US007922277B2

(12) United States Patent
Yoshida

(10) Patent No.: US 7,922,277 B2
(45) **Date of Patent: *Apr. 12, 2011**

(54) PRINTING METHOD, PRINTING APPARATUS, AND PRINTING SYSTEM

(75) Inventor: Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 466 days.

This patent is subject to a terminal disclaimer.

(21) Appl. No.: 11/037,218

(22) Filed: Jan. 19, 2005

(65) Prior Publication Data

US 2005/0185012 A1 Aug. 25, 2005

(30) Foreign Application Priority Data

Jan. 21, 2004 (JP) ..... 2004-013607

(51) Int. Cl.
*B41J 29/393* (2006.01)
*B41J 29/38* (2006.01)

(52) U.S. Cl. ..... 347/19; 347/14

(58) Field of Classification Search ..... 347/15, 347/9, 14, 19, 41

See application file for complete search history.

(56) References Cited

U.S. PATENT DOCUMENTS

| | | | | |
|---|---|---|---|---|
| 6,076,915 | A * | 6/2000 | Gast et al. | 347/19 |
| 6,270,178 | B1 | 8/2001 | Wada et al. | |
| 6,354,688 | B1 * | 3/2002 | Inoue et al. | 347/15 |
| 6,390,583 | B1 | 5/2002 | Kato et al. | |
| 6,582,048 | B1 | 6/2003 | Akahira et al. | |
| 6,692,097 | B2 | 2/2004 | Arima et al. | |
| 6,857,725 | B2 | 2/2005 | Otsuki | |
| 2002/0175962 | A1 * | 11/2002 | Otsuki | 347/15 |
| 2003/0001918 | A1 * | 1/2003 | Tsuchiya et al. | 347/19 |

FOREIGN PATENT DOCUMENTS

| | | | |
|---|---|---|---|
| EP | 0 955 768 | A2 | 11/1999 |
| EP | 1 078 770 | A1 | 2/2001 |
| EP | 1 190 864 | A1 | 3/2002 |
| JP | 06-166247 | A | 6/1994 |
| JP | 2000-307865 | A | 11/2000 |
| JP | 2002-103584 | A | 4/2002 |
| JP | 2002-185783 | A | 6/2002 |
| JP | 2003-34022 | A | 2/2003 |
| JP | 200334063 | A | 2/2003 |
| JP | 2003145851 | A | 5/2003 |
| JP | 2004-174751 | A | 6/2004 |

OTHER PUBLICATIONS

Office Action mailed Jun. 18, 2010 in U.S. Appl. No. 10/576,493.

* cited by examiner

*Primary Examiner* — Matthew Luu
*Assistant Examiner* — Jannelle M Lebron
(74) *Attorney, Agent, or Firm* — Sughrue Mion, PLLC

(57) ABSTRACT

A printing method includes: printing, on a medium, a correction pattern made of lines, the lines being formed by repeating in alternation a dot forming operation of forming dots on the medium by ejecting ink from nozzles that move in a predetermined movement direction, and a carrying operation of carrying the medium in an intersecting direction that intersects the movement direction; measuring, for each line of the correction pattern, the darkness of pixels located on a same line of the correction pattern; obtaining, for each line of the correction pattern, a correction value for correcting a darkness, in the intersecting direction, of an image to be printed based on the darkness of the pixels that has been measured; setting, for each line of the image, the correction value obtained; and forming, in the dot forming operation, dots of a corresponding line for which the correction value has been set such that the darkness of that line becomes a darkness that has been corrected based on that correction value.

18 Claims, 49 Drawing Sheets

TM

| | | | |
|---|---|---|---|
| 1 | 9 | 3 | 11 |
| 13 | 5 | 15 | 7 |
| 4 | 12 | 2 | 10 |
| 16 | 8 | 14 | 6 |

UM

| | | | |
|---|---|---|---|
| 16 | 8 | 14 | 6 |
| 4 | 12 | 2 | 10 |
| 13 | 5 | 15 | 7 |
| 1 | 9 | 3 | 11 |

FIG.19

| MARGIN FORMAT MODE | IMAGE QUALITY MODE | PRINT MODE |
|---|---|---|
| BORDERLESS | FINE | FIRST PRINT MODE |
| | NORMAL | THIRD PRINT MODE |
| BORDERED | FINE | SECOND PRINT MODE |
| | NORMAL | FOURTH PRINT MODE |

FIG.20

| PRINT MODE | PROCESSING MODE |
|---|---|
| FIRST PRINT MODE | FIRST UPPER END PROCESSING MODE, FIRST INTERMEDIATE PROCESSING MODE, FIRST LOWER END PROCESSING MODE |
| SECOND PRINT MODE | FIRST INTERMEDIATE PROCESSING MODE |
| THIRD PRINT MODE | SECOND UPPER END PROCESSING MODE, SECOND INTERMEDIATE PROCESSING MODE, SECOND LOWER END PROCESSING MODE |
| FOURTH PRINT MODE | SECOND INTERMEDIATE PROCESSING MODE |

FIG.46

YELLOW INK

MAGENTA INK

CYAN INK

BLACK INK

| RECORD NUMBER | MEASUREMENT VALUE | | | COMMAND VALUE | | |
|---|---|---|---|---|---|---|
| | Ca | Cc | Cb | Sa | Sc | Sb |
| 1 | | | | | | |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |
| 11 | | | | | | |
| 12 | | | | | | |

⋮

FIG.47

YELLOW INK

MAGENTA INK

CYAN INK

BLACK INK

| RECORD NUMBER | CORRECTION VALUE |
|---|---|
| 1 | |
| 2 | |
| 3 | |
| 4 | |
| 5 | |
| 6 | |
| 7 | |
| 8 | |
| 9 | |
| 10 | |
| 11 | |
| 12 | |
| | |

⋮

PRINTING METHOD, PRINTING APPARATUS, AND PRINTING SYSTEM

CROSS-REFERENCE TO RELATED APPLICATION

The present application claims priority upon Japanese Patent Application No. 2004-13607 filed on Jan. 21, 2004, which is herein incorporated by reference.

BACKGROUND OF THE INVENTION

1. Field of the Invention

The present invention relates to printing methods, printing apparatuses, and printing systems.

2. Description of the Related Art

Inkjet printers (hereinafter referred to simply as "printers") that eject ink onto a medium such as paper to form dots are known as printing apparatuses for printing images. These printers repeat in alternation a dot forming operation of forming dots on a paper by ejecting ink from a plurality of nozzles, which move in the movement direction of a carriage, and a carrying operation of carrying, using a carrying unit, the paper in an intersecting direction (hereinafter, also referred to as the "carrying direction") that intersects the movement direction. By doing this, a plurality of raster lines made of a plurality of dots in the movement direction are formed in the intersecting direction, thereby printing an image.

With this type of printer, there are discrepancies in the ink droplet ejection characteristics, such as the quantity of the ink droplet and the travel direction, among the nozzles. Discrepancies in the ejection characteristics are a cause of darkness nonuniformities in printed images, and thus are not preferable. Accordingly, a conventional method involves setting a correction value for each nozzle and adjusting the quantity of ink based on those correction values that are set. (See, for example, JP H06-166247A (pg. 4, 7, and 8).)

With this conventional method, first, correction patterns are printed on the paper. Printing of these correction patterns is performed by moving a head, which is provided with the nozzles, in a scanning direction while intermittently ejecting ink from all of the nozzles. Then, the darkness of the correction patterns that are printed is measured for each pixel. This darkness measurement is performed in the carrying direction for one spot in the scanning direction of the correction patterns.

However, with this conventional method, there is a possibility that the darkness that is obtained will change depending on the measurement position, even when measuring the same pixel. This is due to the fact that the dots that are formed are circular. In other words, with this type of printer, the dots that land on the paper spread out in a circular manner. The darkness thus differs between a case where the darkness is measured along a straight line that passes over the center of the dot and a case where the darkness is measured along a straight line that passes over the edge of the dot. That is, the darkness of the latter will be lower than the darkness of the former. Therefore, it is difficult to obtain an accurate darkness by measuring only one spot in the main-scanning direction.

Further, with this method there is also a possibility that the quality of the printed image will drop if interlacing is adopted as the print mode. Interlacing is a print mode in which a raster line that is not formed is set between raster lines that are formed in a single dot forming operation, and through a plurality of dot forming operations all of the raster lines are formed in a complementary manner, and with this print mode, adjacent raster lines are not printed by the same nozzle. Also, with interlacing, the nozzle that forms an adjacent raster line will not always be the adjacent nozzle. That is to say, it is possible for the combination of nozzles that form adjacent raster lines in the printed image to be different from the combination in the correction patterns. Here, darkness nonuniformities caused by bending in the flight path of the ink occur due to the spacing between adjacent raster lines becoming small or large, and also occur due to the combination of the nozzles forming the adjacent raster lines. Therefore, it is difficult to correct darkness nonuniformities that result from the combination of raster lines and nozzles using a correction pattern that is printed by ejecting ink from all of the nozzles.

SUMMARY OF THE INVENTION

The present invention was arrived at in light of the foregoing issues, and it is an object thereof to achieve a printing method, a printing apparatus, and a printing system with which darkness nonuniformities can be effectively inhibited.

An aspect of the present invention is a printing method comprising the steps of:

printing, on a medium, a correction pattern that is made of a plurality of lines, the plurality of lines being formed by repeating in alternation a dot forming operation of forming dots on the medium by ejecting ink from a plurality of nozzles that move in a predetermined movement direction, and a carrying operation of carrying the medium in an intersecting direction that intersects the movement direction;

measuring, for each line of the correction pattern, the darkness of a plurality of pixels located on a same line of the correction pattern;

obtaining, for each line of the correction pattern, a correction value for correcting a darkness, in the intersecting direction, of an image to be printed based on the darkness of the plurality of pixels that has been measured;

setting, for each line of the image, the correction value that has been obtained; and forming, in the dot forming operation, dots of a corresponding line for which the correction value has been set such that the darkness of that line becomes a darkness that has been corrected based on that correction value.

Other features of the present invention will become clear through the accompanying drawings and the following description.

BRIEF DESCRIPTION OF THE DRAWINGS

FIG. 19 is a first reference table showing the print modes corresponding to the various combinations between the margin format mode and the image quality mode;

FIG. 20 is a second reference table showing the processing modes corresponding to the various print modes.;

FIG. 46 is a conceptual diagram of the recording table that is used for obtaining the other correction values;

FIG. 47 is a conceptual diagram of the correction value storage section, and shows a correction value table for storing the other correction values;

DETAILED DESCRIPTION OF THE INVENTION

Figure 1:
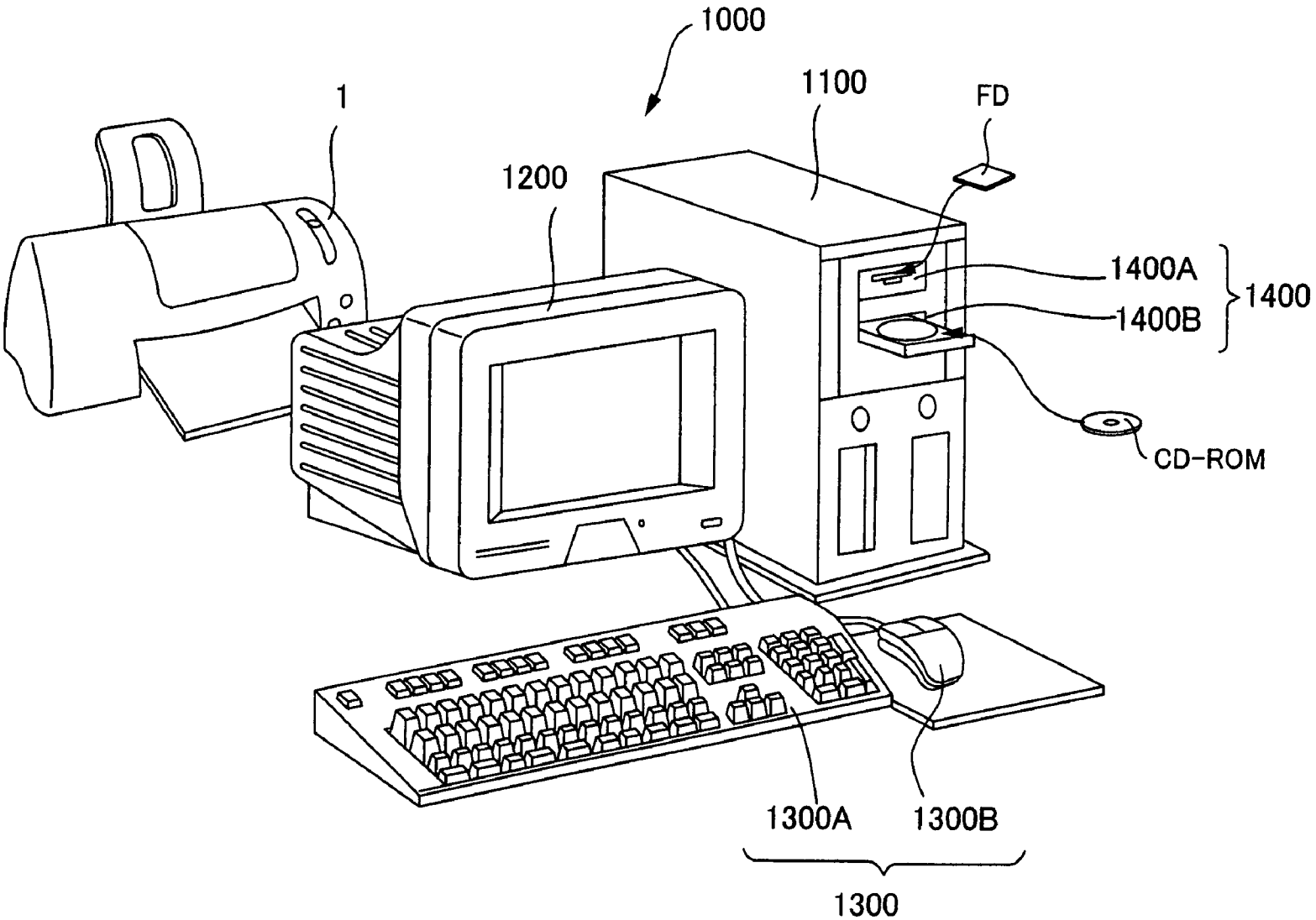
FIG. 1 is an explanatory diagram of an overall configuration of a printing system.

At least the following matters will become clear by the explanation in the present specification and the description of the accompanying drawings.

A printing method comprises the steps of: printing, on a medium, a correction pattern that is made of a plurality of lines, the plurality of lines being formed by repeating in alternation a dot forming operation of forming dots on the medium by ejecting ink from a plurality of nozzles that move in a predetermined movement direction, and a carrying operation of carrying the medium in an intersecting direction that intersects the movement direction; measuring, for each line of the correction pattern, the darkness of a plurality of pixels located on a same line of the correction pattern; obtaining, for each line of the correction pattern, a correction value for correcting a darkness, in the intersecting direction, of an image to be printed based on the darkness of the plurality of pixels that has been measured; setting, for each line of the image, the correction value that has been obtained; and forming, in the dot forming operation, dots of a corresponding line for which the correction value has been set such that the darkness of that line becomes a darkness that has been corrected based on that correction value.

According to this printing method, the darkness of a plurality of pixels located on the same line of a correction pattern is measured, and a correction value is obtained based on the darkness of the pixels that is measured, the correction value is set for each line, and the dots of a corresponding line are formed such that the darkness becomes a darkness after correction based on this correction value. Therefore, darkness irregularities caused by differences in the measurement positions of the dots can be cancelled out. Thus, darkness nonuniformities in the image can be effectively inhibited.

Further, it is preferable that there are provided a plurality of types of processing modes for executing print processing, in which at least one of the carrying operation and the dot forming operation is different from that in another print processing; and that in obtaining the correction value, at least two correction patterns each corresponding to a different one of the processing modes are each printed on the medium by the corresponding type of processing mode, of among the plurality of types of processing modes, and the correction value is obtained for each processing mode.

According to this printing method, there is a darkness correction value for each line for at least two types of processing modes. Further, when printing an image using either one of the at least two types of processing modes, the darkness of the lines is corrected based on the correction value corresponding to that line of the image. Consequently, regardless of the processing mode that is used to print the image, the most appropriate correction value for that mode can be adopted for the lines of the image. Thus, darkness irregularities between lines can be effectively reduced, allowing darkness nonuniformities to be effectively inhibited.

Further, it is preferable that the correction value is obtained from an average value of the darkness of the plurality of pixels that has been measured.

According to this printing method, the correction value is obtained from an average value of the darkness of a plurality of pixels that has been measured, and thus darkness irregularities caused by differences in the measurement position of the dots can be cancelled out at a higher level, allowing darkness nonuniformities in the image to be effectively inhibited.

Further, it is preferable that an other correction value for correcting a darkness, in the movement direction, of the image is set for each pixel aligned in the movement direction; and that in the dot forming operation, dots of a corresponding line for which the correction value and the other correction value have been set are formed at a darkness that has been corrected based on the correction value and the other correction value.

According to this printing method, the darkness is corrected also taking into account an other correction value that is set for each pixel lined up in the movement direction, and thus the darkness of the entire line can be corrected by the correction value, and the darkness of each of the dots making up that line is corrected by the other correction value. As a result, darkness nonuniformities in the movement direction as well can be inhibited, allowing darkness nonuniformities in the image to be effectively inhibited.

Further, it is preferable that the other correction value is obtained by: printing, on the medium, an other correction pattern; measuring the darkness of a plurality of pixels located at a same position, in the movement direction, of the other correction pattern; and obtaining the other correction value based on the darkness of the plurality of pixels that has been measured.

According to this printing method, the other correction values are obtained based on the darkness of a plurality of pixels located at the same position in the movement direction, and the dots of the corresponding line are formed such that their darkness becomes the darkness after correction based on the correction value. Therefore, for darkness nonuniformities in the movement direction as well, the darkness irregularities caused by differences in the measurement position of the dots can be cancelled out. Thus, darkness nonuniformities in the image can be effectively inhibited.

Further, it is preferable that the other correction value is obtained from an average value of the darkness of the plurality of pixels that has been measured.

According to this printing method, the other correction value is obtained from an average value of the darkness of the plurality of pixels that is measured, and thus darkness irregularities caused by differences in the measurement position of the dots can be cancelled out. As a result, darkness nonuniformities in the image can be more effectively inhibited.

Further, it is preferable that the other correction pattern is printed such that its darkness becomes the darkness corrected by the correction value, and the other correction value is obtained based on that other correction pattern.

According to this printing method, the other correction pattern is printed in such a manner that its darkness becomes the darkness corrected by the correction value, thereby correcting darkness nonuniformities in the intersecting direction. Then, the pixel darkness of this other correction pattern in which darkness nonuniformities in the intersecting direction have been corrected is measured to obtain the other correction values, and thus irregularities in the darkness of the measured pixels can be suppressed. As a result, the reliability of the other correction values can be increased.

Further, it is preferable that the plurality of pixels whose darkness is to be measured are adjacent to one another.

According to this printing method, the problem of selectively measuring only spots where darkness nonuniformities have occurred, in a case where darkness nonuniformities appear in a periodic manner, can be reliably prevented. As a result, the reliability of the correction values and the other correction values can be increased.

Further, it is preferable that the correction pattern has a plurality of types of patterns each having a different darkness.

According to this printing method, the correction value of a target line is obtained based on the pixel darkness found using a plurality of types of patterns having different darkness, and thus the correction value can be found by performing processing such as primary interpolation with respect to the data obtained at the various darkness. As a result, the correction values can be obtained efficiently.

Further, it is preferable that the other correction pattern has a plurality of types of patterns each having a different darkness.

According to this printing method, the other correction value of a target pixel is obtained based on the pixel darkness found using a plurality of types of patterns having different darkness, and thus the other correction value can be found by performing processing such as primary interpolation with respect to the data obtained at the various darkness. As a result, the other correction value can be obtained efficiently.

Further, it is preferable that the darkness of the plurality of pixels is measured using a scanner device that is capable of reading an image that has been printed on the medium as data groups in units of pixels.

According to this printing method, data groups corresponding to the correction patterns or the other correction patterns can be handled together, allowing increased processing efficiency to be attained.

Further, it is preferable that at least one of a movement-side reference ruled line extending in the movement direction and an intersecting-side reference ruled line extending in the intersecting direction is formed on the medium together with the correction pattern or the other correction pattern; that the data groups read by the scanner device are corrected based on the reference ruled line; and that the darkness of the plurality of pixels is measured for the data groups that have been corrected.

According to this printing method, even if, when reading a correction pattern or an other correction pattern with the scanner device, that pattern is read shifted from the normal position, this shifting can be corrected using the movement-side reference ruled line or the intersecting-side reference ruled line. Further, because the pixel darkness is measured after this shifting has been corrected, the reliability of the correction value or the other correction value can be increased. Further, this shifting of the pattern can be automatically corrected through image processing. Thus, an increase in processing efficiency can be attained.

Further, it is preferable that a plurality of the nozzles constitute a nozzle row aligned in the intersecting direction.

According to this printing method, the nozzles are arranged in rows in the intersecting direction, thus widening the range over which dots are formed in a single dot forming operation and allowing the printing time to be shortened.

Further, it is preferable that the nozzle row is provided for each color of the ink; that by printing at least one of the correction pattern and the other correction pattern for each color, at least one of the correction value and the other correction value is provided for each color; and that the darkness of the image is corrected for each color based on at least one of the correction value and the other correction value for that color.

According to this printing method, a nozzle row is provided for each ink color, and thus multicolor printing can be performed. Further, because the darkness of the image is corrected for each color based on the correction values and the other correction values for each color, it is possible to effectively inhibit darkness nonuniformities in the image during multicolor printing.

Further, it is preferable that a line that is not formed is set between the lines that are formed in a single dot forming operation; and that the lines are formed in a complementary manner through a plurality of the dot forming operations.

According to this printing method, darkness nonuniformities in the image can be effectively inhibited even in a case where the relationship between the nozzles responsible for adjacent lines does not match the order in which the nozzles constituting the nozzle rows are arranged.

Further, it is preferable that the print processing being different in the carrying operation is print processing in which a pattern of change in a carry amount of each carrying operation is different from that in another print processing; and that the print processing being different in the dot forming operation is print processing in which a pattern of change in the nozzles that are used in each dot forming operation is different from that in another print processing.

According to this printing method, because the processing modes are different for each pattern of change in the carry amount, a correction pattern is printed for each change pattern and each change pattern is provided with a correction value. Consequently, it is possible to respond to a change in the combination of nozzles forming adjacent lines, which changes for each change pattern. As a result, each line can be corrected by the most suitable correction value. Further, because the processing modes are different for each pattern of change in the nozzles that are used, a correction pattern is printed for each change pattern and each change pattern is provided with a correction value. Consequently, it is possible to respond to a change in the combination of nozzles forming adjacent lines, which changes for each change pattern. As a result, each line can be corrected by the most suitable correction value.

It is also possible to achieve a printing method comprising the steps of: printing, on a medium, a correction pattern that is made of a plurality of lines, the plurality of lines being formed by repeating in alternation a dot forming operation of forming dots on the medium by ejecting ink from a plurality of nozzles that move in a predetermined movement direction, and a carrying operation of carrying the medium in an intersecting direction that intersects the movement direction; measuring, for each line of the correction pattern, the darkness of a plurality of pixels located on a same line of the correction pattern; obtaining, for each line of the correction pattern, a correction value for correcting a darkness, in the intersecting direction, of an image to be printed based on the darkness of the plurality of pixels that has been measured; setting, for each line of the image, the correction value that has been obtained; and forming, in the dot forming operation, dots of a corresponding line for which the correction value has been set such that the darkness of that line becomes a darkness that has been corrected based on that correction value; wherein there are provided a plurality of types of processing modes for executing print processing, in which at least one of the carrying operation and the dot forming operation is different from that in another print processing; wherein in obtaining the correction value, at least two correction patterns each corresponding to a different one of the processing modes are each printed on the medium by the corresponding type of processing mode, of among the plurality of types of processing modes, and the correction value is obtained for each processing mode; wherein the correction value is obtained from an average value of the darkness of the plurality of pixels that has been measured; wherein an other correction value for correcting a darkness, in the movement direction, of the image is set for each pixel aligned in the movement direction; wherein in the dot forming operation, dots of a corresponding line for which the correction value and the other correction value have been set are formed at a darkness that has been corrected based on the correction value and the other correction value; wherein the other correction value is obtained by: printing, on the medium, an other correction pattern; measuring the darkness of a plurality of pixels located at a same position, in the movement direction, of the other correction pattern; and obtaining the other correction value based on the darkness of the plurality of pixels that has been measured; wherein the other correction value is obtained from an average value of the darkness of the plurality of pixels that has been measured; wherein the other correction pattern is printed such that its darkness becomes the darkness corrected by the correction value, and the other correction value is obtained based on that other correction pattern; wherein the plurality of pixels whose darkness is to be measured are adjacent to one another; wherein the correction pattern has a plurality of types of patterns each having a different darkness; wherein the other correction pattern has a plurality of types of patterns each having a different darkness; wherein the darkness of the plurality of pixels is measured using a scanner device that is capable of reading an image that has been printed on the medium as data groups in units of pixels; wherein at least one of a movement-side reference ruled line extending in the movement direction and an intersecting-side reference ruled line extending in the intersecting direction is formed on the medium together with the correction pattern or the other correction pattern; wherein the data groups read by the scanner device are corrected based on the reference ruled line; wherein the darkness of the plurality of pixels is measured for the data groups that have been corrected; wherein a plurality of the nozzles constitute a nozzle row aligned in the intersecting direction; wherein the nozzle row is provided for each color of the ink; wherein, by printing at least one of the correction pattern and the other correction pattern for each color, at least one of the correction value and the other correction value is provided for each color; wherein the darkness of the image is corrected for each color based on at least one of the correction value and the other correction value for that color; wherein a line that is not formed is set between the lines that are formed in a single dot forming operation; wherein the lines are formed in a complementary manner through a plurality of the dot forming operations; wherein the print processing being different in the carrying operation is print processing in which a pattern of change in a carry amount of each carrying operation is different from that in another print processing; and wherein the print processing being different in the dot forming operation is print processing in which a pattern of change in the nozzles that are used in each dot forming operation is different from that in another print processing.

With this printing method, substantially all of the effects mentioned above are attained, and thus the object of the present invention is more effectively achieved.

It is also possible to achieve a printing apparatus comprising: nozzles for ejecting ink; and a carrying unit for carrying a medium; wherein by repeating in alternation a dot forming operation of forming dots on the medium by ejecting ink from a plurality of the nozzles that move in a predetermined movement direction, and a carrying operation of carrying the medium in an intersecting direction that intersects the movement direction using the carrying unit, the printing apparatus forms, in the intersecting direction, a plurality of lines each made of a plurality of dots aligned in the movement direction to print an image; wherein a correction value for correcting a darkness, in the intersecting direction, of the image is set for each line; wherein in the dot forming operation, dots of a corresponding line for which the correction value has been set are formed such that the darkness of that line becomes a darkness that has been corrected based on the correction value; and wherein the correction value is obtained by: printing, on the medium, a correction pattern that is made of a plurality of the lines; measuring, for each line of the correction pattern, the darkness of a plurality of pixels located on a same line of the correction pattern; and obtaining, for each line of the correction pattern, the correction value based on the darkness of the plurality of pixels that has been measured.

It is also possible to achieve a printing system comprising: a computer; and a printing apparatus that is communicably connected to the computer, and that is provided with nozzles for ejecting ink and a carrying unit for carrying a medium; wherein by repeating in alternation a dot forming operation of forming dots on the medium by ejecting ink from a plurality of the nozzles that move in a predetermined movement direction, and a carrying operation of carrying the medium in an intersecting direction that intersects the movement direction using the carrying unit, the printing system forms, in the intersecting direction, a plurality of lines each made of a plurality of dots aligned in the movement direction to print an image; wherein a correction value for correcting a darkness, in the intersecting direction, of the image is set for each line; wherein in the dot forming operation, dots of a corresponding line for which the correction value has been set are formed such that the darkness of that line becomes a darkness that has been corrected based on the correction value; and wherein the correction value is obtained by: printing, on the medium, a correction pattern that is made of a plurality of the lines; measuring, for each line of the correction pattern, the darkness of a plurality of pixels located on a same line of the correction pattern; and obtaining, for each line of the correction pattern, the correction value based on the darkness of the plurality of pixels that has been measured.

===Configuration of the Printing System===

An embodiment of a printing system is described next with reference to the drawings.

FIG. 1 is an explanatory diagram showing the external structure of the printing system. This printing system is provided with an inkjet printer 1 (hereinafter, referred to simply as "printer 1"), a computer 1100, a display device 1200, an input device 1300, and a record/play device 1400. The printer 1 is a printing apparatus for printing images on a medium such as paper, cloth, or film. It should be noted that the following description is made using paper S (see FIG. 9), which is a representative medium, as an example of the medium. The computer 1100 is communicably connected to the printer 1, and outputs print data corresponding to an image to be printed to the printer 1 in order to print the image with the printer 1. The display device 1200 has a display, and displays a user interface such as an application program or a printer driver 1110 (see FIG. 2). The input device 1300 is for example a keyboard 1300A and a mouse 1300B, and is used to operate the application program or adjust the settings of the printer driver 1110, for example, through the user interface that is displayed on the display device 1200. A flexible disk drive device 1400A and a CD-ROM drive device 1400B, for example, are employed as the record/play device 1400.

The printer driver 1110 is installed on the computer 1100. The printer driver 1110 is a program for achieving the function of displaying the user interface on the display device 1200, and in addition it also achieves the function of converting image data that have been output from the application program into print data. The printer driver 1110 is recorded on a storage medium (computer-readable storage medium) such as a flexible disk FD or a CD-ROM. Further, the printer driver 1110 can be downloaded onto the computer 1100 via the Internet. This program is made of codes for achieving various functions.

It should be noted that "printing apparatus" in a narrow sense means the printer 1, but in a broader sense it means the system constituted by the printer 1 and the computer 1100.

===Printer Driver===

<Regarding the Printer Driver>

Figure 2:
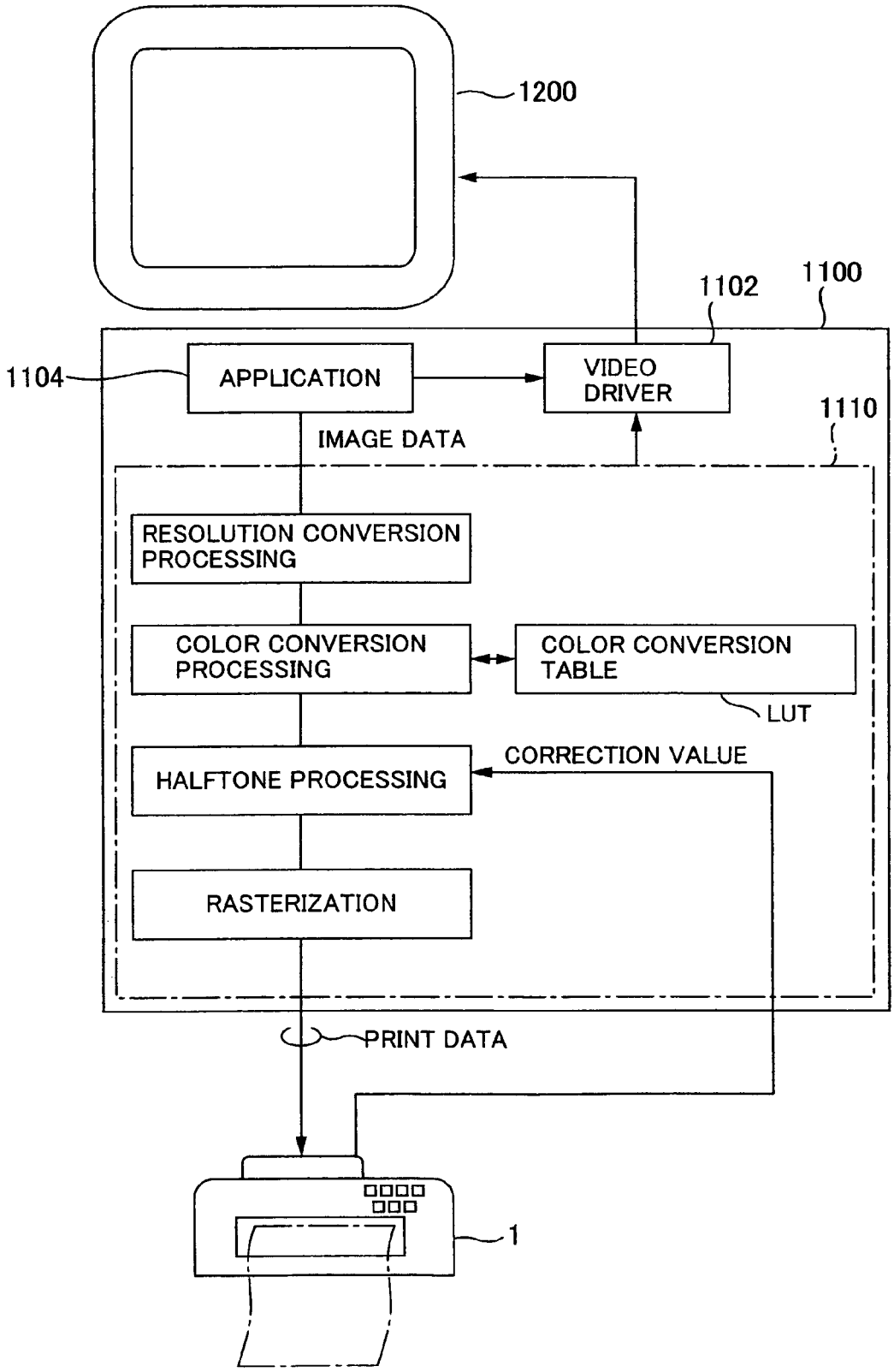
FIG. 2 is an explanatory diagram of the processing performed by the printer driver.

FIG. 2 is a schematic explanatory diagram of the basic processes carried out by the printer driver 1110. It should be noted that structural elements that have already been described are assigned identical reference numerals and thus further description thereof is omitted.

On the computer 1100, computer programs such as a video driver 1102, an application program 1104, and the printer driver 1110 operate under an operating system installed on the computer 1100. The video driver 1102 has a function of displaying, for example, the user interface on the display device 1200 in accordance with display commands from the application program 1104 and the printer driver 1110. The application program 1104 has, for example, the function of performing image editing, and creates data (image data) related to an image. A user can give an instruction to print an image edited by the application program 1104 via the user interface of the application program 1104. Upon receiving the print instruction, the application program 1104 outputs image data to the printer driver 1110.

The printer driver 1110 receives the image data from the application program 1104, converts the image data into print data, and outputs the print data to the printer 1. The image data have pixel data as the data on the pixels of the image to be printed. The gradation values, for example, of the pixel data are then converted in accordance with the processing stage, which are described later, and ultimately, at the print data stage are converted into data on the dots to be formed on the paper (data such as the color and the size of the dots).

It should be noted that "pixels" are the virtually determined square grids on the paper for defining the positions onto which ink lands to form dots. In other words, the pixels are regions on the paper on which dots can be formed, and can be thought of as "dot formation units."

Print data are data in a format that can be interpreted by the printer 1, and include various command data and pixel data. Here, "command data" refers to data for instructing the printer 1 to carry out a specific operation, and are data indicating the carry amount, for example.

In order to convert the image data that are output from the application program 1104 into print data, the printer driver 1110 carries out processes such as resolution conversion, color conversion, halftone processing, and rasterization. The various processes carried out by the printer driver 1110 are described below.

Resolution conversion is a process for converting image data (text data, image data, etc.) output from the application program 1104 to a resolution (the spacing between dots when printing; also referred to as "print resolution") for when printing an image on the paper S. For example, when the print resolution is designated as 720×720 dpi, then the image data obtained from the application program 1104 are converted into image data having a resolution of 720×720 dpi.

Pixel data interpolation and thinning-out are examples of this conversion method. For example, if the resolution of the image data is lower than the print resolution that has been designated, then linear interpolation or the like is performed to create new pixel data between adjacent pixel data. On the other hand, if the resolution of the image data is higher than the print resolution, then the pixel data are thinned out, for example, at a set ratio to make the image-data resolution match the print resolution.

Further, in this resolution conversion processing, the size of the "print region" (which is the region to which ink is actually ejected) is adjusted based on the image data. This size adjustment is performed by trimming, for example, the pixel data that correspond to the ends of the paper S of the image data, in accordance with the margin format mode, the image quality mode, and the paper size mode, which are described later.

It should be noted that the pixel data of the image data have a gradation value of many gradations (for example, 256 gradations) expressed by the RGB color space. The pixel data having this RGB gradation value are hereinafter referred to as "RGB pixel data," and the image data made of these RGB pixel data are referred to as "RGB image data."

Color conversion processing is for converting each piece of RGB pixel data of the RGB image data into data having a gradation value of many gradations (for example, 256) expressed by the CMYK color space. CMYK are the ink colors of the printer 1. That is, C stands for cyan. Further, M stands for magenta, Y for yellow, and K for black. Hereinafter, the pixel data having CMYK gradation values are referred to as "CMYK pixel data", and the image data made of these CMYK pixel data are referred to as "CMYK image data". Color conversion processing is carried out by the printer driver 1110, with reference to a table (color conversion lookup table LUT) that correlates RGB gradation values and CMYK gradation values.

Halftone processing is for converting CMYK pixel data having many gradation values into CMYK pixel data having fewer gradation values that can be expressed by the printer 1. For example, through halftone processing, CMYK pixel data having a gradation value of 256 gradations are converted into 2-bit CMYK pixel data having a gradation value of four gradations. For example, the 2-bit CMYK pixel data indicate, for each color, "no dot formation" (binary value "00"), "small dot formation" (binary value "01"), "medium dot formation" (binary value "10"), and "large dot formation" (binary value "11").

Dithering or the like is used for halftone processing to create 2-bit CMYK pixel data with which the printer 1 can form dispersed dots. It should be noted that halftone processing according to dithering is described later. Further, the method used for halftone processing is not limited to dithering, and it is also possible to use γ-correction or error diffusion. It should be noted that in halftone processing in this embodiment, darkness correction based on the correction value or on the other correction value is performed. Darkness correction will be described in detail later.

Rasterization is for changing the CMYK pixel data that have been subjected to halftone processing into the data order in which they are to be transferred to the printer 1. Data that have been rasterized are output to the printer 1 as print data.

<Halftone Processing According to Dithering>

Figure 3:
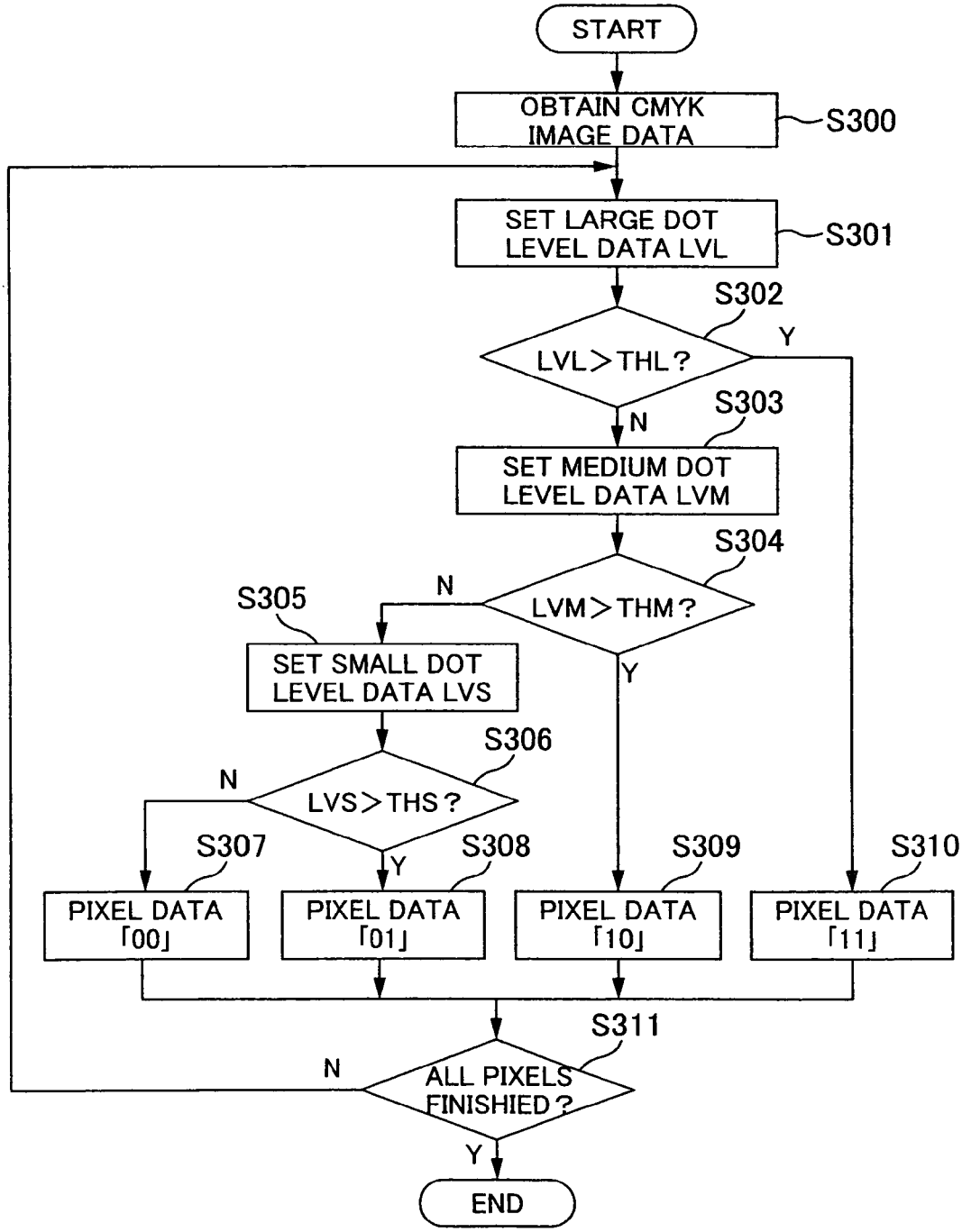
FIG. 3 is a flowchart of halftone processing according to dithering.

Here, halftone processing according to dithering is described. FIG. 3 is a flowchart of halftone processing according to dithering. The printer driver 1110 performs the following steps in accordance with this flowchart.

First, in step S300, the printer driver 1110 obtains the CMYK image data. The CMYK image data are made of image data expressed by gradation values of 256 gradations for each ink color C, M, Y, and K. In other words, the CMYK image data include C image data for cyan (C), M image data for magenta (M), Y image data for yellow (Y), and K image data for black (K). These C, M, Y, and K image data are respectively made of C, M, Y, and K pixel data indicating the gradation values of that ink color. It should be noted that the following description can be applied to any of the C, M, Y, and K image data, and therefore, the K image data are described as a representative.

The printer driver 1110 performs the processing of the steps S301 to S311 for all of the K pixel data of the K image data while successively changing the K pixel data to be processed. Through this processing, the K image data are converted into 2-bit data having a gradation value of the four gradations mentioned above for each K pixel data.

Figure 4:
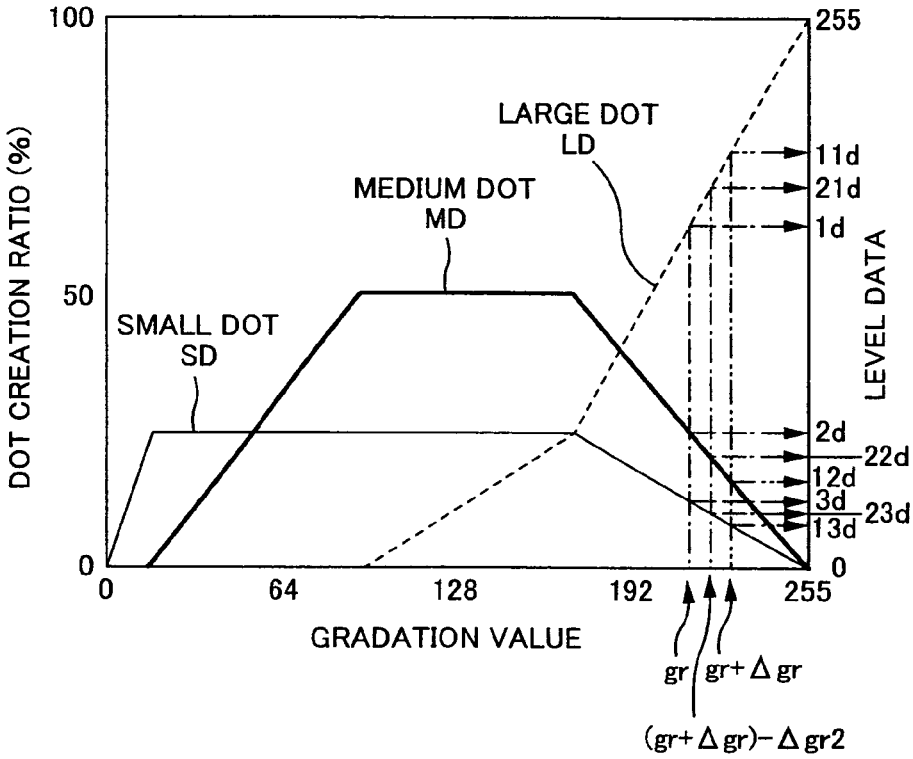
FIG. 4 is a diagram showing a dot creation ratio table.

This conversion processing is described in detail here. First, in step S301, the large dot level LVL is set in accordance with the gradation value of the K pixel data to be processed. This setting is performed through the following procedure, using for example a creation ratio table. FIG. 4 is a diagram showing a creation ratio table that is used for setting the level data for each of the large, medium, and small dots. In this diagram, the horizontal axis indicates gradation values (0-255), the vertical axis on the left is the dot creation ratio (%), and the vertical axis on right is the level data (0-255). Here, the level data refers to data whose dot creation ratio has been converted to one of 256 gradation values from 0 to 255. Further, the "dot creation ratio" is used to mean the proportion of pixels at which dots are formed among the pixels that exist within a uniform region reproduced according to a constant gradation value. For example, take a case where the dot creation ratio for a particular gradation value is large dot 65%, medium dot 25%, and small dot 10%, and at this dot creation ratio, a region of 100 pixels made of 10 pixels in the vertical direction by 10 pixels in the horizontal direction is printed. In this case, of the 100 pixels, 65 of the pixels will be formed by large dots, 25 of the pixels will be formed by medium dots, and 10 of the pixels will be formed by small dots. The profile SD shown by the thin solid line in FIG. 4 indicates the dot creation ratio of the small dots. Further, the profile MD shown by the thick solid line indicates the dot creation ratio of the medium dots, and the profile LD shown by the dotted line indicates the creation ratio of the large dots.

Consequently, in step S301, the level data LVL corresponding to the gradation value are read from the profile LD for large dots. For example, as shown in FIG. 4, if the gradation value of the K pixel data to be processed is gr, then the level data LVL is determined to be id from the point of intersection with the profile LD. In practice, the profile LD is stored in the form of a one-dimensional table on a memory (not shown) such as a ROM within the computer 1100, and the printer driver 1110 finds the level data by referencing this table.

In step S302, it is determined whether or not the level data LVL that has been set as above is larger than the threshold value THL. Here, determination of whether the dots are on or off is performed using dithering. The threshold value THL is set to a different value for each pixel block of the so-called dither matrix. This embodiment uses a dither matrix in which a value from 0 to 254 is expressed for each square of a 16×16 square pixel block.

Figure 5:
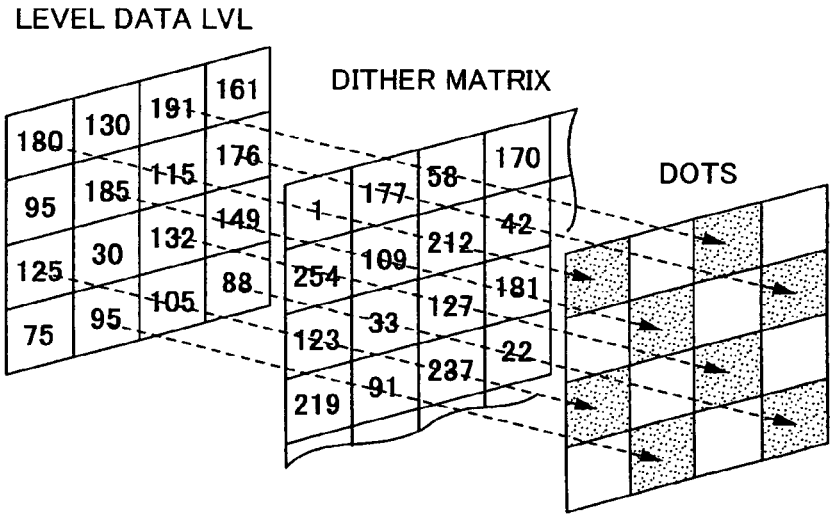
FIG. 5 is a diagram showing how dots are determined to be on or off according to dithering.

FIG. 5 is a diagram illustrating how dots are determined to be on or off according to dithering. For the convenience of illustration, FIG. 5 shows only some of the K pixel data. First, the level data LVL of each K pixel data is compared with the threshold value THL of the pixel block on the dither matrix that corresponds to that K pixel data. Then, if the level data LVL is larger than the threshold value THL, the dot is set to on, and if the level data LVL is smaller, the dot is set to off. In this diagram, the pixel data of the shaded regions in the dot matrix are the K pixel data in which the dots are set to on (that is, dots are formed). In other words, in step S302, if the level data LVL is larger than the threshold value THL, then the procedure advances to step S310, and otherwise the procedure advances to step S303. Here, if the procedure is advanced to step S310, then the printer driver 1110 assigns a value of "11" to the K pixel data being processed, storing it as the pixel data (2-bit data) indicating a large dot, and then the procedure is advanced to step S311. Then, in step S311, it is determined whether or not all of the K pixel data have been processed, and if processing is finished, then halftone processing is ended, and if processing is not finished, then the K pixel data that have not yet been processed are set as the target of processing, and the procedure is returned to step S301.

On the other hand, if the procedure is advanced to step S303, then the printer driver 1110 sets the medium dot level data LVM. The medium dot level data LVM is set using the creation ratio table mentioned above based on the gradation value. The setting method is the same as that for setting the large dot level data LVL. That is, in the example shown in FIG. 4, the level data LVM corresponding to the gradation value gr is found to be 2d, which is indicated by the point of intersection with the profile MD that indicates the medium dot creation ratio.

Next, in step S304, the medium dot level data LVM is compared in size with the threshold value THM to determine whether or not the medium dot is on or off. The method by which dots are determined to be either on or off is the same that as that for large dots. However, when determining whether medium dots are on or off, the threshold values THM used for this determination are set to values that are different from the threshold values THL for large dots. That is, if the dots are determined to be on or off using the same dither matrix for the large dots and the medium dots, then the pixel blocks where the dot is likely to be on will be the same in both cases. That is, there is a high possibility that when a large dot is off, the medium dot will also be off. As a result, there is a possibility that the creation ratio of medium dots will be lower than the desired creation ratio. In order to prevent this problem, in the present embodiment there are different dither matrices for large dots and medium dots. That is, by changing the pixel blocks that are likely to be on between the large dots and the medium dots, the dots are formed appropriately.

Figures 6A, 6B, 7:
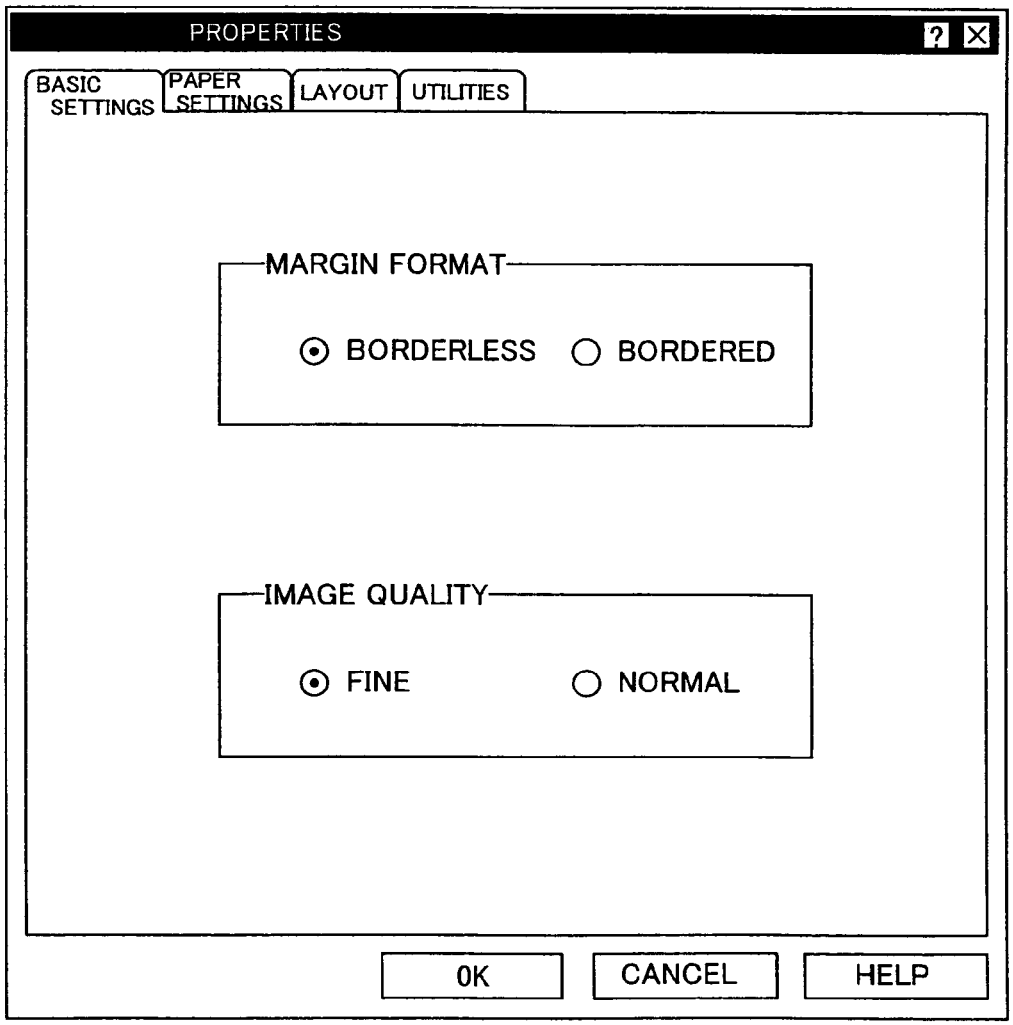
FIG. 6A is a dither matrix used in determining large dots.
FIG. 6B is a dither matrix used in determined medium dots.
FIG. 7 is an explanatory diagram of the user interface of the printer driver.

FIG. 6A and FIG. 6B show the relationship between the dither matrix that is used for assessing large dots and the dither matrix that is used for assessing medium dots. In this embodiment, the first dither matrix TM of FIG. 6A is used for the large dots. The second dither matrix UM of FIG. 6B is used for the medium dots. The second dither matrix UM is obtained by symmetrically shifting the threshold values in the first dither matrix TM about the center in the carrying direction (the vertical direction in these diagrams). As explained previously, the present embodiment uses a 16×16 matrix, but for convenience of illustration, FIG. 6 shows a 4×4 matrix. It should be noted that it is also possible to use completely different dither matrices for the large dots and medium dots.

Then, instep S304, if the medium dot level data LVM is larger than the medium dot threshold value THM, then it is determined that the medium dot should be on, and the procedure is advanced to step S309, and otherwise the procedure is advanced to step S305. Here, if the procedure is advanced to step S309, then the printer driver 1110 assigns a value of "10" to the K pixel data being processed, storing it as pixel data indicating a medium dot, and then the procedure is advanced to step S311. Then, in step S311, it is determined whether or not all of the K pixel data have been processed, and if processing is finished, then halftone processing is ended, and if processing is not finished, then the K pixel data that have not yet been processed are set as the target of processing, and the procedure is returned to step S301.

On the other hand, if the procedure is advanced to step S305, then the small dot level data LVS is set in the same way that the level data of the large dots and the medium dots are set. It should be noted that the dither matrix for the small dots is preferably different from those for the medium dots and the large dots, in order-to prevent a drop in the creation ratio of small dots as discussed above.

Then, instep S306, the printer driver 1110 compares the level data LVS and the small dot threshold values THS, and if the small dot level data LVS is larger than the small dot threshold value THS, then the procedure is advanced to step S308, and otherwise the procedure is advanced to step S307. Here, if the procedure is advanced to step S308, then a value of "01" for pixel data that indicate a small dot is assigned to the K pixel data being processed and the data are stored, and then the procedure is advanced to step S311. Then, in step S311, it is determined whether or not all of the K pixel data have been processed, and if processing is not finished, then the K pixel data that have not yet been processed are set as the target of processing, and the procedure is returned to step S301. On the other hand, if processing is finished, then halftone processing for the K image data is ended, and halftone processing is performed in the same manner for the image data of the other colors.

On the other hand, if the procedure is advanced to step S307, then the printer driver 1110 assigns a value of "00" to the K pixel data being processed and stores it as pixel data indicating that not dot is to be formed, and then the procedure is advanced to step S311. Then, in step S311, it is determined whether or not all of the K pixel data have been processed, and if processing is not finished, then the K pixel data that have not yet been processed are set as the target of processing, and the procedure is returned to step S301. On the other hand, if processing is finished, then halftone processing for the K image data is ended, and halftone processing is performed in the same way for the image data of the other colors.

<Regarding Setting the Printer Driver>

FIG. 7 is an explanatory diagram of the user interface of the printer driver 1110. The user interface of the printer driver 1110 is displayed on the display device 1200 via the video driver 1102. The user can use the input device 1300 to change the various settings of the printer driver 1110. The settings for "margin format mode" and "image quality mode" are prepared as the basic settings, and settings such as "paper size mode" are prepared as the paper settings. These modes are described later.

===Configuration of Printer===

<Configuration of Printer>

Figure 8:
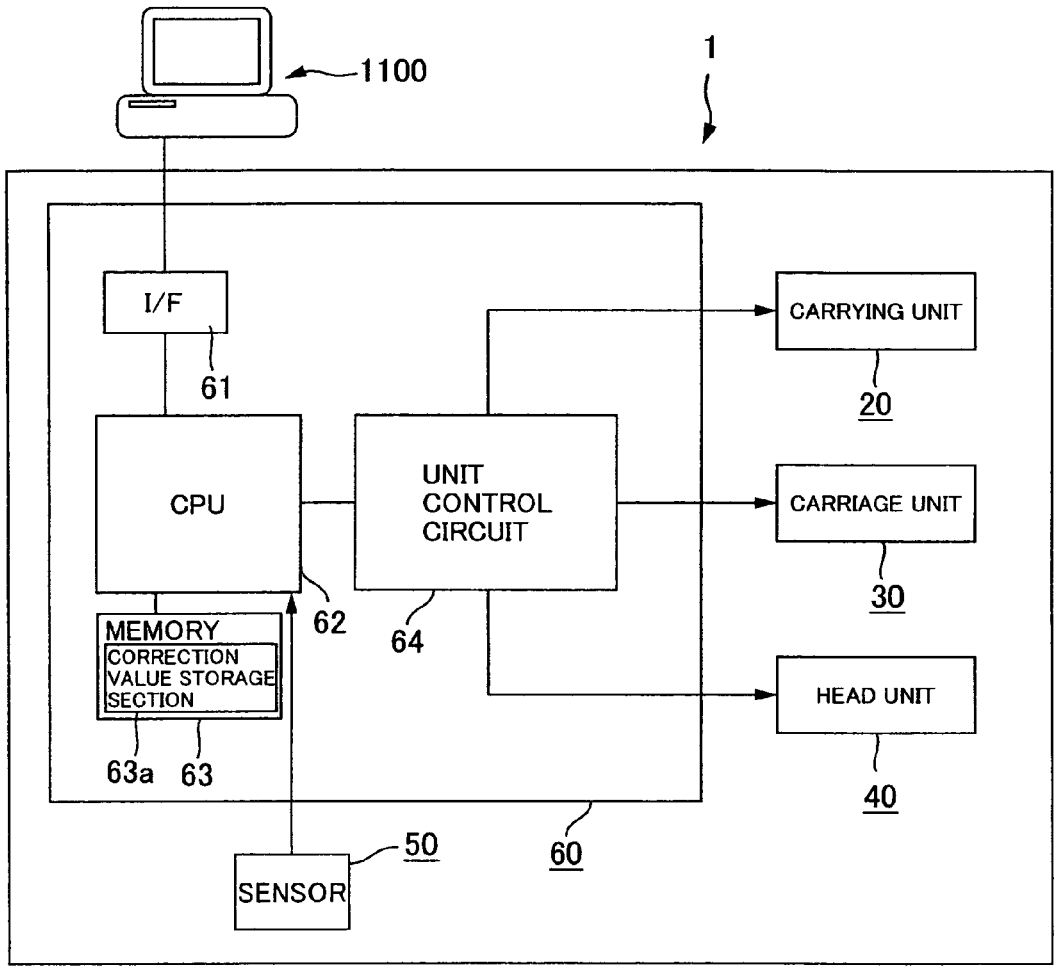
FIG. 8 is a block diagram of the overall configuration of the printer.
Figure 9:
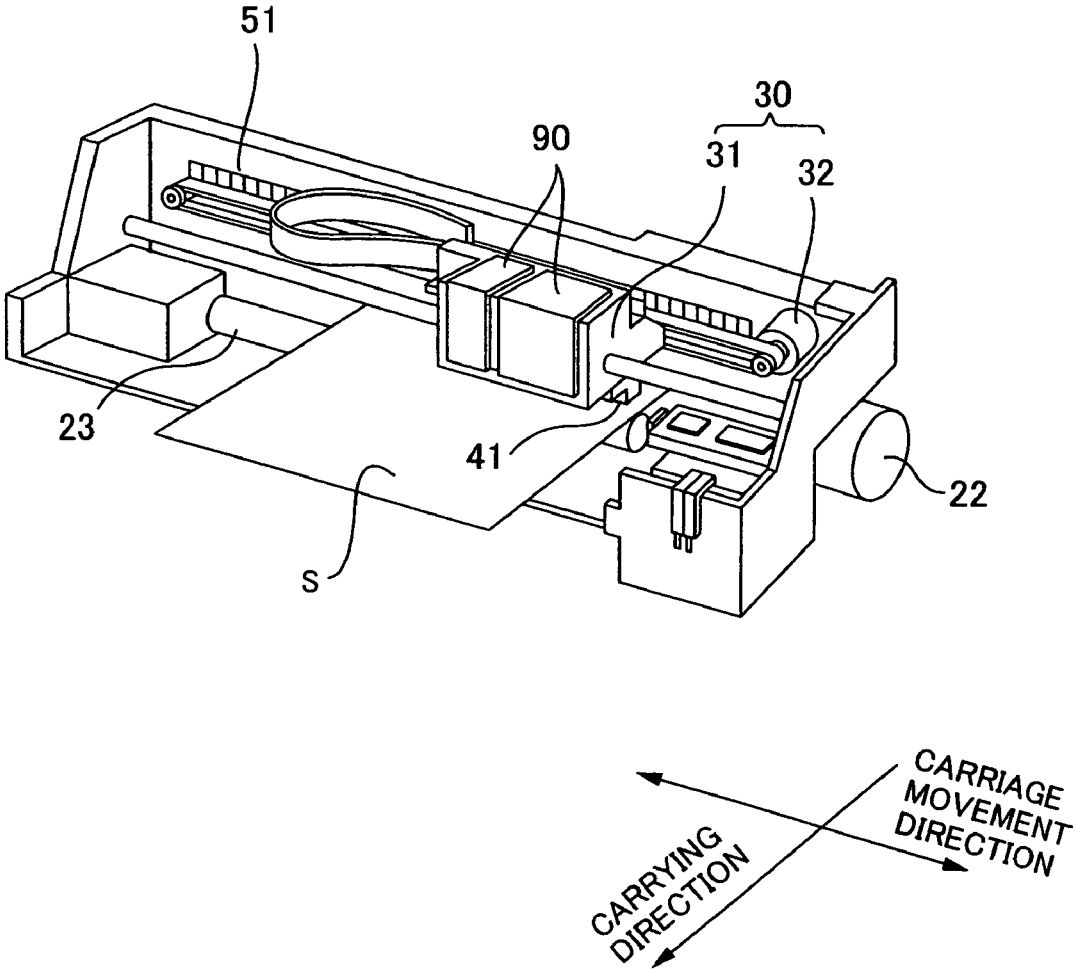
FIG. 9 is a schematic diagram of the overall configuration of the printer.
Figure 10:
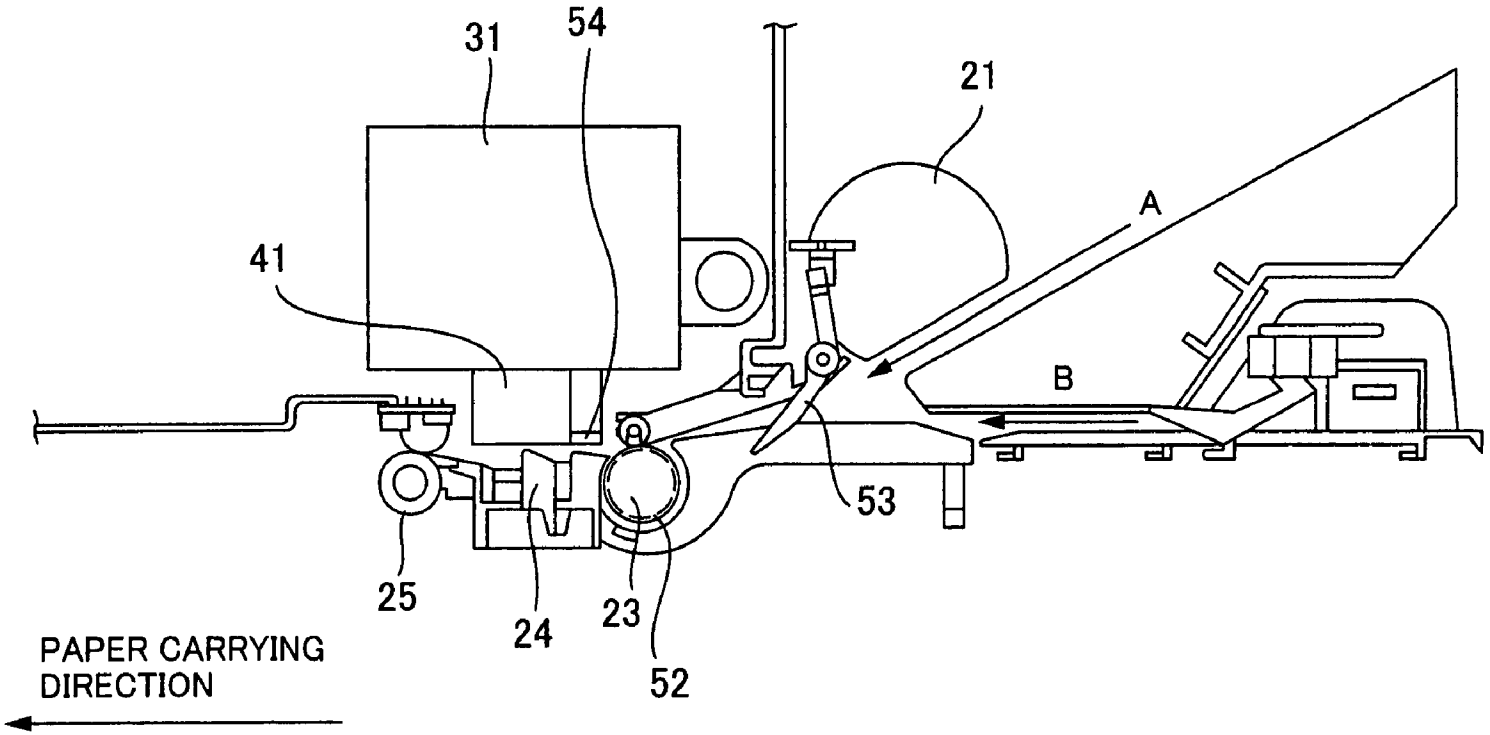
FIG. 10 is a horizontal cross-section of the overall configuration of the printer.

FIG. 8 is a block diagram of the overall configuration of the printer 1 of this embodiment. Further, FIG. 9 is a schematic diagram of the overall configuration of the printer 1 of this embodiment. FIG. 10 is lateral sectional view of the overall configuration of the printer 1 of this embodiment. The basic structure of the printer 1 according to the present embodiment is described below using these diagrams.

The inkjet printer 1 of this embodiment has a carrying unit 20, a carriage unit 30, a head unit 40, a sensor 50, and a controller 60. The printer 1 that receives print data from the computer 1100, which is an external device, controls the various units (the carrying unit 20, the carriage unit 30, and the head unit 40) using the controller 60. The controller 60 controls the units in accordance with the print data that are received from the computer 1100 to print an image on a paper S. The sensor 50 monitors the conditions within the printer 1, and it outputs the results of this detection to the controller 60. The controller 60 receives the detection results from the sensor 50, and controls the units based on these detection results.

The carrying unit 20 is for feeding the paper S up to a printable position, and carrying the paper S by a predetermined carry amount in a predetermined direction (hereinafter, referred to as the "carrying direction") during printing. Here, the carrying direction of the paper S is the direction that intersects the carriage movement direction described below, and corresponds to the "intersecting direction" of the claims. The carrying direction can also be referred to as the "sub-scanning direction." In the following description, positions in the carrying direction may also be referred to as "sub-scanning positions." The carrying unit 20 functions as a carrying mechanism for carrying the paper S. The carrying unit 20 has a paper feed roller 21, a carry motor 22 (also referred to as the "PF motor"), a carry roller 23, a platen 24, and a paper discharge roller 25. The paper feed roller 21 is a roller for automatically feeding paper S that has been inserted into a paper insert opening into the printer 1. The paper feed roller 21 has the cross-sectional shape of the letter D, and the length of its circumferential portion is set longer than the carry distance up to the carry roller 23. Thus, by rotating the paper feed roller 21 with its circumferential portion abutting against the paper surface, the paper S can be carried up to the carry roller 23. The carry motor 22 is a motor for carrying paper in the carrying direction, and is constituted by a DC motor, for example. The carry roller 23 is a roller for carrying the paper S that has been supplied by the paper feed roller 21 up to a printable region, and is driven by the carry motor 22. The platen 24 is for supporting the paper S during printing from the rear surface side of the paper S. The paper discharge roller 25 is a roller for discharging the paper S for which printing has finished in the carrying direction. The paper discharge roller 25 is rotated in synchronization with the carry roller 23.

The carriage unit 30 is provided with a carriage 31 and a carriage motor 32 (hereinafter, also referred to as "CR motor"). The carriage motor 32 is a motor for moving the carriage 31 back and forth in a predetermined direction (hereinafter, this is also referred to as the "carriage movement direction"), and for example is constituted by a DC motor. The carriage 31 detachably holds ink cartridges 90 containing ink. A head 41 for ejecting ink from the nozzles is attached to the carriage 31. Thus, by moving the carriage 31 back and forth, the head 41 and the nozzles also move back and forth in the carriage movement direction. Consequently, the carriage movement direction corresponds to the "movement direction" in the claims. It should be noted that the carriage movement direction can also be referred to as the "main-scanning direction." In the following description, positions in the carriage movement direction are also referred to as "main-scanning positions."

The head unit 40 is for ejecting ink onto the paper S. The head unit 40 has a head 41. The head 41 has a plurality of nozzles, and ejects ink intermittently from each of the nozzles. A raster line made of dots in the carriage movement direction is formed on the paper S due to the head 41 intermittently ejecting ink from the nozzles while moving in the carriage movement direction. This raster line corresponds to the "line" in the claims. It should be noted that the configuration of the head 41, the drive circuit for driving the head 41, and the method for driving the head 41 are described later.

The sensor 50 includes a linear encoder 51, a rotary encoder 52, a paper detection sensor 53, and a paper width sensor 54, for example. The linear encoder 51 is for detecting the position in the carriage movement direction, and has a belt-shaped slit plate provided extending in the scanning direction, and a photo interrupter that is attached to the carriage 31 and detects the slits formed in the slit plate. The rotary encoder 52 is for detecting the amount of rotation of the carry roller 23, and has a disk-shaped slit plate that rotates in conjunction with rotation of the carry roller 23, and a photo interrupter for detecting the slits formed in the slit plate.

The paper detection sensor 53 is for detecting the position of the front end of the paper S to be printed. The paper detection sensor 53 is provided at a position where it can detect the front end position of the paper S as the paper S is being carried toward the carry roller 23 by the paper feed roller 21. It should be noted that the paper detection sensor 53 is a mechanical sensor that detects the front end of the paper S through a mechanical mechanism. More specifically, the paper detection sensor 53 has a lever that can be rotated in the paper carrying direction, and this lever is disposed so that it protrudes into the path over which the paper S is carried. Further, as a result of the paper S being carried, the front end of the paper comes into contact with the lever and the lever is rotated. Thus, the paper detection sensor 53 detects the front end of the paper S and whether or not the paper S is present by detecting the movement of this lever using the photo interrupter, for example.

Figure 11:
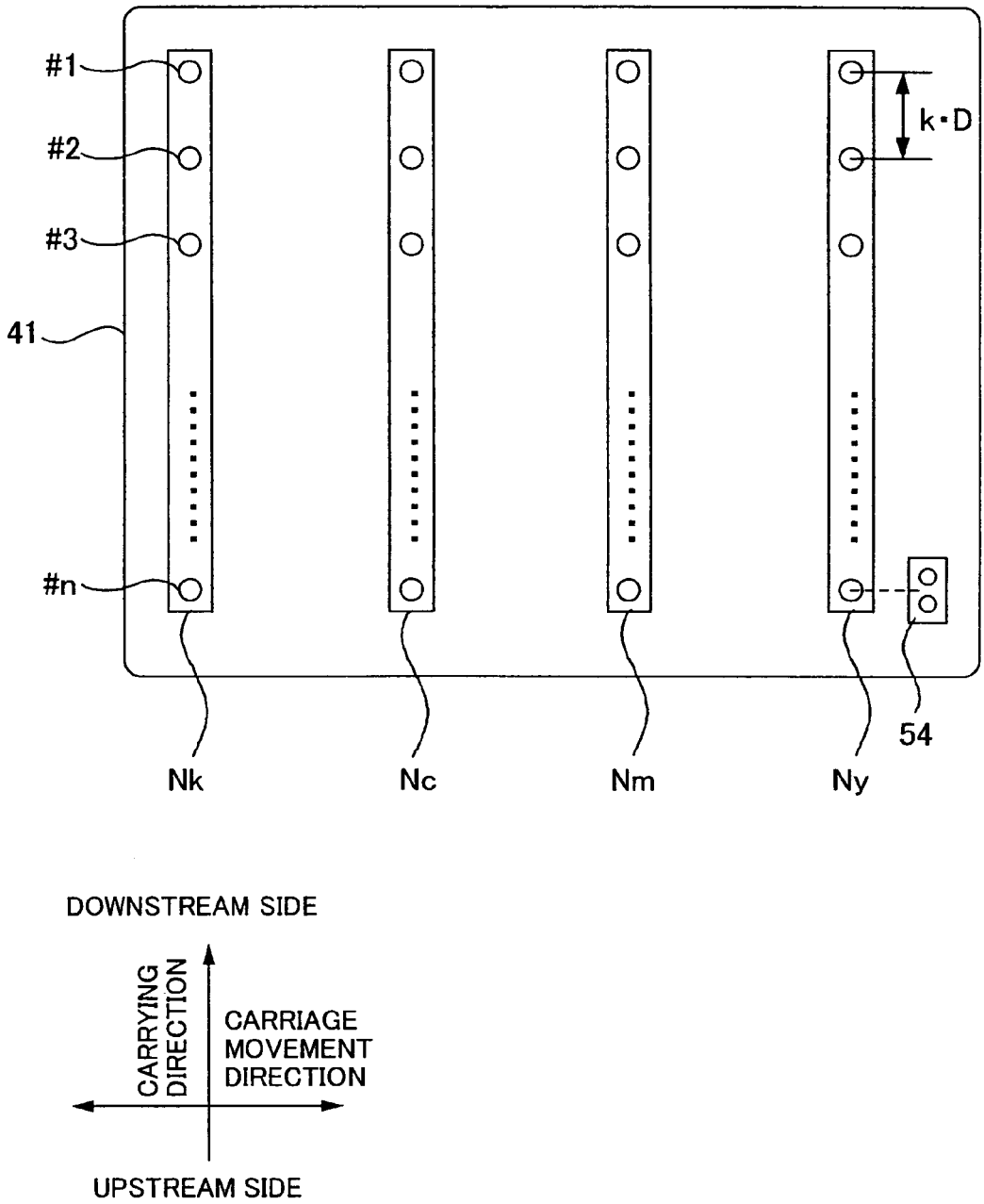
FIG. 11 is an explanatory diagram showing the arrangement of the nozzles.

The paper width sensor 54 is attached to the carriage 31. In the present embodiment, as shown in FIG. 11, it is attached at substantially the same position as the most upstream-side nozzle, as regards its position in the carrying direction. The paper width sensor 54 is an optical sensor 50, and with a light-receiving section, receives the reflection light of the light that has been irradiated onto the paper S from a light-emitting section. Then, based on the intensity of the light that is received by the light-receiving section, the sensor detects whether or not the papers is present. The paper width sensor 54 detects the positions of the ends of the paper S while being moved by the carriage 31, so as to detect the width of the paper S. The paper width sensor 54 also can detect the front end of the paper S depending on the conditions.

The controller 60 is a control unit for carrying out control of the printer 1. The controller 60 has an interface section 61, a CPU 62, a memory 63, and a unit control circuit 64. The interface section 61 exchanges data between the computer 1100, which is an external device, and the printer 1. The CPU 62 is a computer processing device for performing overall control of the printer. The memory 63 is for ensuring a working region and a region for storing the programs for the CPU 62, for instance, and includes memory means such as a RAM, an EEPROM, or a ROM. The CPU 62 controls the various units 20, 30, and 40 via the unit control circuit 64 in accordance with programs stored on the memory 63. In this embodiment, a partial region of the memory 63 is used as a correction value storage section 63*a* for storing correction values, which is described later.

<Regarding the Configuration of the Head>

FIG. 11 is an explanatory diagram showing the arrangement of the nozzles in the lower surface of the head 41. A black ink nozzle row Nk, a cyan ink nozzle row Nc, a magenta ink nozzle row Nm, and a yellow ink nozzle row Ny are formed in the lower surface of the head 41. Each nozzle row is provided with n pieces of nozzles (for example, n=180), which are ejection openings for ejecting the respective color inks. The plurality of nozzles of the nozzle rows are arranged in a row at a constant spacing (nozzle pitch: k•D) in the carrying direction. Here, D is the minimum dot pitch in the carrying direction, that is, the spacing at the highest resolution of the dots formed on the paper S. Further, k is an integer of 1 or more. For example, if the nozzle pitch is 180 dpi (1/180 inch) and the dot pitch in the carrying direction is 720 dpi (1/720), then k=4. It should be noted that in the example diagrammed here the nozzles of the nozzle rows are assigned numbers that become smaller toward the nozzles on the downstream side (#1 to #n). That is, the nozzle #1 is positioned more downstream in the carrying direction than the nozzle #n. When these nozzles rows are provided in the head 41, the region in which dots are formed by a single dot forming operation becomes wide, allowing the printing time to be reduced. Further, these nozzle rows are provided for each color of ink, and thus by suitably ejecting ink from these nozzle rows it is possible to perform multi-color printing.

Further, pressure chambers (not shown) are provided on the ink path that is in communication with each nozzle. In each pressure chamber there is provided a piezo element (not shown) to serve as a drive element for causing ink droplets to be ejected from the respective nozzle.

<Regarding Driving of the Head>

Figure 12:
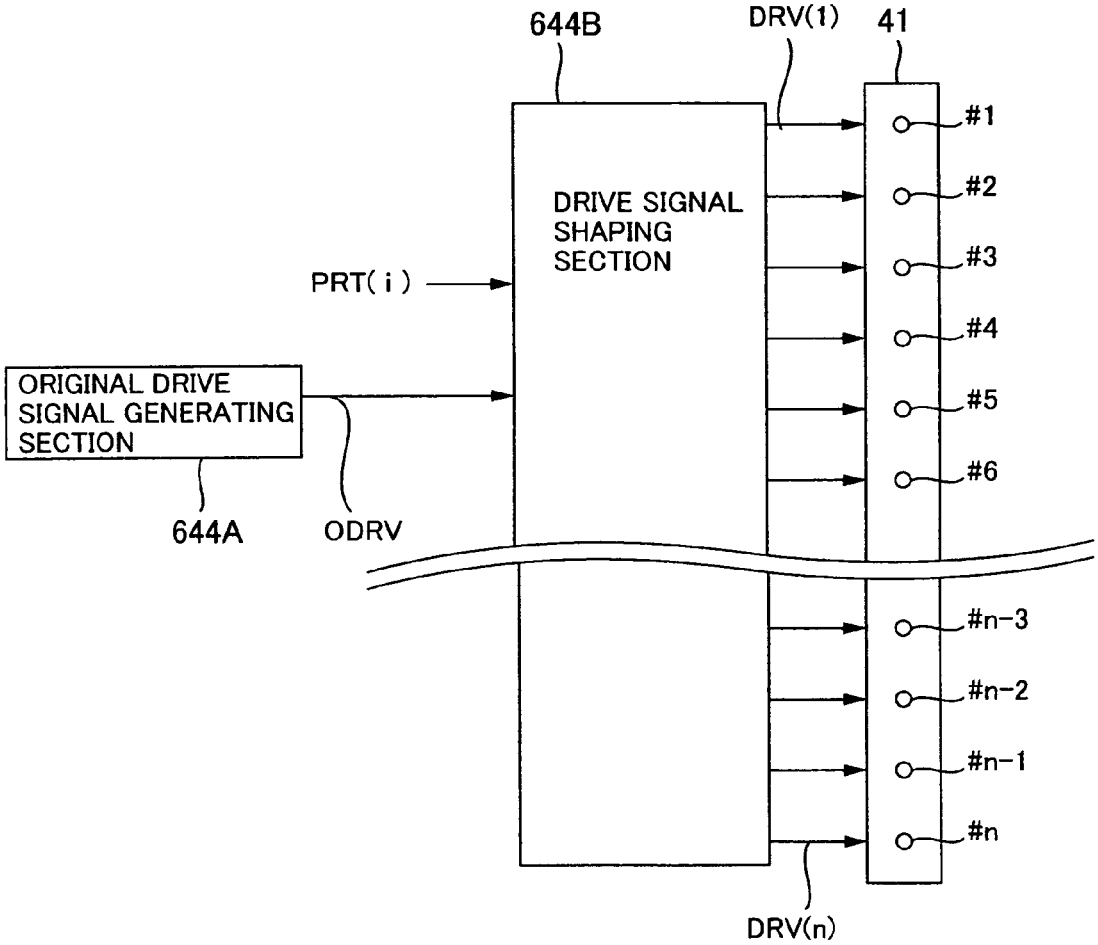
FIG. 12 is an explanatory diagram of the drive circuit of the head unit.

FIG. 12 is an explanatory diagram of the drive circuit of the head 41. This drive circuit is provided within the unit control circuit 64 mentioned above. As shown in the diagram, the drive circuit is provided with an original drive signal generating section 644A and a drive signal shaping section 644B. In this embodiment, a drive circuit is provided for each nozzle row, that is, for each nozzle row of the colors black (K), cyan (C), magenta (M), and yellow (Y), such that the piezo elements are driven individually for each nozzle row. The number in parentheses at the end of the name of each of the signals in the diagram indicates the number of the nozzle to which that signal is supplied.

The piezo element mentioned above is deformed each time a drive pulse W1 or W2 (see FIG. 13) is supplied thereto, changing the pressure on the ink within the pressure chamber. That is, when a voltage of a predetermined time duration is applied between electrodes provided at both ends of the piezo element, the piezo element becomes deformed for the time duration of voltage application and deforms an elastic membrane (lateral wall) which defines a portion of the pressure chamber. The volume of the pressure chamber changes in accordance with this deformation of the piezo element, and due to this change in the volume of the pressure chamber, the pressure on the ink within the pressure chamber is altered. Then, due to this change in pressure on the ink, an ink droplet is ejected from the corresponding nozzle #1 to #180.

The original drive signal generating section 644A generates an original drive signal ODRV that is used in common by the nozzles #1 to #n. The original drive signal ODRV of the present embodiment is a signal that includes a plurality of drive pulses W1 and W2 during the main-scanning period of a single pixel (the time during which a single nozzle crosses over a grid corresponding to a single pixel).

The drive signal shaping section 644B receives an original drive signal ODRV from the original drive signal generating section together with a print signal PRT(i). The drive signal shaping section 644B shapes the original drive signal ODRV in correspondence with the level of the print signal PRT(i) and outputs it toward the piezo elements of the nozzles #1 to #n as a drive signal DRV(i). The piezo elements of the nozzles #1 to #n are driven in accordance with the drive signal DRV from the drive signal shaping section 644B.

<Regarding Drive Signals of the Head>

Figure 13:
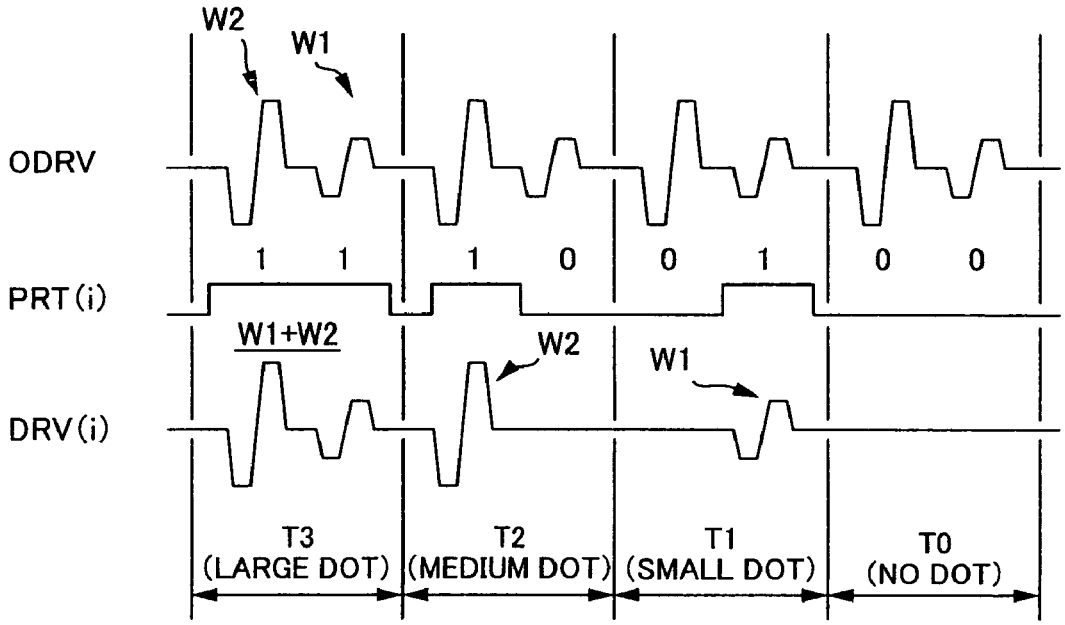
FIG. 13 is a timing chart for describing the various signals.

FIG. 13 is a timing chart for explaining the various signals. That is, this drawing shows a timing chart for the various signals, these being an original drive signal ODRV, a print signal PRT(i), and a drive signal DRV(i).

As discussed above, the original drive signal ODRV is a signal used in common for the nozzles #1 to #n, and is output from the original drive signal generating section 644A to the drive signal shaping section 644B. In this embodiment, the original drive signal ODRV includes two drive pulses, namely a first pulse W1 and a second pulse W2, in the period during which a single nozzle crosses over the length of one pixel. The first pulse W1 is a drive pulse for causing a small size ink droplet (hereinafter, called small ink droplet) to be ejected from the nozzle. Further, the second pulse W2 is a drive pulse for causing a medium size ink droplet (hereinafter, called medium ink droplet) to be ejected from the nozzle. That is, by supplying the first pulse W1 to the piezo element, a small ink droplet is ejected from the nozzle. When this small ink droplet lands on the paper S, a small size dot (small dot) is formed. Likewise, by supplying the second pulse W2 to the piezo element, a medium ink droplet is ejected from the nozzle. When this medium ink droplet lands on the paper S, a medium size dot (medium dot) is formed.

The print signal PRT(i) is a signal corresponding to the pixel data allocated to a single pixel. That is, the print signal PRT(i) is a signal corresponding to the pixel data included in the print data. In this embodiment, the print signals PRT(i) are signals having two bits of information per pixel. It should be noted that the drive signal shaping section 644B shapes the original drive signal ODRV in correspondence with the level of the print signal PRT(i), and outputs a drive signal DRV(i).

The drive signal DRV is a signal that is obtained by blocking the original drive signal ODRV in correspondence with the level of the print signal PRT. That is, when the level of the print signal PRT is "1" then the drive signal shaping section 644B allows the drive pulse for the original drive signal ODRV to pass unchanged and sets it as the drive signal DRV(i). On the other hand, when the level of the print signal PRT is "0," the drive signal shaping section 644B blocks the drive pulse of the original drive signal ODRV. Then, the drive signal DRV(i) from the drive signal shaping section 644B is individually supplied to the corresponding piezo element. The piezo elements are driven according to the drive signals DRV(i) that have been supplied thereto.

When the print signal PRT(i) corresponds to the two bits of data "01" then only the first pulse W1 is output in the first half of the pixel period. Accordingly, a small ink droplet is ejected from the nozzle, forming a small dot on the paper S. When the print signal PRT(i) corresponds to the two bits of data "10" then only the second pulse W2 is output in the later half of the pixel period. Accordingly, a medium ink droplet is ejected from the nozzle, forming a medium dot on the paper S. When the print signal PRT(i) corresponds to the two bits of data "11" then both the first pulse W1 and the second pulse W2 are output during the pixel period. Accordingly, a small ink droplet and a medium ink droplet are successively ejected from the nozzle, forming a large size dot (large dot) on the paper S.

When the print signal PRT(i) corresponds to the two bits of data "00" then neither the first pulse W1 or the second pulse W2 are output during the pixel period. In this case, no ink droplet of any size is ejected from the nozzle, and a dot is not formed on the paper S.

As described above, the drive signal DRV(i) in a single pixel period is shaped so that it may have four different waveforms corresponding to the four different values of the print signal PRT(i). Here, in the present embodiment, the content of the two-bit pixel data and the content of the print signals are matching. In other words, for all pixel data and print signals, non-formation of a dot is the two-bit data "00" and formation of a small dot is the two-bit data "01." Further, formation of a medium dot is the two-bit data "10" and formation of a large dot is the two-bit data "11." Consequently, the drive circuits of the head 41 use the pixel data included in the print data as the print signals PRT.

<Regarding the Printing Operation>

Figure 14:
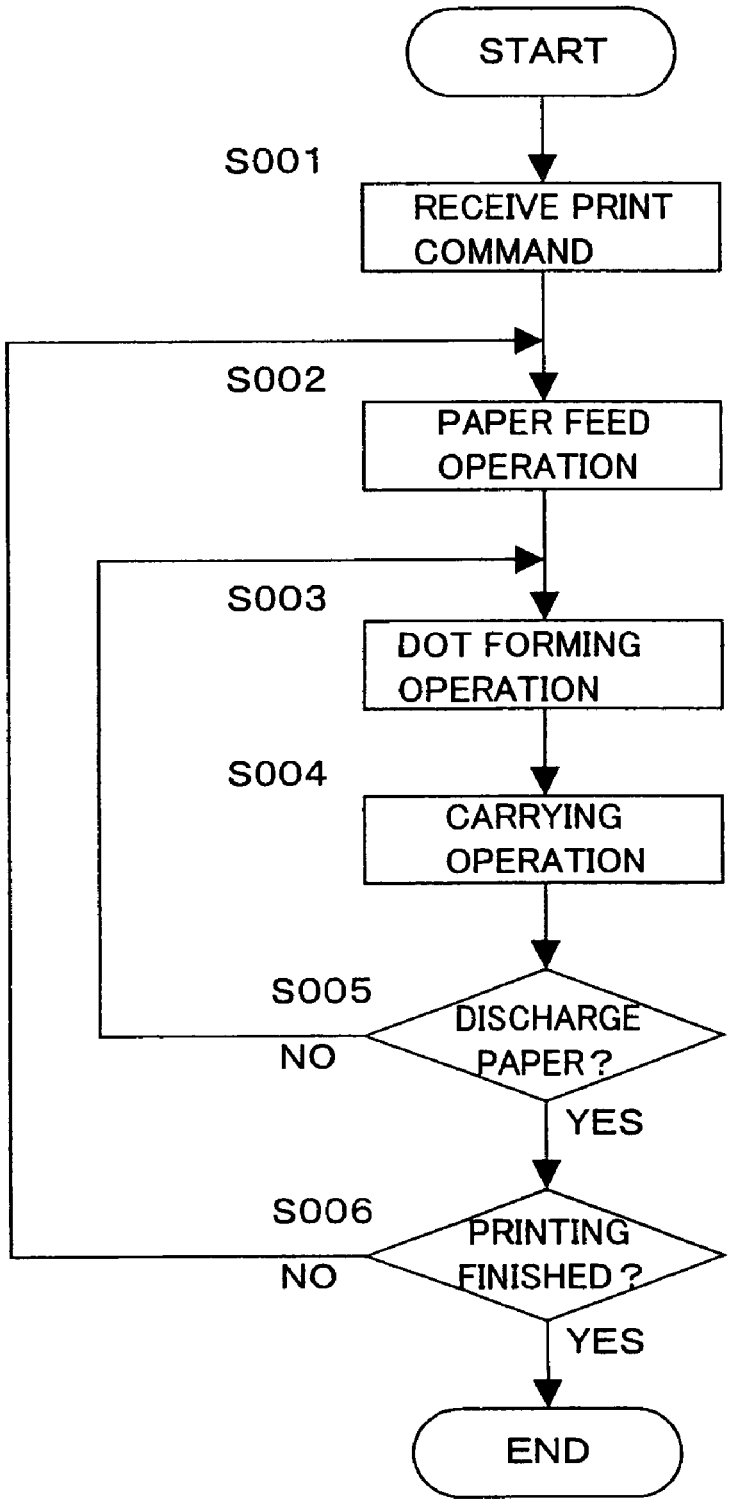
FIG. 14 is a flowchart of the operations during printing.

FIG. 14 is a flowchart of the operations during printing. The various operations that are described below are achieved by the controller 60 controlling the various units in accordance with a program stored in the memory. This program has codes for executing the various operations.

Receive Print Command (S001): The controller 60 receives a print command via the interface section 61 from the computer 1100. This print command is included in the header of the print data transmitted from the computer 1100. The controller 60 then analyzes the content of the various commands included in the print data that are received and uses the various units to perform the following "paper feeding operation", "carrying operation", and "dot forming operation", for example.

Paper Feeding Operation (S002): Next, the controller 60 performs the paper feeding operation. The paper feeding operation is a process for moving the paper S, which is the object to be printed, and positioning it at a print start position (the so-called indexing position). That is, the controller 60 rotates the paper feed roller 21 to feed the paper S to be printed up to the carry roller 23. Then, the controller 60 rotates the carry roller 23 to position the paper S, which has been fed from the paper feed roller 21, at the print start position. It should be noted that when the paper S has been positioned at the print start position, at least some of the nozzles of the head 41 are in opposition to the paper S.

Dot Formation Operation (S003): Next, the controller 60 performs the dot forming operation. The dot forming operation is an operation for intermittently ejecting ink from the head 41 moving in the carriage movement direction, so as to form dots on the paper S. The controller 60 drives the carriage motor 32 to move the carriage 31 in the carriage movement direction. Further, the controller 60 causes ink to be ejected from the head 41 in accordance with the print data during the period that the carriage 31 is moving. Then, as mentioned above, if ink that is ejected from the head 41 lands on the paper S, dots are formed on the paper S.

Carrying Operation (S004): Next, the controller 60 performs the carrying operation. The carrying operation is a process for moving the paper S relative to the head 41 in the carrying direction. The controller 60 drives the carry motor 22 to rotate the carry roller 23 and thereby carry the paper S in the carrying direction. Through this carrying operation, the head 41 becomes able to form dots at positions that are different from the positions of the dots formed in the preceding dot forming operation.

Paper Discharge Determination (S005): Next, the controller 60 determines whether or not to discharge the paper S that is being printed. In this determination, the paper is not discharged if there are still data to be printed to the paper S that is being printed. In this case, the controller 60 repeats in alternation the dot forming operation and the carrying operation until there are no longer any data for printing, thereby gradually printing an image made of dots on the paper S. When there are no longer any data for printing to the paper S that is being printed, the controller 60 discharges that paper S. That is, the controller 60 discharges the printed paper S to the outside by rotating the paper discharge roller 25. It should be noted that whether or not to discharge the paper can also be determined based on a paper discharge command that is included in the print data.

Determining Whether Printing is Finished (S006): Next, the controller 60 determines whether or not to continue printing. If the next sheet of paper S is to be printed, then printing is continued and the paper feed operation for the next sheet of paper S is started. If the next sheet of paper S is not to be printed, then the printing operation is ended.

===Regarding the Print Mode===

Figure 15A:
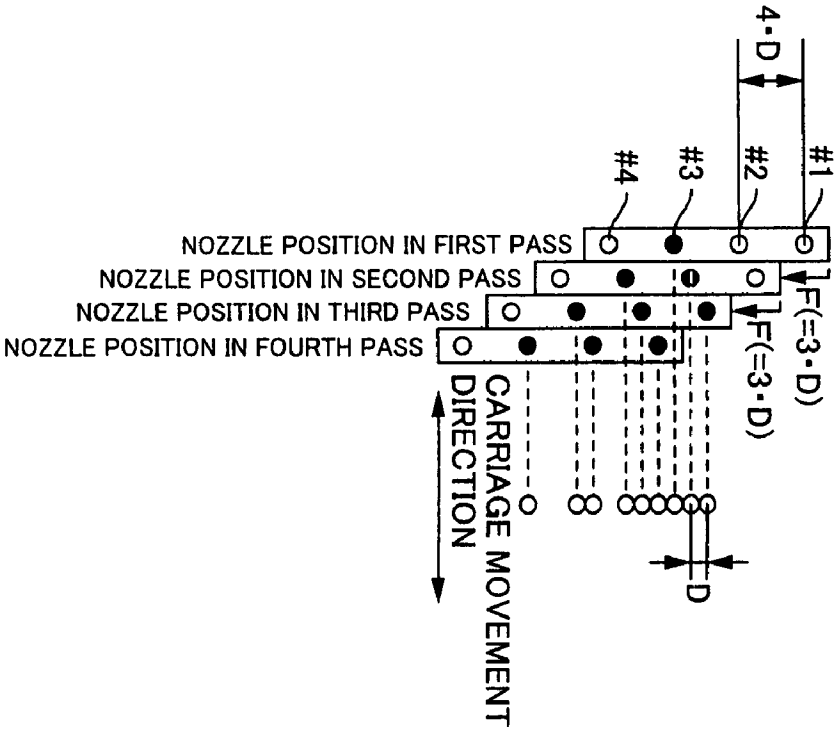
FIG. 15A and FIG. 15B are explanatory diagrams of interlacing.
Figure 15B:
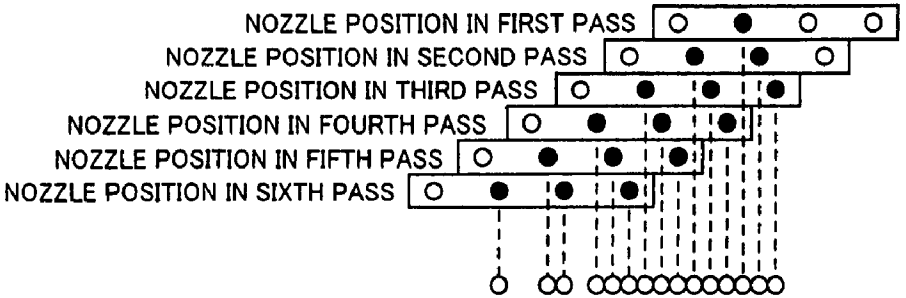

Here, print modes that can be executed by the printer 1 of the present embodiment are described using FIG. 15A and FIG. 15B. Interlacing is available as an example of the print mode. By using an interlacing method, individual differences between the nozzles such as in the nozzle pitch and the ink ejection properties are lessened by spreading them out over the image to be printed, and thus an improvement in image quality can be attained.

FIGS. 15A and 15B are explanatory diagrams of the interlacing method. It should be noted that for the sake of simplifying the description, the nozzle rows shown in place of the head 41 are illustrated as if they are moving with respect to the paper S, but the diagrams show the relative positional relationship between the head and the paper S, and in fact, it is the paper S that moves in the carrying direction. In the diagrams, the nozzles represented by a black circle are the nozzles that in practice eject ink, and the nozzles represented by white circles are nozzles that do not eject ink. It should be noted that FIG. 15A shows the nozzle positions in the first through fourth passes and how the dots are formed by those nozzles. FIG. 15B shows the nozzle positions in the first through sixth passes and how the dots are formed.

Here, "pass" refers to a single movement of the nozzle rows in the carriage movement direction. "Raster line" is a row of dots lined up in the carriage movement direction. The "interlace mode" refers to a print mode in which k is at least 2 and at least one raster line that is not recorded is sandwiched between raster lines that are recorded in a single pass. In other words, it is a print mode in which at least one raster line that is not formed is set between raster lines that are formed in a single dot forming operation, and through a plurality of dot forming operations, the lines are formed in a complementary manner, forming adjacent raster lines with different nozzles.

With the interlace mode illustrated in FIG. 15A and FIG. 15B, each time the paper S is carried in the carrying direction by a constant carry amount F, the nozzles form a raster line immediately above the raster line that was recorded in the immediately-prior pass. In order to form the raster lines in this way using a constant carry amount, the number N (integer) of nozzles that actually eject ink is coprime to k, and the carry amount F is set to N•D.

In the example of the drawings, the nozzle row has four nozzles arranged in the carrying direction. However, since the nozzle pitch k of the nozzle group is 4, in order to fulfill the condition for forming raster lines using a constant carry amount, the condition being "N and k are coprime to one another," not all the nozzles can be used. Accordingly, three of the four nozzles are used to perform the interlace mode. Furthermore, because three nozzles are used, the paper S is carried by a carry amount 3•D. As a result, for example, a nozzle row with a nozzle pitch of 180 dpi (4•D) is used to form dots on the paper S at a dot pitch of 720 dpi (=D).

These diagrams show the manner in which continuous raster lines are formed, with the first raster line being formed by the nozzle #1 in the third pass, the second raster line being formed by the nozzle #2 in the second pass, the third raster line being formed by the nozzle #3 in the first pass, and the fourth raster line being formed by the nozzle #1 in the fourth pass. It should be noted that ink is ejected from only nozzle #3 in the first pass, and ink is ejected from only nozzle #2 and nozzle #3 in the second pass. The reason for this is that when ink is ejected from all of the nozzles in the first and second passes, it is not possible to form continuous raster lines on the print paper S. It should be noted that, from the third pass on, three nozzles (#1 to #3) eject ink and the paper S is carried by a constant carry amount F (=3•D), forming continuous raster lines at the dot pitch D.

===Regarding Borderless Printing and Bordered Printing===

With the printer 1 of the present embodiment, it is possible to execute both so-called "borderless printing," in which printing is performed without forming margins on the ends of the paper S, and so-called "bordered printing," in which printing is carried out forming margins at the ends of the paper S.

<Overview of Borderless Printing and Bordered Printing>

Figure 16:
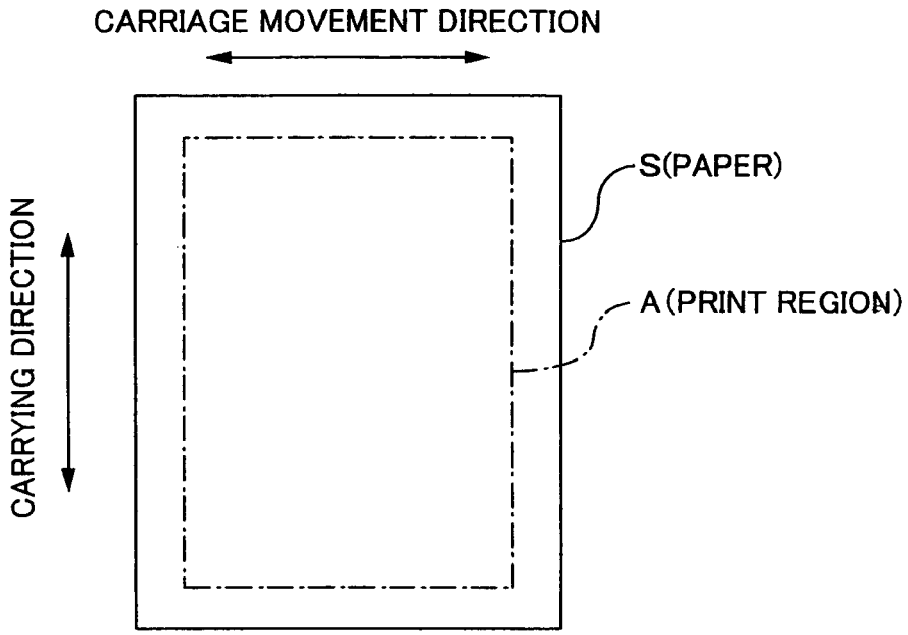
FIG. 16 is a diagram showing the size relationship between the print region and the paper during bordered printing.

With bordered printing, printing is performed such that the print region, which is the region to which ink is ejected according to the print data, is contained within the paper S. FIG. 16 is a diagram showing the relationship in size between the print region A and the paper S during bordered printing. As shown in the diagram, the print region A is set so that it is contained within the paper S, forming margins on the top and bottom ends and on the left and right lateral ends of the paper S.

When performing bordered printing, the printer driver 1110 converts, in the resolution conversion process, the resolution of the image data to a designated print resolution while processing the image data so that the print region A is located inward from the edges of the paper S by a predetermined width. For example, if the image data does not fit within a predetermined width from the edges when printing at the print resolution that has been set for the print region A, then the pixel data corresponding to the ends of that image are removed by suitably performing trimming etc., making the print region A smaller.

Figure 17:
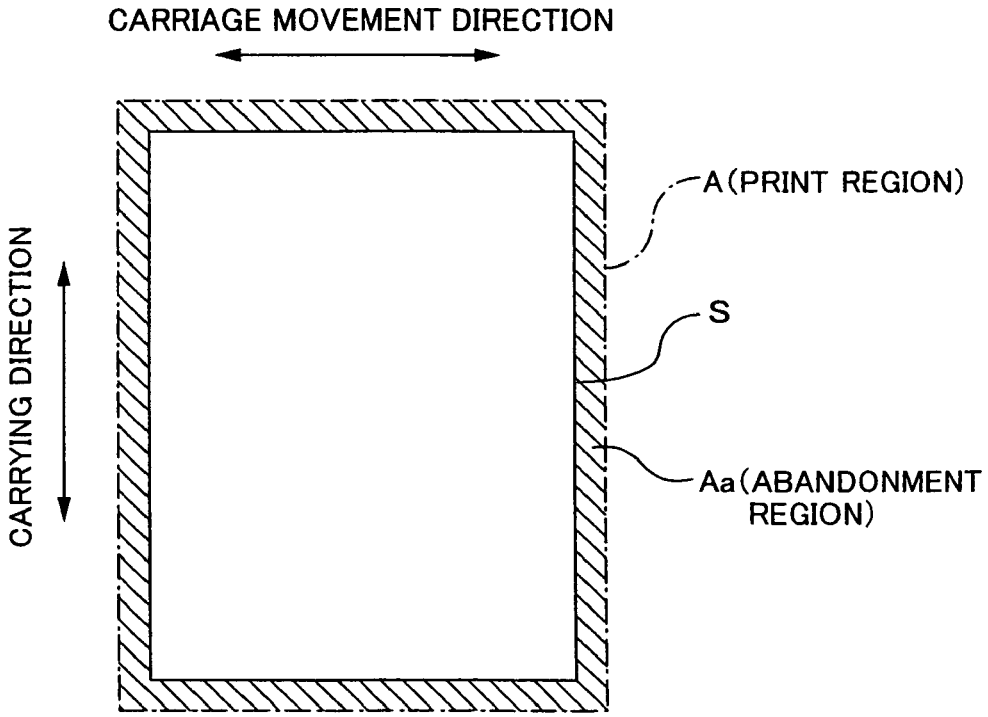
FIG. 17 is a diagram showing the size relationship between the print region and the paper during borderless printing.

On the other hand, with borderless printing, printing is executed such that the outer circumference portion of the print region A extends beyond the paper S. FIG. 17 shows the relationship in size between the print region A and the paper S during borderless printing. As shown in this diagram, the print region A is set to include the region extending beyond the upper and lower ends and the right and left lateral edges of the paper S (hereinafter, referred to as the "abandonment region Aa"). Ink is ejected onto this abandonment region Aa as well. By ejecting ink onto the abandonment region Aa, ink is reliably ejected toward the ends of the paper S, even if there is some shift in the position of the paper S with respect to the head 41 due, for example, to the precision of the carrying operation, thus achieving printing without forming margins at the ends. It should be noted that in this abandonment region Aa, the region that extends beyond the upstream end of the paper S (the lower end of the paper S) and the region that extends beyond the downstream end of the paper S (the upper end of the paper S) can be expressed as the "region that is determined to be outside, on the upstream side, of the upstream-side end in the intersecting direction of the medium" and the "region that is determined to be outside, on the downstream side, of the downstream-side end," respectively.

When performing borderless printing, the printer driver 1110 converts, in the resolution conversion process, the resolution of the image data to a designated print resolution while processing the image data so that the print region A extends beyond the edges of the paper S by a predetermined width. For example, if the image data extend too far beyond the paper S when printing at the print resolution that has been set for the print region A, then the image data are suitably trimmed, for example, so that the amount by which the print region A extends beyond the paper S becomes a predetermined width.

It should be noted that paper size information regarding the standard dimensions of the paper S, such as the A4 size, are stored in advance in the memory of the computer 1100. The paper size information for example indicates the number of dots (D) in the carriage movement direction and the carrying direction for that size. Further, this paper size information is stored corresponding with the paper size mode that is input through the user interface of the printer driver 1110. Then, when processing the image data, the printer driver 1110 references the paper size information corresponding to that paper size mode to find the size of the paper S, and then processing is performed.

<Regarding the Nozzles Used in Borderless Printing and Bordered Printing>

As mentioned above, with borderless printing, ink is ejected toward the abandonment region Aa as well, which is the region outside of the upper end and the lower end of the paper S. Thus, there is a possibility that the ink that is abandoned will adhere to the platen 24 and cause the platen 24 to become dirty. Accordingly, the platen 24 is provided with grooves for collecting the ink that is outside of the upper end and the lower end of the paper S. Then, when printing the upper end and the lower end of the paper S, use of the nozzles is restricted such that ink is ejected from only the nozzles that are in opposition to that groove.

Figure 18A:
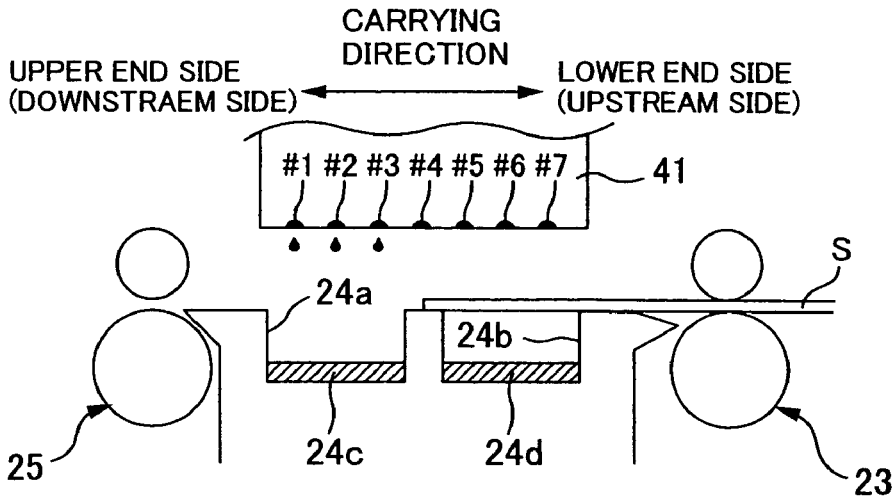
FIG. 18A to FIG. 18C are diagrams showing the positional relationship between the grooves provided in the platen and the nozzles.
Figure 18B:
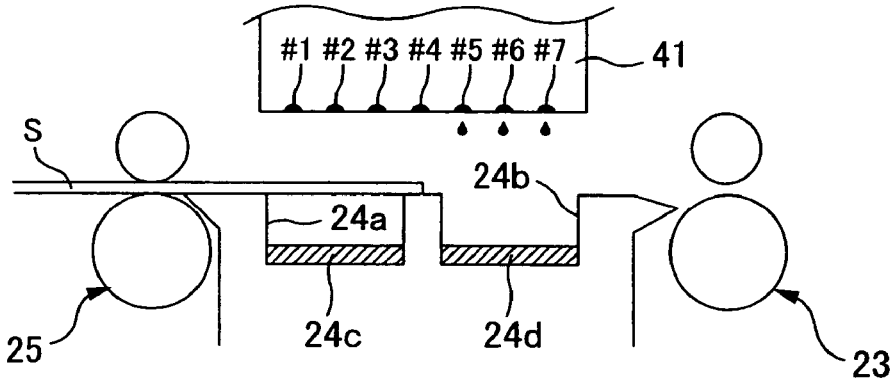
Figure 18C:
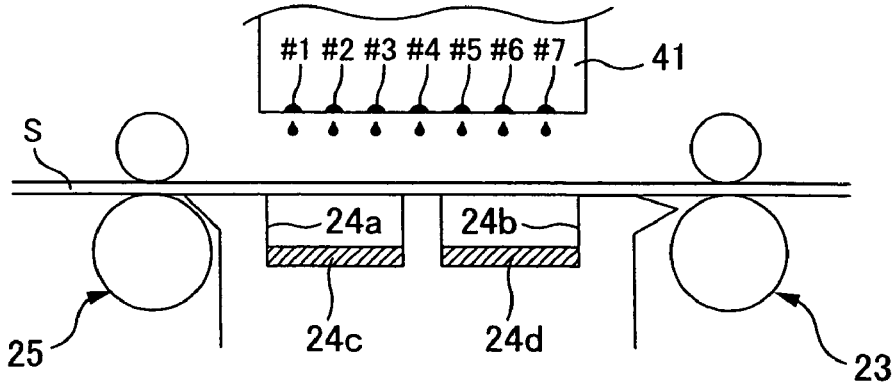

FIGS. 18A to 18C show the positional relationship between the grooves provided in the platen 24 and the nozzles. It should be noted that for the convenience of description, a nozzle row of n=7, that is, a nozzle row provided with nozzles #1 to #7, is used as an example. It should be noted that as shown in FIG. 18A, the upstream side and the downstream side in the carrying direction respectively correspond to the lower-end side and the upper-end side of the paper S.

As shown in FIG. 18A, grooves are provided in two positions of the platen 24, these being a portion on the downstream side and a portion on the upstream side in the carrying direction, over a length that exceeds the width of the paper S. The nozzles #1 to #3 are in opposition to the downstream groove, and the nozzles #5 to #7 are in opposition to the upstream groove. Then, as shown in FIG. 18A, when printing the upper end of the paper S (the downstream-side end in the carrying direction), printing is performed using the nozzles #1 to #3 (hereinafter, this is referred to as "upper end processing"), and as shown in FIG. 18B, when printing the lower end (the upstream-side end in the carrying direction), printing is performed using the nozzles #5 to #7 (hereinafter, this is referred to as "lower end processing"), and the intermediate portion between the upper end and the lower end is printed using all of the nozzles #1 to #7 as shown in FIG. 18C (hereinafter, this is referred to as "intermediate processing"). Here, as shown in FIG. 18A, when printing the upper end of the paper S, the ejection of ink from the nozzles #1 to #3 is started before the upper end arrives at the downstream groove. At this time, the abandoned ink that does not land on the paper S is absorbed by an absorbing material that is accommodated within the downstream side groove, thus keeping the platen 24 from becoming dirty. Further, as shown in FIG. 18B, when printing the lower end of the paper S, the ejection of ink from the nozzles #5 to #7 is continued even after that lower end has passed over the upstream groove. At this time, the abandoned ink that does not land on the paper S is absorbed by an absorbing material that is accommodated within the upstream side groove, and thus again, it is possible to prevent the platen 24 from becoming dirty.

On the other hand, in bordered printing, a margin is formed at the ends of the paper S, and thus ink is not ejected toward the abandonment region Aa, which is the region outside of the upper end and the lower end of the paper S. Consequently, it is always possible to start and end the ejection of ink in a state where the paper S is in opposition to a nozzle, and thus unlike with borderless printing, there is no limitation to which nozzles are used. For this reason, all of the nozzles #1 to #7 are used to print on the entire length of the paper S.

===Regarding the Processing Mode===

The user can select "borderless printing" or "bordered printing" through the user interface of the printer driver 1110. That is, as shown in FIG. 7, the two buttons "bordered" and "borderless" are displayed on the user interface as the input buttons of the margin format mode for designating the margin format.

It is also possible to select the image quality mode for specifying the image quality of the image from the screen of the user interface, and on this screen are displayed the two buttons "normal" and "fine" as the input buttons of the image quality mode. If the user has input "normal," then the printer driver 1110 sets the print resolution mentioned above to 360×360 dpi, for example. On the other hand, if "fine" has been input, then the printer driver 1110 sets the print resolution to 720×720 dpi, for example.

It should be noted that as shown in the first reference table of FIG. 19, a print mode is prepared for each combination of margin mode and image quality mode. Further, a processing mode(s) is correlated to each of these print modes as shown in the second reference table in FIG. 20. It should be noted that the first reference table and the second reference table are stored on the memory of the computer 1100, for example.

The processing modes are for defining the dot forming operation and the carrying operation. The printer driver 1110 converts, through the series of processes from the resolution conversation process to the rasterizing process, the image data into print data that match the format of the processing mode that has been set.

It should be noted that if the processing modes are different, then print processing in which at least one of the dot forming operation and the carrying operation is different are performed. Here, print processing in which the dot forming operations are different refers to print processing in which the patterns of change in the nozzles that are used in the dot forming operations are different. On the other hand, print processing in which the carrying operations are different refers to print processing in which the patterns of change in the carry amount of the carrying operations are different. These are described later using specific examples.

<Specific Examples of the Processing Modes>

The printer 1 is provided with six types of processing modes, these being for example a first upper end processing mode, a first intermediate processing mode, a first lower end processing mode, a second upper end processing mode, a second intermediate processing mode, and a second lower end processing mode, serving as the print processing in which at least one of the dot forming operations and the carrying operations is different.

The first upper end processing mode is a processing mode for executing the upper end processing mentioned above at a print resolution of 720×720 dpi. In other words, it is a processing mode in which printing through interlacing using only nozzles #1 to #3 is performed in principle in the first half pass numbers. It should be noted that the carry amount F of the paper S is 3•D because three nozzles are used (see FIG. 21A).

The first intermediate processing mode is a processing mode for executing the intermediate processing mentioned above at a print resolution of 720×720 dpi. In other words, it is a processing mode in which printing through interlacing using all of the nozzles of the nozzle row (nozzles #1 to #7) is performed in all of the passes. It should be noted that the carry amount F of the paper S is 7•D because seven nozzles are used (see FIG. 21A and FIG. 21B).

The first lower end processing mode is a processing mode for executing the lower end processing mentioned above at a print resolution of 720×720 dpi. In other words, it is a processing mode in which printing through interlacing using only nozzles #5 to #7 is performed in principle in the later half pass numbers. It should be noted that the carry amount of the paper S is 3•D because three nozzles are used (see FIG. 21B).

The second upper end processing mode is a processing mode for executing the upper end processing mentioned above at a print resolution of 360×360 dpi. In other words, it is a processing mode in which printing through interlacing using only nozzles #1 to #3 is performed in principle in the first half pass numbers. However, due to the print resolution being half as fine as that of the first upper end processing mode, the carry amount F of the paper S is 6•D, which is twice that of the first upper end processing mode (see FIG. 23A).

The second intermediate processing mode is a processing mode for executing the intermediate processing mentioned above at a print resolution of 360×360 dpi. In other words, it is a processing mode in which printing through interlacing using all of the nozzles of the nozzle row (nozzles #1 to #7) is performed in all of the passes. However, due to the print resolution being half as fine as that of the first intermediate processing mode, the carry amount F of the paper S is 14•D dots, which is twice that of the first intermediate processing mode (see FIG. 23A and FIG. 23B).

The second lower end processing mode is a processing mode for executing the lower end processing mentioned above at a print resolution of 360×360 dpi. In other words, it is a processing mode in which printing through interlacing using only nozzles #5 to #7 is performed in principle in the later half pass numbers. However, due to the print resolution being half as fine as that of the first lower end processing mode, the carry amount F of the papers is 6•D, which is twice that of the first lower end processing mode (see FIG. 23B).

Here, the manner in which the image is formed on the paper S through these processing modes is described with reference to FIG. 21A to FIG. 24B. It should be noted that in all of these diagrams, the pair of diagrams A and B express the manner in which a single image is formed. In other words, FIG. A shows which nozzle in what pass of what processing mode the raster lines on the upper side portion of the image are formed, and FIG. B shows which nozzle in what pass of what processing mode the raster lines on the lower side portion of the image are formed.

The left side portions of FIG. 21A through FIG. 24B (hereinafter referred to as the "left diagrams") show the relative position of the nozzle row with respect to the paper S in each pass of the processing modes. It should be noted that in the left diagrams, for the convenience of description, the nozzle row is shown moving downward in increments of the carry amount F for each pass, but in actuality, it is the paper S that is moved in the carrying direction. Further, the nozzle row has nozzles #1 to #7, their nozzle number shown surrounded by a circle, and their nozzle pitch k•D is 4•D. Further, the dot pitch D is 720 dpi (1/720 inch). It should be noted that in this nozzle row the nozzles shown shaded in black are the nozzles that eject ink.

The right side portions of FIG. 21A through FIG. 24B (hereinafter referred to as the "right diagrams") show how the dots are formed by ejecting ink toward the pixels making up the raster lines. It should be noted that, as mentioned earlier, "pixels" are the virtually determined square grids on the paper for defining the positions where ink is made to land to form dots. The square grids in the right diagrams each express a 720×720 dpi pixel, that is, a square pixel having the length D in the four directions. The numbers written in each square indicate the number of the nozzle that ejects ink toward that pixel, and the squares in which no numbers are written indicate pixels in which ink is not ejected. Further, as shown in the right diagrams, the raster line on the uppermost end that can be formed through the dot formation processing is called the first raster line R1. Thereafter, in the direction toward the lower-end side of the paper S the raster lines are successively the second raster line R2, the third raster line R3, etc.

Figure 21A:
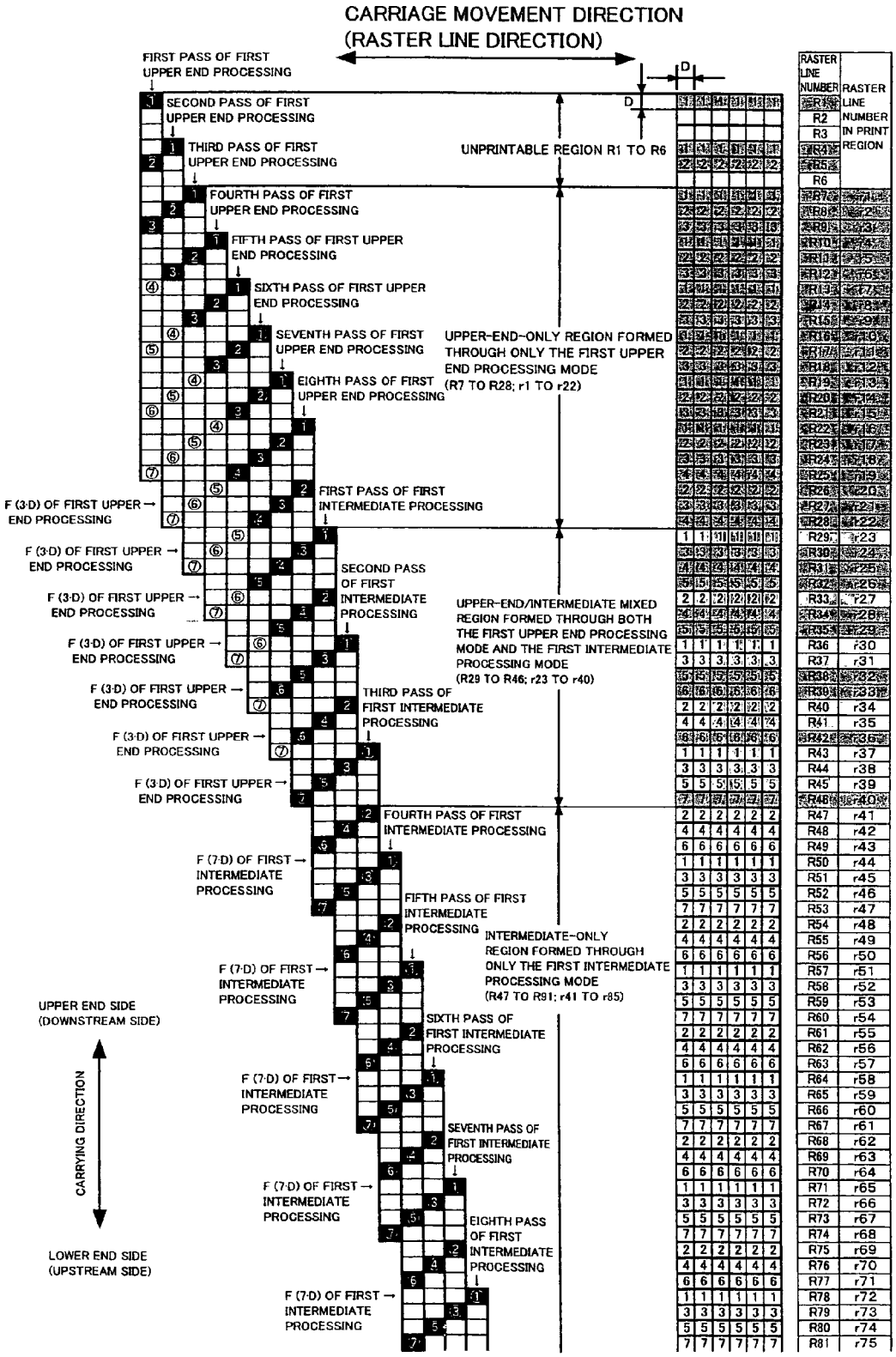
FIG. 21A is a diagram for describing the various processing modes.
Figure 21B:
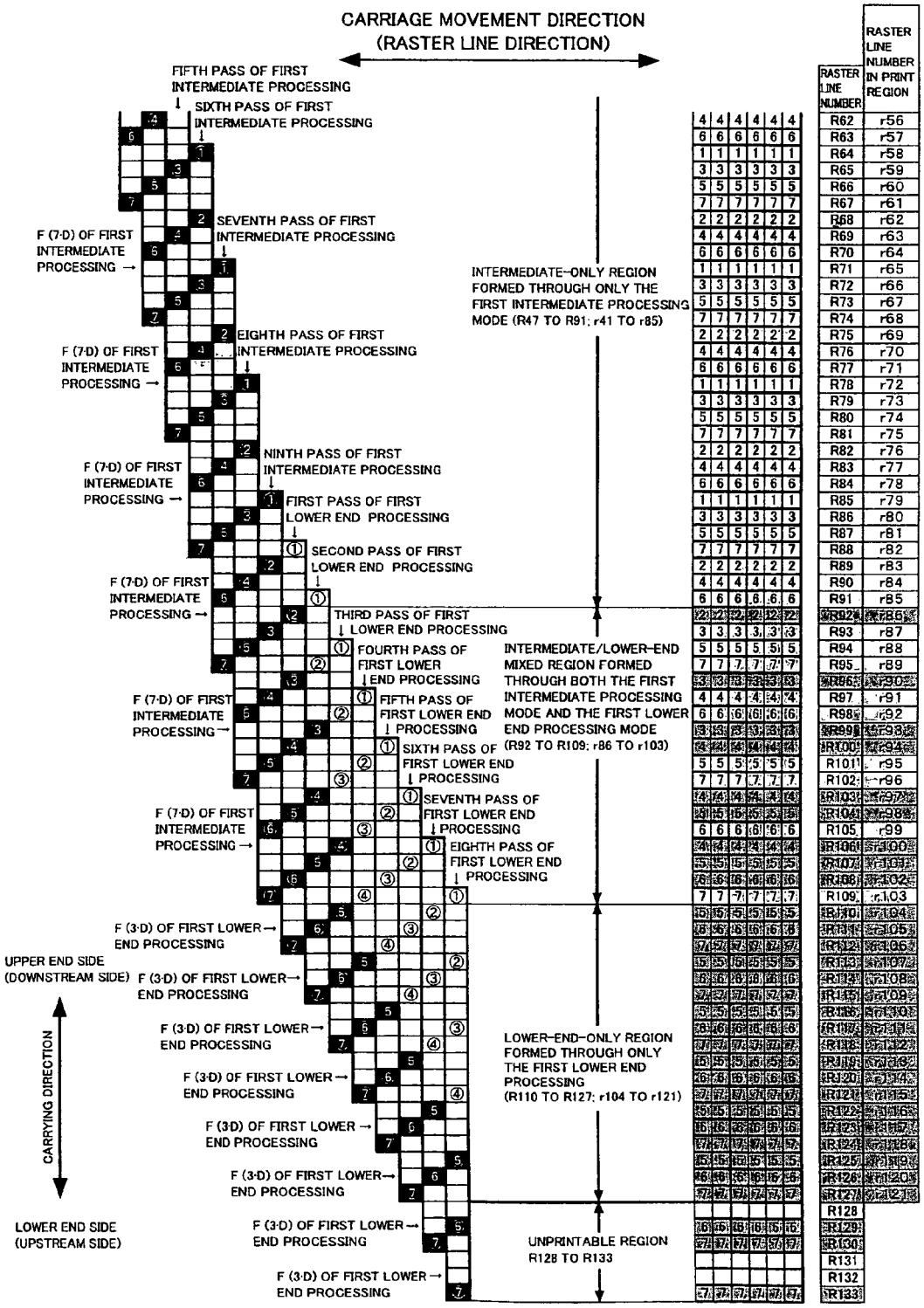
FIG. 21B is a diagram for describing the various processing modes.

(1) Regarding the Case of Printing an Image Using the First Upper End Processing Mode, the First Intermediate Processing Mode, and the First Lower End Processing Mode This case corresponds to an instance in which the first print mode shown in FIG. 19 and FIG. 20 has been set, that is, an instance in which "borderless" has been set as the margin format mode and "fine" has been set as the image quality mode. As shown in FIG. 21A and FIG. 21B, the printer 1 performs eight passes in the first upper end processing mode, then performs nine passes in the first intermediate processing mode, and then performs eight passes in the first lower end processing mode. As a result, ink is ejected at a print resolution of 720×720 dpi to the region R7 to R127 from the seventh raster line R7 to the 127$^{th}$ raster line R127 as a print region A, thereby borderlessly printing on a paper S of a later-described "first size", which is 110•D in the carrying direction (paper length).

It should be noted that the numbers of passes for the first upper end processing mode and the first lower end processing mode are fixed values, and for example do not change from the eight passes mentioned above, but the number of passes of the first intermediate processing mode is set changed in correspondence with the paper size mode that has been input through the user interface of the printer driver 1110. This is because, in order to perform borderless printing it is necessary for the size of the print region A to be larger in the carrying direction than the paper S corresponding to the paper size mode, and the size of the print region A is adjusted by changing the number of passes in the intermediate processing mode.

In the example of the diagrams, the "first size," which indicates that the size in the carrying direction is 110•D, has been input as the paper size mode. Then, the number of passes of the first intermediate mode is set to nine passes as mentioned above so that the size in the carrying direction of the print region A becomes 121•D. It should be noted that this is explained in detail later.

In the first upper end processing mode, the dot forming operation of a single pass is executed through interlacing between the carrying operations, each of which in principle carries the paper S by 3•D, as shown in the left diagram of FIG. 21A. In the four passes of the first half of this processing mode, printing is performed using nozzles #1 to #3. In the four passes of the latter half, printing is performed while increasing the nozzle number by one each time the pass number advances, in the order of nozzle #4, nozzle #5, nozzle #6, and nozzle #7. That is, in the fifth pass, nozzles #1 to #4 are used, and in the sixth pass, nozzles #1 to #5 are used. In the seventh pass, nozzles #1 to #6 are used, and in the eighth pass, nozzles #1 to #7 are used. It should be noted that in the four latter half passes, the reason why the number of nozzles used is successively increased is to make the manner in which the nozzles are used match that of the first intermediate processing mode that is executed immediately afterward. In other words, ink is ejected in order from the nozzles on the side near the nozzles #1 to #3 so that ink can be ejected from all the nozzles #1 to #7 at the point that the first intermediate processing mode is started.

Printing through the first upper end processing mode results in raster lines formed over the regions R1 to R46, from the first raster line R1 to the 46$^{th}$ raster line R46, shown in the right diagram (in the right diagram, the raster lines that are formed by the first upper end processing mode are shown shaded). Of these regions R1 to R46, the regions R7 to R28 corresponding to raster line R7 to raster line R28 are complete, with all of the raster lines being formed. However, the regions R1 to R6, which correspond to the raster lines R1 to R6, and the regions R29 to R46, which correspond to raster line R29 to raster line R46, are incomplete, with unformed sections being present in each of these raster lines.

Of these, the former region R1 to R6 is a so-called unprintable region. That is, nozzles do not pass over the sections corresponding to the second, third, and sixth raster lines R2, R3, and R6 in any pass number. For this reason, dots cannot be formed in those pixels. Thus, the region R1 to R6 is not used for recording the image, and is excluded from the print region A. On the other hand, the yet unformed sections of the raster lines in the later region R29 to R46 are formed in a complementary manner through the first intermediate processing mode that is executed immediately afterwards, and this region R29 to R46 is completed at that time. In other words, the region R29 to R46 is a region that is completed through both the first upper end processing mode and the first intermediate processing mode, and hereinafter this region R29 to R46 is referred to as the "upper-end/intermediate mixed region."

Further, the region R7 to R28 that is formed through only the first upper end processing mode is referred to as the "upper-end-only region."

In the first intermediate processing mode, the dot forming operation of a single pass is executed in an interlacing manner between carrying operations, each of which in principle carries the paper S by 7•D, as shown in the left diagrams of FIG. 21A and FIG. 21B. All the nozzles #1 to #7 are used for printing in all of the passes, from the first pass to the ninth pass, at this time. As a result, raster lines are formed over the region R29 to R109, from the $29^{th}$ raster line R29 to the $109^{th}$ raster line R109 shown in the right diagram.

More specifically, with regard to the upper-end/intermediate mixed region R29 to R46, the raster lines R29, R33, R36, R37, R40, R41, R43, R44, and R45, which were unformed in the first upper end processing mode, are formed in a complementary manner. In other words, these are formed by filling in the raster lines buried between the raster lines that have already been formed. By doing this, the upper-end/intermediate mixed region R29 to R46 becomes complete. All of the raster lines of the region R47 to R91 are completely formed through only the dot forming operations of the first intermediate processing mode. Hereinafter, the region R47 to R91, which is completed through only the first intermediate processing mode, is referred to as the "intermediate-only region." The region R92 to R109 includes some raster lines with unformed portions, and these are formed in a complementary manner through the first lower end processing mode that is executed next, completing the region R92 to R109. In other words, the region R92 to R109 is a region that is completed through both the first intermediate processing mode and the first lower end processing mode. Hereinafter, the region R92 to R109 is referred to as the "intermediate/lower-end mixed region." It should be noted that in the right diagram the raster lines that are formed through the first lower end processing mode are shown shaded.

In the first lower end processing mode, as shown in FIG. 21B, the dot forming operation of a single pass is executed in an interlacing manner between carrying operations, each of which in principle carries the paper S by 3•D. In the five passes of the later half of the first lower end processing mode, printing is executed using nozzles #5 to #7. Further, in the three passes of the first half of the first lower end processing mode, printing is carried out while decreasing the nozzle number of the nozzles that are used by one in the order of nozzle #1, nozzle #2, and nozzle #3 each time the pass number increases. That is, printing is executed in the first pass using nozzles #2 to #7, in the second pass using nozzles #3 to #7, and in the third pass using nozzles #4 to #7. It should be noted that the reason why the nozzle number used in the three passes of the first half is successively decreased is to make the manner in which the nozzles are used match that of the five latter half passes that are executed immediately thereafter (the fourth pass of the lower end processing through the eighth pass of the first lower end processing).

The result of printing in the first lower end processing mode is that raster lines are formed over the region R92 to R133, from the $92^{nd}$ raster line R92 to the $133^{rd}$ raster line R133 shown in the right diagram.

More specifically, with regard to the intermediate/lower-end mixed region R92 to R109, the raster lines R92, R96, R99, R100, R103, R104, R106, R107, and R108, which were not formed in the first intermediate processing mode, are each formed in a complementary manner, completing the intermediate/lower-end mixed region R92 to R109. All the raster lines of the region R110 to R127 are formed through only the dot forming operations of the first lower end processing mode, completing this region. Hereinafter, the region R110 to R127 that is formed through only the lower end processing mode is referred to as the "lower-end-only region." Further, the region R128 to R133 is a so-called unprintable region, that is, nozzles do not pass over the regions corresponding to the $128^{th}$, $131^{st}$, and $132^{nd}$ raster lines R128, R131, and R132 in any pass number, and thus it is not possible to form dots in those pixels. Therefore, the region R128 to R133 is not used for recording the image, and is excluded from the print region A.

Incidentally, in the case of printing using the first upper end processing mode, the first intermediate processing mode, and the first lower end processing mode, the print start position (the target position on the upper end of the paper S when printing is started) can be set to the fourth raster line, on the lower end side, from the uppermost end of the print region A (in FIG. 21A, the tenth raster line R10). In other words, the target position on the paper upper end when printing is started should be set toward the lower end of the print region A (the upstream side in the carrying direction) by a predetermined margin from the upper end position of the print region A (the position corresponding to the spot where the seventh raster line R7 is formed). By doing this, even if, due to carry error, the paper S is carried more than the stipulated carry amount, as long as that error is within 3•D, the upper end of the paper S is positioned more toward the lower end than the uppermost end of the print region A. Consequently, borderless printing can be reliably achieved without a blank region being formed on the upper end of the paper S. Conversely, if due to carry error the paper S is carried less than the stipulated carry amount, then as long as that amount is within 14•D, the upper end of the paper S is positioned more on the upper-end side than the $24^{th}$ raster line R24, and thus the upper end of the paper S is printed by only the nozzles #1 to #3 above the groove, reliably preventing the platen 24 from becoming dirty.

On the other hand, the print end position (the target position on the lower end of the paper S when printing is finished) can be set to the ninth raster line, on the upper end side, from the lowermost end of the print region A (in FIG. 21B, the $119^{th}$ raster line R119), for example. In other words, the target position on the paper lower end when printing is finished should be set on the upper-end side of the print region A (the downstream side in the carrying direction) by a predetermined margin from the lower end position of the print region A (the position corresponding to the spot where the $121^{st}$ raster line R121 is formed). By doing this, even if, due to carry error, the paper S is carried less than the stipulated carry amount, as long as that error is within 8•D, the lower end of the paper S is positioned more on the upper-end side than the raster line R127 on the lowermost end of the print region A. Consequently, borderless printing can be reliably achieved without a blank region being formed on the lower end of the paper S. Conversely, if due to carry error the paper S is carried more than the stipulated carry amount, then as long as that amount is within 12•D, the lower end of the paper S is positioned more on the lower-end side than the $106^{th}$ raster line R106, and thus the lower end of the paper S is printed by only the nozzles #5 to #7 above the groove, reliably preventing the platen 24 from becoming dirty.

It should be noted that the print start position and the print end position are related to the number of passes that are set in the first intermediate processing mode mentioned above. In other words, to satisfy the conditions of the print start position and the print end position mentioned above with respect to a paper S that corresponds to the paper size mode, first the size in the carrying direction of the print region A must be set to a size that extends beyond the upper end and the lower end of the paper S by 3•D and 8•D, respectively. This is because it is necessary to set the size in the carrying direction to larger than the paper S by 11•D. Consequently, the number of passes in the first intermediate processing mode is set such that the size is larger by 11•D than the size in the carrying direction, which is indicated by the paper size mode that has been input. Incidentally, the size in the carrying direction of the "first size" mentioned above is 110•D. To set the print region A to 121•D, which is larger than 110•D by 11•D, the number of passes of the first intermediate processing mode is set to nine passes.

Figure 22A:
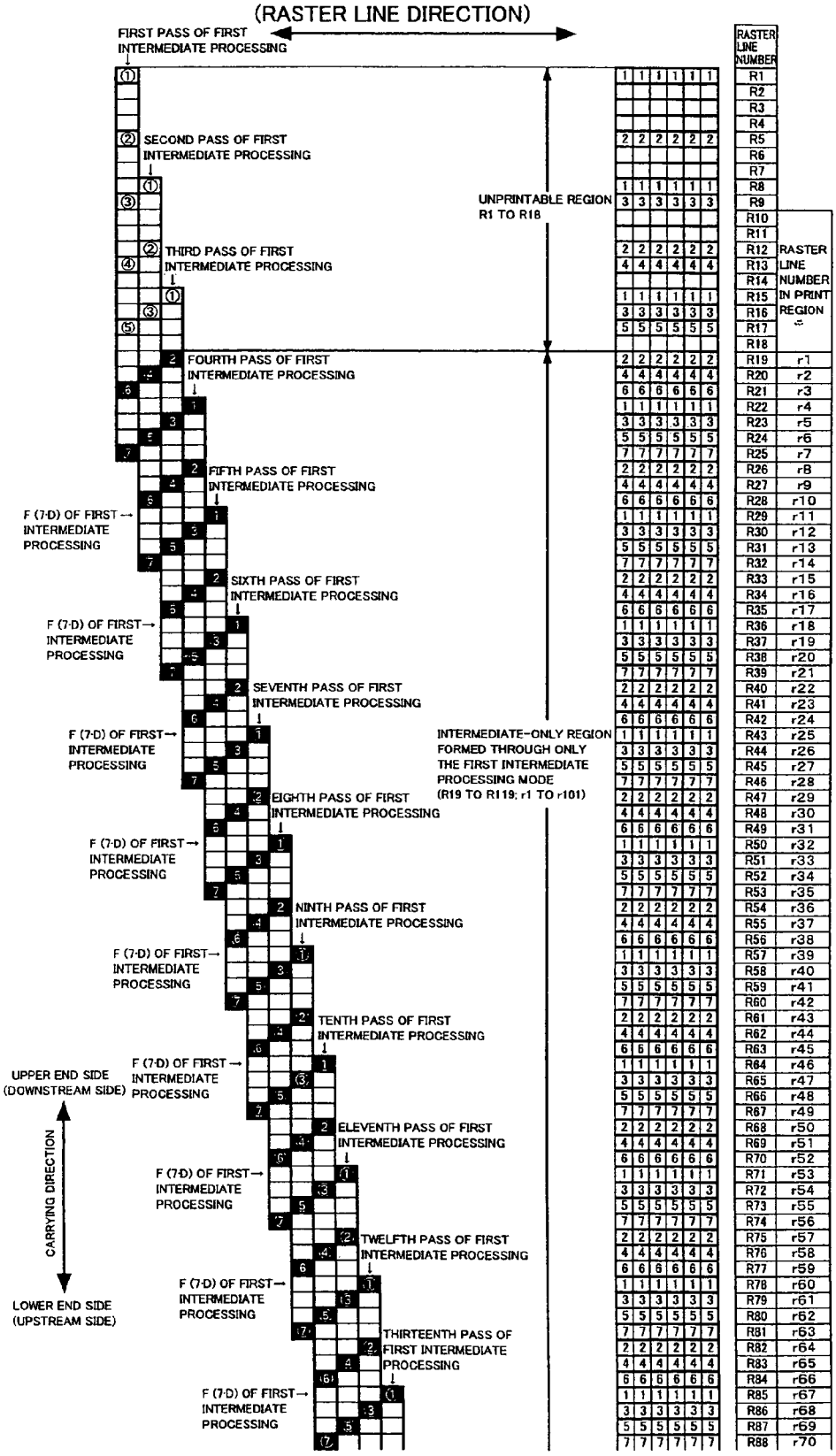
FIG. 22A is a diagram for describing the various processing modes.
Figure 22B:
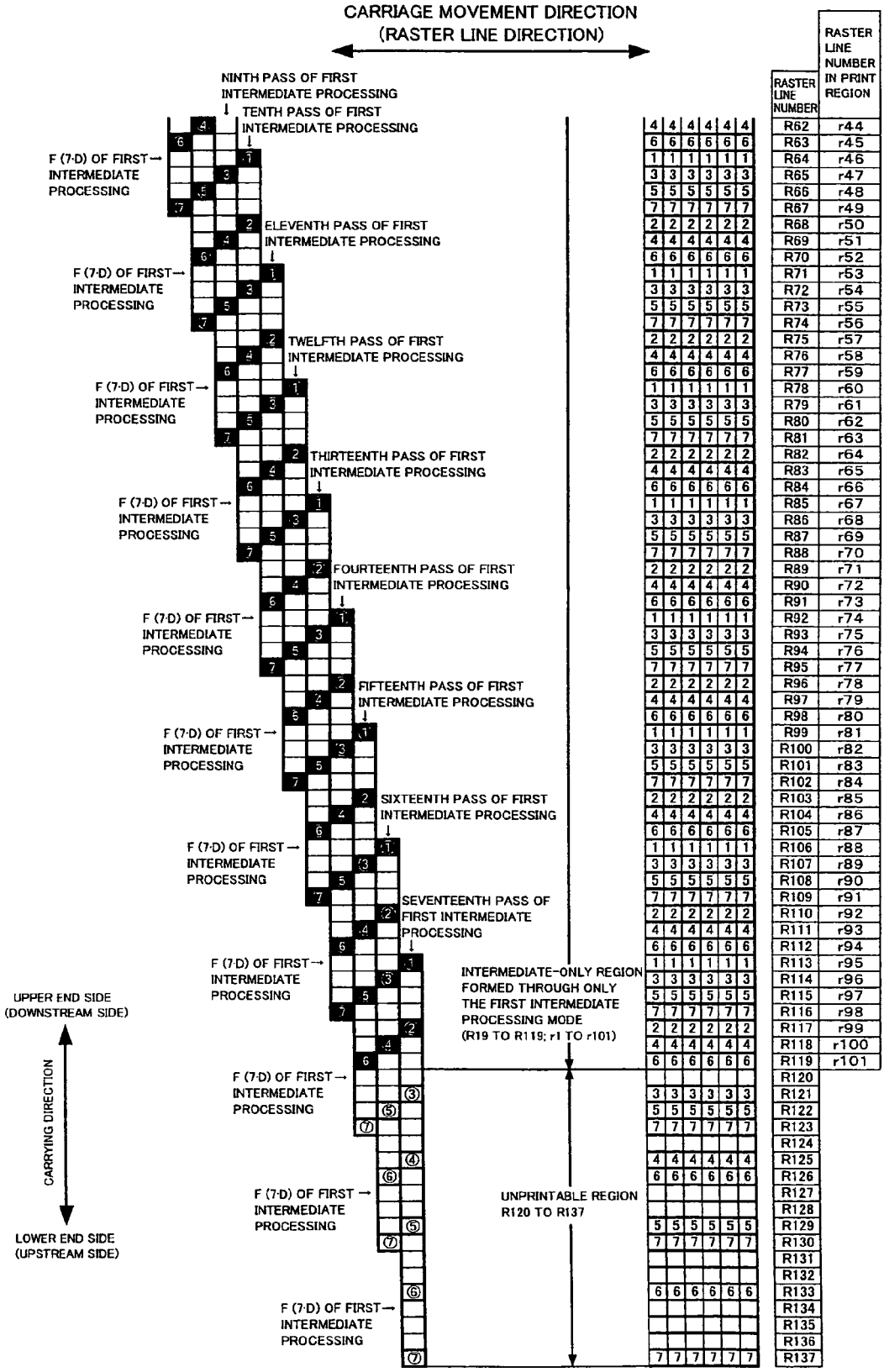
FIG. 22B is a diagram for describing the various processing modes.

(2) Regarding a Case Where an Image is Printed Using Only the First Intermediate Processing Mode This case corresponds to an instance in which the second print mode shown in FIG. 19 and FIG. 20 has been set, that is, an instance in which "bordered" has been set as the margin format mode and "fine" has been set as the image quality mode. As shown in FIG. 22A and FIG. 22B, the printer 1 performs nine passes in the first intermediate processing mode. As a result, ink is ejected at a print resolution of 720×720 dpi onto the region R19 to R119, which serves as the print region A, printing on a paper S of the "first size," which is 110•D in the carrying direction, leaving a border.

It should be noted that like case (1) mentioned above, the number of passes of the first intermediate processing mode changes depending on the paper size mode that has been input. In other words, the number of passes is set such that the size of the print region A is a size with which a margin of a predetermined width is formed on the upper and lower ends of a paper S of the print size mode that has been input. In the example of the diagrams, "first size" has been input as the paper size mode, wherein the size of the paper S in the carrying direction is 110•D. Thus, in order to print on the paper S leaving a border, the number of passes of the first intermediate processing is set to 17 passes, as mentioned above, such that the size in the carrying direction of the print region A is 101•D.

As mentioned above, bordered printing is printing forming a margin at the upper end and the lower end of the paper S. Consequently, it is not necessary to use only the nozzles in opposition to the groove to print on the upper end and the lower end. Thus, printing is executed according to only the first intermediate processing mode, in which all of the nozzles #1 to #7 are used over the entire length in the carrying direction of the paper S.

In the first intermediate processing mode, the dot forming operation of a single pass is performed in an interlacing manner between carrying operations, each with which the paper S is carried by 7•D. Then, in the example of the diagrams, all of the nozzles #1 to #7 are used in all of the passes, from the first pass to the seventh pass, resulting in raster lines being formed over the region from the $19^{th}$ raster line R19 to the $119^{th}$ raster line R119.

However, the region R1 to R18 on the upper-end side includes sections in which raster lines are not formed in any of the passes, such as R18, and thus the region R1 to R18 is an "unprintable region" and is excluded from the print region A. Similarly, the region R120 to R137 on the lower-end side includes sections in which raster lines are not formed in any of the passes, such as R120, and thus this region R120 to R137 also is an "unprintable region" and is excluded from the print region A. Consequently, in the remaining region R19 to R119 all the raster lines are formed through only the first intermediate processing mode. These regions R19 to R119 correspond to the intermediate-only region mentioned above.

Figure 23A:
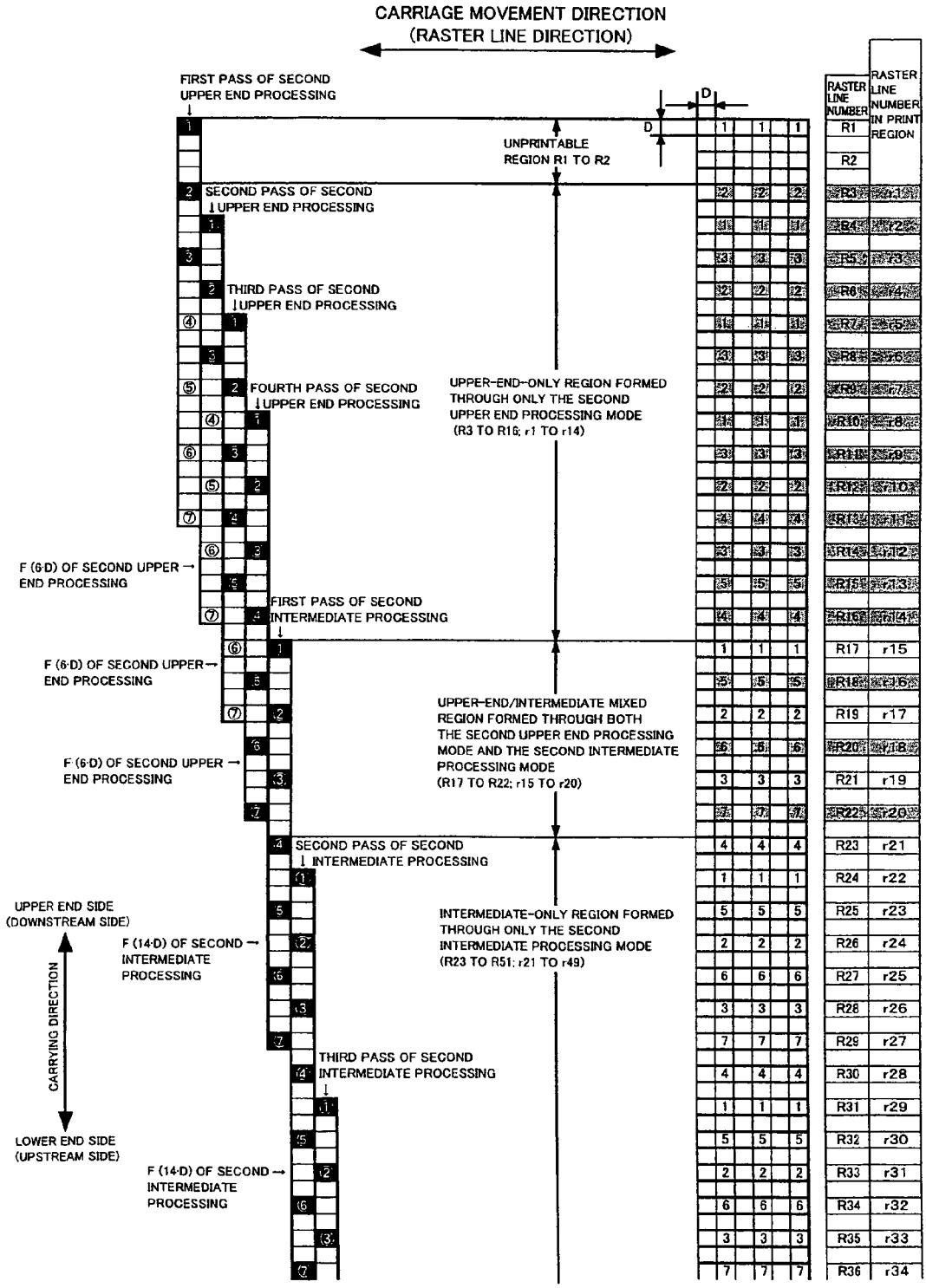
FIG. 23A is a diagram for describing the various processing modes.
Figure 23B:
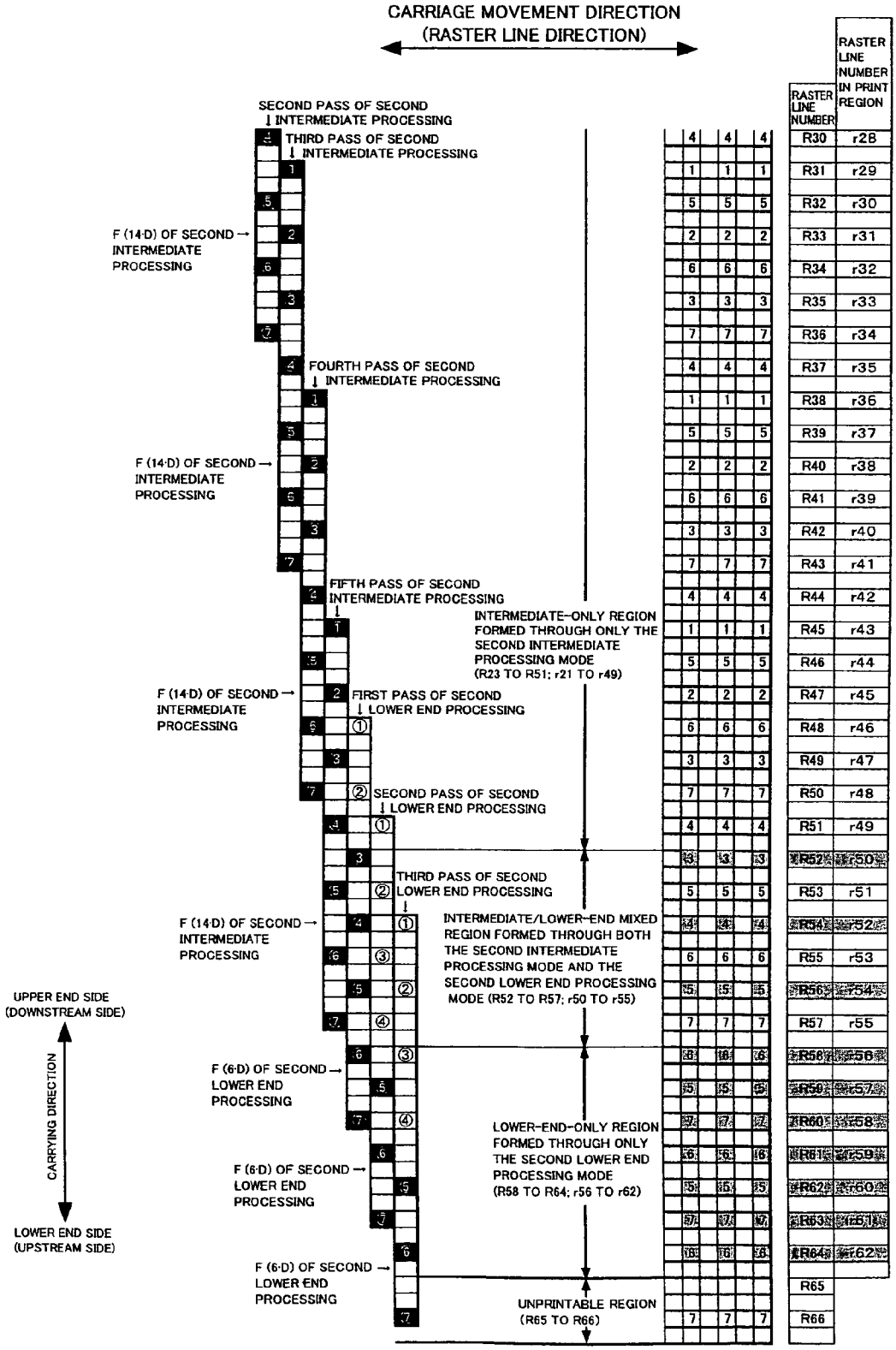
FIG. 23B is a diagram for describing the various processing modes.

(3) Regarding a Case Where an Image is Printed Using the Second Upper End Processing Mode, the Second Intermediate Processing Mode, and the Second Lower End Processing Mode This case corresponds to an instance in which the third print mode shown in FIG. 19 and FIG. 20 has been set, that is, an instance in which "borderless" has been set as the margin format mode and "normal" has been set as the image quality mode. As shown in FIG. 23A and FIG. 23B, the printer 1 performs four passes in the second upper end processing mode, five passes in the second intermediate processing mode, and three passes in the second lower end processing mode. As a result, ink is ejected at a print resolution of 360×360 dpi to the region R3 to R64, which serves as the print region A, borderlessly printing a paper S of the "first size."

It should be noted that because the print resolution is 360×360 dpi, every other grid square shown in the right diagram is buried by a dot. In other words, the raster lines of the print region A are formed every other square.

As in case (1) above, the number of passes in the second upper end processing mode and the second lower end processing mode is fixed and does not change, but the number of passes in the second intermediate processing mode changes depending on the paper size mode. In other words, in order to borderlessly print on a paper S of any paper size mode reliably, the number of passes of the second intermediate processing mode is set such that the size of the print region A is larger than the size of the paper S by 14•D. It should be noted that the value 14•D is determined so that the print start position becomes the fourth raster line, on the lower-end side, from the uppermost end of the print region A (the sixth raster line R6 in FIG. 23A), and that the print end position becomes the fourth raster line, on the upper-end side, from the lowermost end of the print region A (the 61st raster line R61 in FIG. 23B). In the example of the drawings, "first size" has been input and thus the size of the paper S in the carrying direction is 110•D, and therefore the number of passes of the second intermediate processing mode is set to five passes such that the size in the carrying direction of the print region A becomes 124•D (=110•D+14•D). The dot formation processing of the processing modes is described in detail below.

In the second upper end processing mode, the dot forming operation of a single pass is executed in an interlacing manner between the carrying operations, each of which in principle carries the paper S by 6•D, as shown in the left diagram of FIG. 23A.

In the first two passes of the second upper end processing mode, printing is performed using nozzles #1 to #3. In the second two passes, printing is performed while increasing the nozzle number of the nozzles that are used by two each time the pass number advances, in the order of nozzle #4, nozzle #5, nozzle #6, and nozzle #7. It should be noted that the reason for successively increasing the number of nozzles that are used is the same as in the case (1) discussed above.

The result of printing through the second upper end processing mode is that raster lines are formed over the region R1 to R22 shown in the right diagram (in the right diagram, the raster lines that are formed are shown shaded). However, the completed region in which all of the raster lines have been formed, which corresponds to the upper-end-only region mentioned above, is only the region R3 to R16, and the region R1 to R2 and the region R17 to R22 are incomplete because they include some unformed raster lines. Of these, the former region R1 to R2 is an unprintable region because raster lines are not formed in the section corresponding to the second raster line R2 in any pass number, and is excluded from the print region A. On other hand, the latter region R17 to R22 corresponds to the upper-end/intermediate mixed region, and the unformed raster lines in the region R17 to R22 are completed, being formed in a complementary manner, in the second intermediate processing mode that is executed immediately thereafter.

In the second intermediate processing mode, the dot forming operation of a single pass is executed in an interlacing manner between carrying operations, each of which in principle carries the paper S by 14•D, as shown in the left diagrams of FIG. 23A and FIG. 23B. All the nozzles #1 to #7 are used for printing in all of the passes at this time, from the first pass to the fifth pass, and as a result, raster lines are formed over the region R17 to R57 shown in the right diagram. More specifically, with regard to the upper-end/intermediate mixed region R17 to R22, the raster lines R17, R19, and R21, which were unformed in the second upper end processing mode, are each formed in a complementary manner, becoming complete. The region R23 to R51 corresponds to the intermediate-only region, and the region R23 to R51 is completed, all of the raster lines being formed through only the dot forming operations of the second intermediate processing mode. Moreover, the region R52 to R57 corresponds to the intermediate/lower-end mixed region and includes some raster lines that have not been formed, but these are formed in a complementary manner through the second lower end processing mode that is performed immediately thereafter, completing these regions R52 to R57. It should be noted that in the right diagram the raster lines that are formed through the second lower end processing mode only are shown shaded.

In the second lower end processing mode, the dot forming operations of a single pass are executed in an interlacing manner between the carrying operations, each of which in principle carries the paper S by 6•D, as shown in FIG. 23B.

In the single pass of the latter half of the second lower end processing mode, printing is performed using nozzles #5 to #7. Further, in the two first half passes of the second lower end processing mode, printing is performed while the nozzle number of the nozzles that are used is reduced by two each time the pass number advances, in the order of nozzle #1, nozzle #2, nozzle #3, and nozzle #4. It should be noted that the reason for successively reducing the number of nozzles that are used is the same as in the case (1) discussed above.

The result of printing through the second lower end processing mode is that raster lines are formed over the region R48 to R66 shown in the right diagram. More specifically, the intermediate/lower-end mixed region R52 to R57 is completed, the raster lines R52, R54, and R56 that were unformed in the second intermediate processing mode each being formed in a complementary manner. Further, the region R58 to R64 corresponds to the lower-end-only region, and is completed by all the raster lines that are formed through only the dot forming operations of the second lower end processing mode. It should be noted that the remaining region R65 to R66 is an unprintable region because raster lines are not formed in the section corresponding to the $65^{th}$ raster line R65 in any pass number, and thus is excluded from the print region A.

Figure 24A:
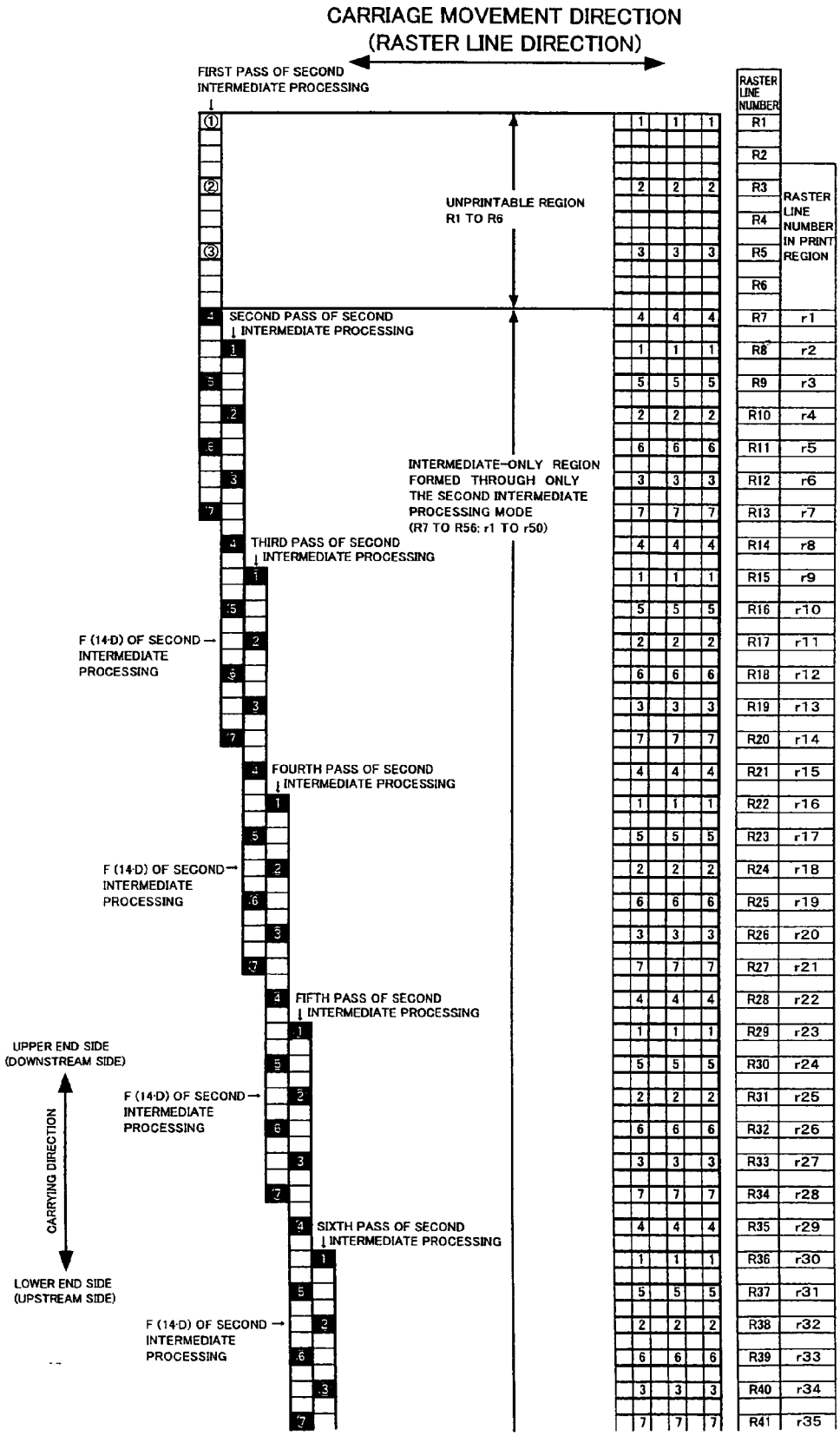
FIG. 24A is a diagram for describing the various processing modes.
Figure 24B:
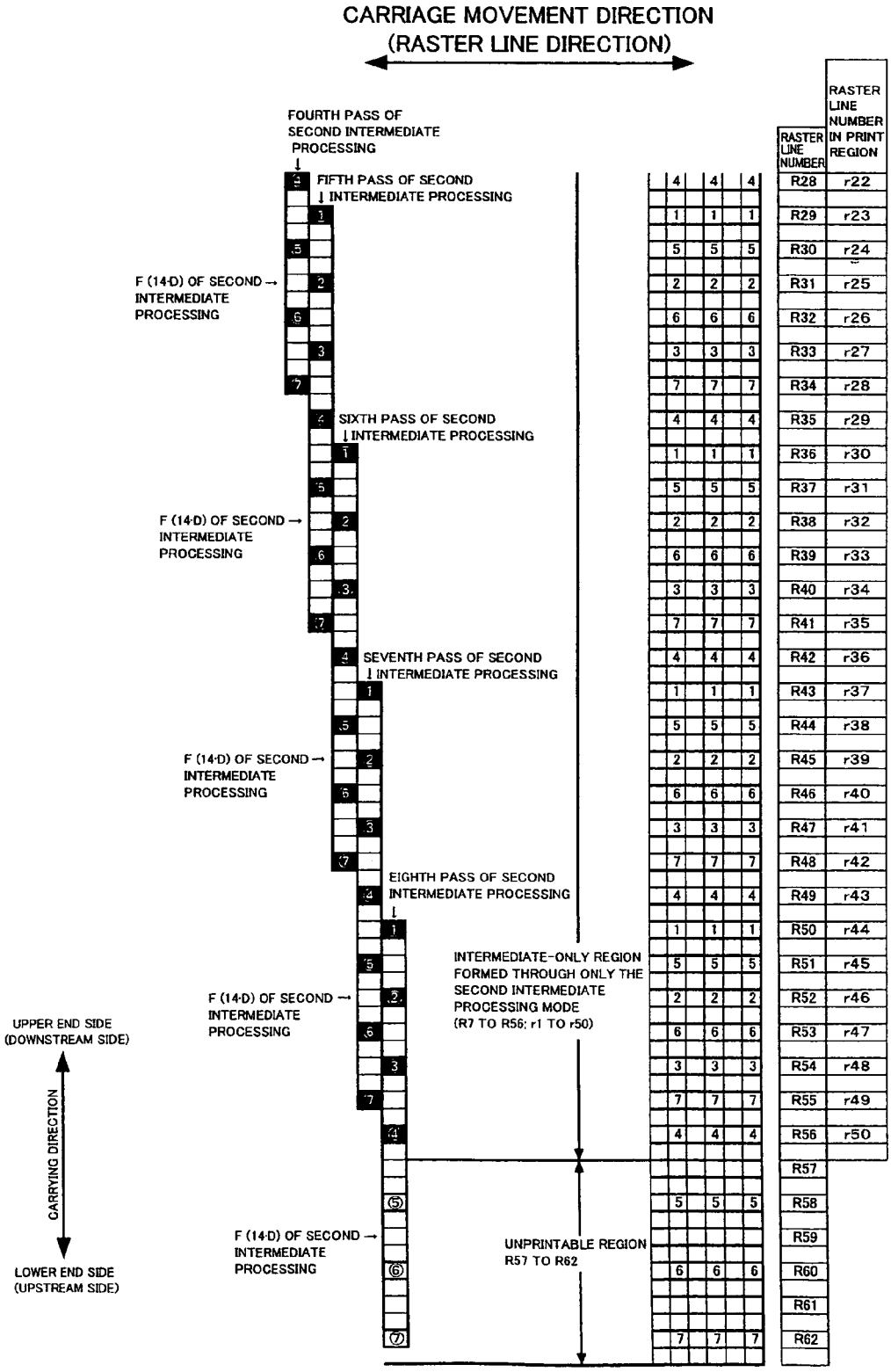
FIG. 24B is a diagram for describing the various processing modes.

(4) Regarding a Case in which an Image is Printed Using Only the Second Intermediate Processing Mode This case corresponds to an instance in which the fourth print mode shown in FIG. 19 and FIG. 20 has been set, that is, an instance in which "bordered" has been set as the margin format mode and "normal" has been set as the image quality mode. As shown in FIG. 24A and FIG. 24B, the printer 1 performs eight passes in the second intermediate processing mode. As a result, ink is ejected at a print resolution of 360×360 dpi onto the region R7 to R56 serving as the print region A, printing a paper S of the "first size" leaving a border.

It should be noted that like case (2) mentioned above, the number of passes of the second intermediate processing mode changes depending on the paper size mode. In the example of the diagrams, "first size" has been input, and thus in order to print a paper S whose size is 110•D while leaving a border, the number of passes is set to a pass number such that the size in the carrying direction of the print region A is 100•D. For this reason, the number of passes of the second intermediate processing mode is set to eight passes. It should be noted that in bordered printing, the reason for printing through the second intermediate processing mode is the same as in the case (2) discussed above.

In the second intermediate processing mode, the dot forming operation of a single pass is performed in an interlacing manner between carrying operations, each with which the paper S is carried by 14•D. Then, in the example of the diagrams, all of the nozzles #1 to #7 are used in all of the passes, from the first pass to the eighth pass, resulting in raster lines being formed over the region spanning the region R7 to R56.

It should be noted that the region from R1 to R6 on the upper-end side includes sections in which raster lines are not formed in any of the passes, such as the section of R6, and thus the region R1 to R6 is an unprintable region and is excluded from the print region A. Similarly, the region R57 to R62 on the lower-end side includes sections in which raster lines are not formed in any of the passes, such as the section of R57, and thus this region R57 to R62 also is an unprintable region and is excluded from the print region A. It should be noted that in the remaining region R7 to R56 all of the raster lines are formed through only the second intermediate processing mode, and thus this corresponds to the intermediate-only region.

Incidentally, the first upper end processing mode, first intermediate processing mode, first lower end processing mode, second upper end processing mode, second intermediate processing mode, and second lower end processing mode described above can each be considered different modes. This is because the relationship between the six corresponds to a relationship where printing is performed with at least one of at least the dot forming operation and the carrying operation being different.

In other words, print processing in which the carrying operation is different refers to print processing in which the pattern of change in the carry amount F of the carrying operations (the carry amount F for each pass) is different. In regard to this, the pattern of change in the first intermediate processing mode is 7•D for all the passes, the pattern of change in the second intermediate processing mode is 14•D for all the passes, the pattern of change in the first upper end processing mode and the first lower end processing mode is 3•D for all the passes, and the pattern of change in the second upper end processing mode and the second lower end processing mode is 6•D for all the passes.

Consequently, the first intermediate processing mode and the second intermediate processing mode are different from any of the other modes in terms of their pattern of change in the carry amount F, and thus these processing modes are different from the other processing modes.

On the other hand, the first upper end processing mode and the first lower end processing mode both exhibit a pattern of change in the carry amount F of 3•D for all of the passes, and thus they are not different from one another as regards the print processing in the carrying operations. However, as regards the print processing of their dot forming operations, they are different from one another and thus they can be regarded as different processing modes. In other words, the pattern of change in the nozzles that are used in the dot forming operations (passes) in the first upper end processing mode is a pattern in which the nozzles #1 to #3 are used in the first through fourth passes, and the nozzles that are used is increased by one in the order of #4, #5, #6, and #7 each time the pass number increases in the fifth through eighth passes. In contrast, the pattern of change in the first lower end processing mode is a pattern in which the nozzles that are used is decreased by one in the order of #1, #2, #3, and #4 in the first through fourth passes, and in the fifth through eighth passes the nozzles #5 to #7 are used. Consequently, the first upper end processing mode and the first lower end processing mode are different from one another in terms of the nozzle change pattern, and thus, they are different from one another in terms of print processing of the dot forming operations. Due to this, these processing modes are different from one another.

Likewise, the second upper end processing mode and the second lower end processing mode both have a carry amount change pattern of 6•D for all of the passes, and thus they are not different from one another in terms of the print processing of the carrying operations. However, as regards the print processing of their dot forming operations, they are different from one another and thus they can be regarded as different processing modes. In other words, the pattern of change in the nozzles that are used in the dot forming operations (passes) in the second upper end processing mode is a pattern in which the nozzles #1 to #3 are used in the first through second passes, and the nozzles that are used is increased by two at a time in the order of #4, #5, #6, and #7 each time the pass number increases in the third through fourth passes. In contrast, the pattern of change in the second lower end processing mode is a pattern in which #3 to #7 are used in the first pass and the nozzles #5 to #7 are used in the second through third passes. Consequently, the second upper end processing mode and the second lower end processing mode are different from one another in terms of the nozzle change pattern, that is, they are different from one another in terms of their print processing of the dot forming operations. Due to this, these processing modes are different from one another.

The processing modes were described above using specific examples. However, because the print region A is the only region that contributes to image formation, the raster line numbers are reassigned for only the print region A in the following description. In other words, as shown in the right diagrams of FIG. 21A to FIG. 24C, the uppermost raster line in the print region A is called the first raster line r1, and thereafter heading toward the lower end in the drawings the raster lines are the second raster line r2, the third raster line r3, and so on.

===Regarding the Reason Why Darkness Nonuniformaties Occur in an Image===

Darkness nonuniformaties that occur in a multicolor image that is printed using CMYK inks are generally due to darkness nonuniformaties that occur in each of those ink colors. For this reason, the method that is normally adopted is a method for inhibiting darkness nonuniformaties in images printed in multiple colors by separately inhibiting darkness nonuniformities in each of the ink colors.

Figure 25A:
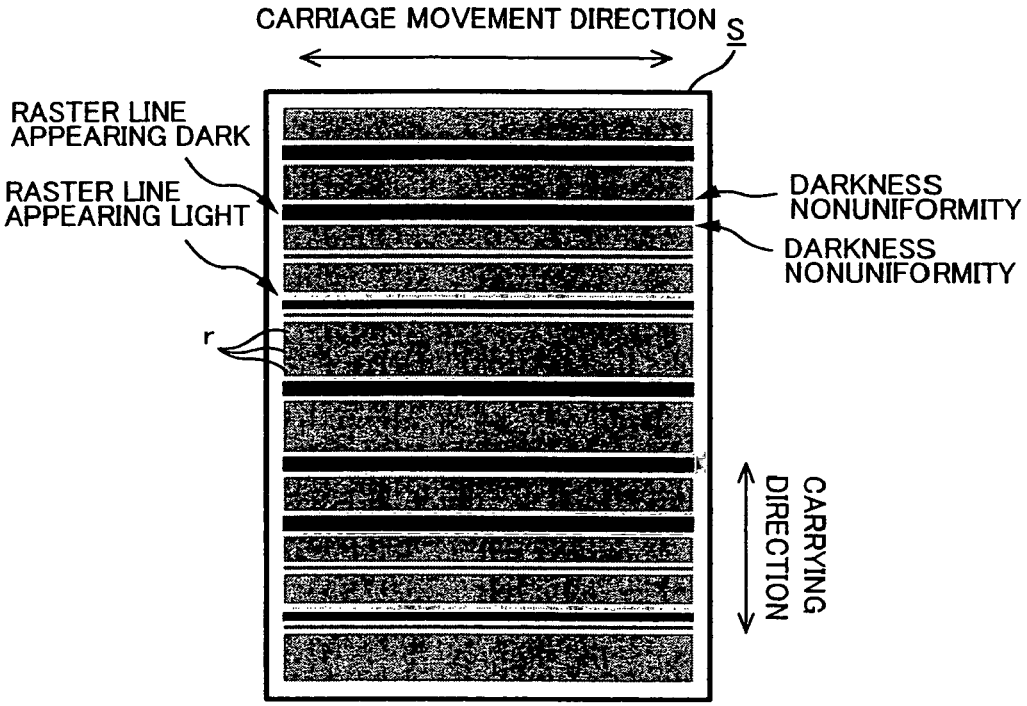
FIG. 25A is a diagram for describing the darkness nonuniformities that occur, in an image printed in a single color, in the carrying direction of the paper.
Figure 25B:
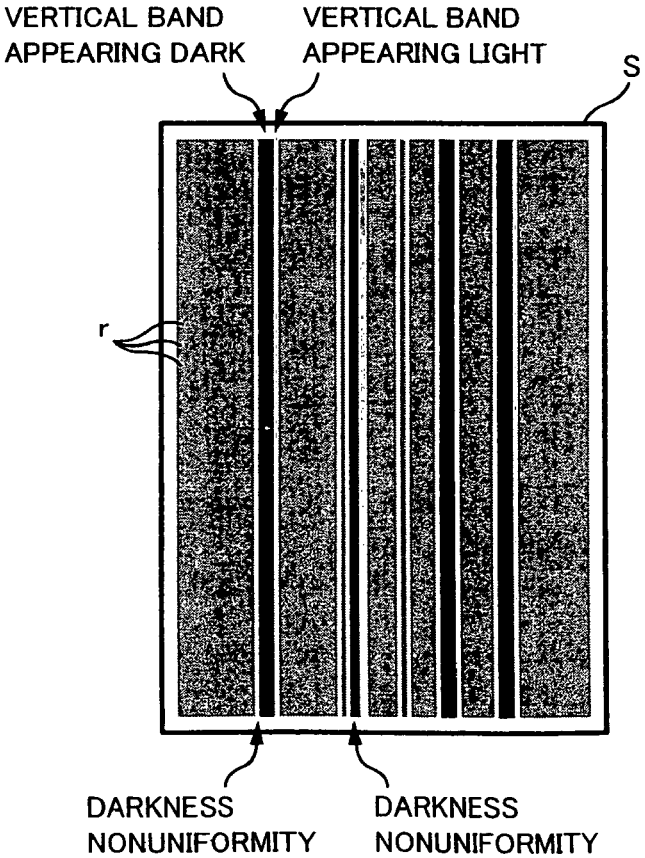
FIG. 25B is a diagram for describing the darkness nonuniformities that occur in the carriage movement direction.

Accordingly, the following is a description of how darkness nonuniformaties occur in images printed in a single color. FIG. 25A is a diagram for describing darkness nonuniformaties that occur in an image that is printed in a single color, these being darkness nonuniformaties that occur in the carrying direction of the paper S. Further, FIG. 25B is a diagram for describing the darkness nonuniformaties that occur in the carriage movement direction. These diagrams show the darkness nonuniformaties in an image that has been printed in one of the ink colors from CMYK, for example black ink.

The darkness nonuniformaties in the carrying direction that are illustrated in FIG. 25A appear as bands parallel to the carriage movement direction (for convenience, these are also referred to as "horizontal bands"). These darkness nonuniformaties in horizontal bands for example occur due to discrepancies in the ink ejection amount between nozzles, but they can also occur due to discrepancies in the processing precision of the nozzles. That is, variation in the direction of travel of the ink that is ejected from the nozzles occurs due to discrepancies in the processing precision of the nozzles. Due to this variation in the travel direction, the positions of the dots that are formed by the ink that lands on the paper S are deviated in the carrying direction from the target formation positions.

In such a case, the positions where the raster lines r made of these dots are necessarily also deviated in the carrying direction from their target formation positions, and thus the spacing between adjacent raster lines r in the carrying direction becomes periodically wide or narrow. When viewed macroscopically, these appear as darkness nonuniformaties in horizontal bands. In other words, adjacent raster lines r with a relatively wide spacing between them macroscopically appear light, whereas raster lines r with a relatively narrow spacing between them macroscopically appear dark.

The darkness nonuniformaties in the carriage movement direction that are shown in FIG. 25B appear as bands parallel to the direction that intersects the carriage movement direction, that is, to the carrying direction (for convenience, these are also referred to as "vertical bands"). These darkness nonuniformaties in vertical bands for example occur due to the mechanism constituting the printer 1, such as vibration of the carriage 31 as it moves. In other words, due to vibration of the carriage 31 the recording head 41 also is tilted, and the ink that is ejected in this tilted state travels deviated from the standard direction. Due to this deviation in travel direction, the positions of the dots that are formed by the ink that lands on the paper S are shifted in the carriage movement direction with respect to the target formation positions.

It should be noted that these factors causing darkness nonuniformaties also apply to the other ink colors as well. As long as even one color among the colors CMYK has this tendency, darkness nonuniformities will appear in an image printed in multiple colors.

<Regarding the Method for Inhibiting Darkness Nonuniformities According to a Reference Example>

The method of a reference example for inhibiting darkness nonuniformities is described. In the method of this reference example, first, all of the nozzles of the head 41 are used to print a correction pattern for correcting the darkness. That is, ink is intermittently ejected from all of the nozzles as the nozzles move in the carriage movement direction, to thereby print a correction pattern. As regards the raster lines making up the correction pattern that is printed in this manner, the order of the nozzles forming the raster lines matches the order of the nozzles in the nozzle rows.

Figure 26:
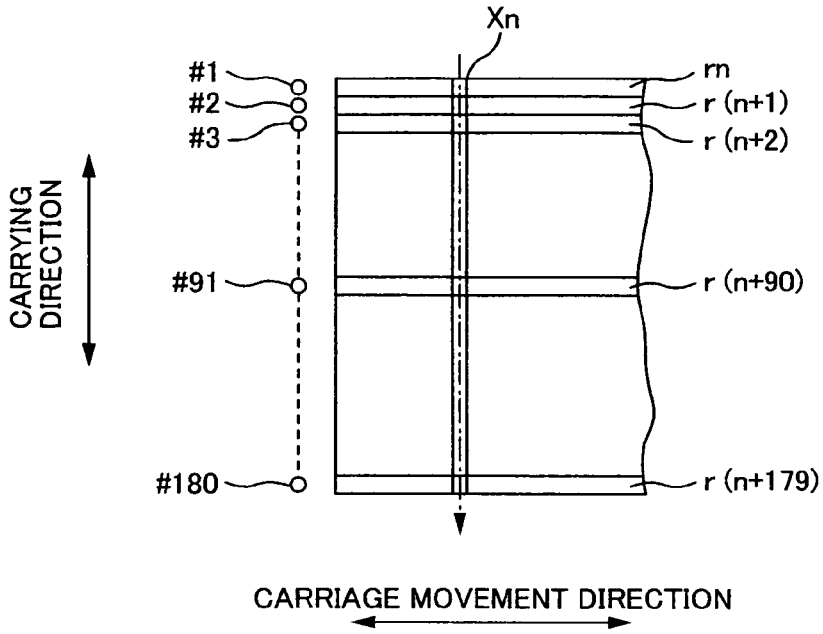
FIG. 26 is a diagram schematically showing the relationship between the nozzles and the correction patterns printed according to a method of a reference example.

Here, FIG. 26 is a diagram that schematically shows the relationship between the nozzles and the correction pattern that has been printed through this reference example method. As shown in the diagram, the raster line rn positioned on the uppermost end of the correction pattern that is printed on the paper S is formed by nozzle #1. Then, the raster line r(n+1) positioned second from the uppermost end is formed by nozzle #2, and the raster line r(n+2) positioned third is formed by nozzle #3. Likewise thereafter, the raster line r(n+90)

positioned 91st from the uppermost end is formed by nozzle #91, and the (180th) raster line r(n+179) positioned on the lowermost end is formed by nozzle #180.

Next, the darkness is measured for each pixel in the correction pattern printed in this manner. Darkness measurement is performed along the carrying direction with respect to one spot in the scanning direction of the correction pattern. In the example of FIG. 26, a position Xn in the carriage movement direction is measured along the carrying direction from the upper end to the lower end of the correction pattern. Then, a correction value is obtained for each nozzle based on the dot darkness that has been measured.

Figure 27A:
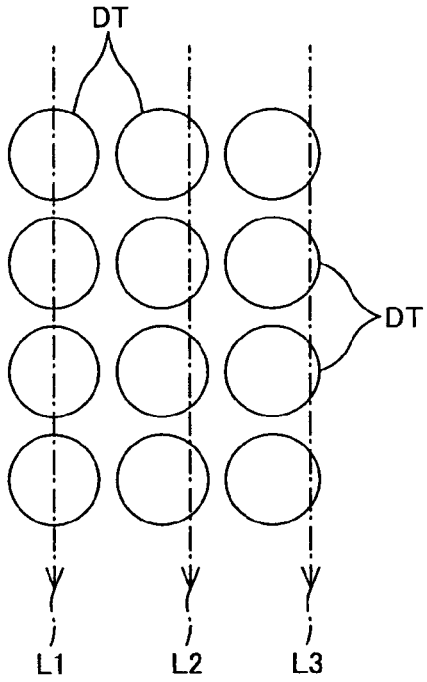
FIG. 27A is a diagram schematically showing the measurement positions of the dots.
Figure 27B:
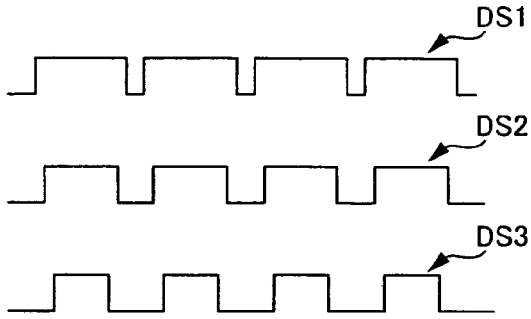
FIG. 27B is a diagram showing the measurement signal that is obtained by measuring the measurement position of FIG. 27A.

With the method of this reference example, there is the problem that it is difficult to increase the correction accuracy. This point is described below. Here, FIG. 27A is a diagram schematically showing the dot measurement positions. Further, FIG. 27B is a diagram that shows the measurement signals that are obtained by measuring at the measurement positions of FIG. 27A.

In general, the ink that is ejected from the nozzles expands in a substantially circular fashion. As shown in these drawings, if such dots are measured, there would be a difference in the measured darkness, even if the same dot is measured, depending on the spot where the dot is measured. In other words, as shown in the left diagram of FIG. 27A, if measurements are taken along a straight line L1 that passes through the center of the dots, then as shown in the upper stage of FIG. 27B, the duty ratio of the detection signal DS1 is greatest, resulting in the highest measurement darkness. Then, as shown in the center and right diagrams of FIG. 27A, when the dots are measured along the straight lines L2 and L3, which are parallel to the straight line L1 and are positioned outward in the radial direction of the dots from the straight line L1, then as shown in the middle stage and the lower stage of FIG. 27B, the duty ratios of the detection signals DS2 and DS3 are smaller than that of the detection signal DS1, which was measured along the straight line L1 passing through the center of the dots, resulting in a lower measurement darkness. In this case, the measured darkness becomes lower as the straight lines L2 and L3, which show the measured position, move away from the straight line L1, which passes through the center of the dots. Thus, with the method of this reference example the darkness that is obtained differs depending on where in the dot the darkness is measured. For this reason, there is the problem that it is difficult to accurately obtain correction values.

Further, with this method it is assumed that all of the dots are formed at the same size in the correction pattern. Thus, it is difficult to adopt this method for a halftone correction pattern that has been recorded by thinning out the dots (for convenience, this is referred to as "halftone correction pattern").

Figure 28A:
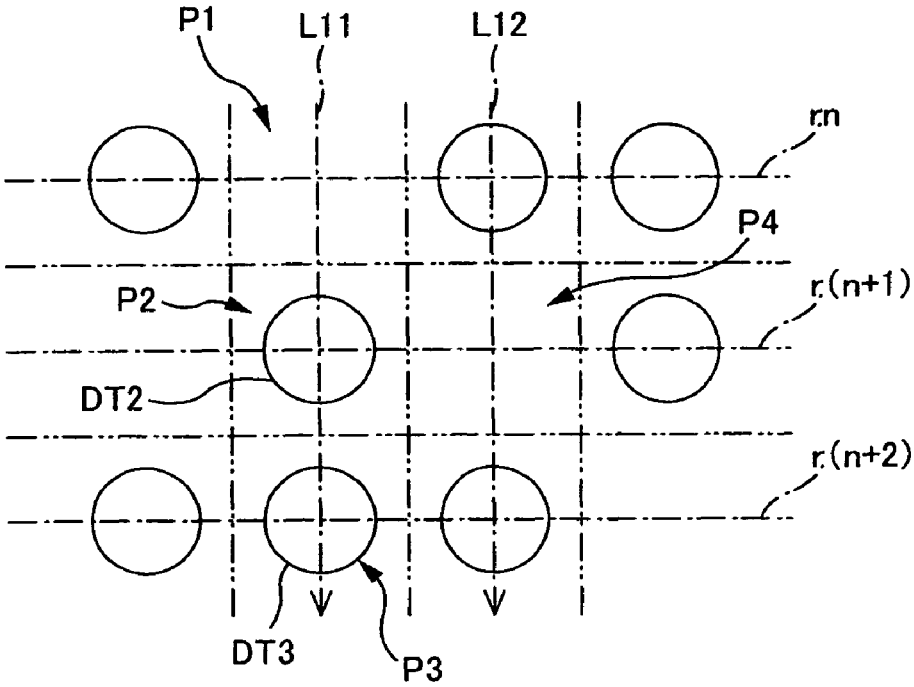
FIG. 28A is a diagram describing how the darkness of a halftone correction pattern is measured.
Figure 28B:
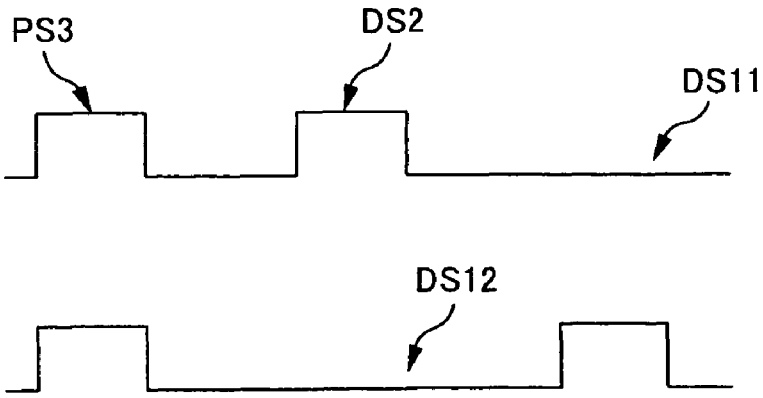
FIG. 28B is a diagram describing the detection signals that are obtained through the darkness measurement of FIG. 28A.

Here, FIG. 28A is a diagram describing darkness measurement of a halftone correction pattern, and FIG. 28B is a diagram for describing the detection signals that are obtained through the darkness measurements of FIG. 28A.

As shown in FIG. 28A, the print darkness of the halftone correction pattern is lowered by thinning out the dots that are formed. Thus, the detection signal DS11 that is obtained by measuring the darkness of the dots (raster lines) along a straight line L11 that is parallel with the carrying direction does not include a pulse at the temporal point corresponding to the pixel P1 because a dot is not formed in the pixel P1. Thus, it is difficult to obtain a correction value for the raster line rn to which the pixel P1 belongs. It should be noted that in this case, pulses PS2 and PS3 are obtained because dots DT2 and DT3 are formed in the pixels P2 and P3, respectively. Correction values can be obtained for the raster lines r(n+1) and r(n+2) to which the pixels P2 and P3 belong using these pulses PS2 and PS3. Further, the detection signal DS12 that is obtained by measuring the dots along the straight line L12 does not include a pulse at the temporal point corresponding to the pixel P4 because a dot is not formed in the pixel P4. Thus, it is difficult to obtain a correction value for the raster line r(n+1) to which the pixel P4 belongs.

Furthermore, this method does not take into consideration the combination of nozzles that form adjacent raster lines r. In other words, darkness nonuniformaties that occur in the carrying direction and extend in the carriage movement direction (horizontal band-shaped nonuniformaties; see FIG. 25A) may also occur due to the combination of the nozzles forming adjacent raster lines r. Say for example that a particular nozzle #na has the characteristic of ejecting ink toward the upper-end side of the paper S, and a separate nozzle #nb has the characteristic of ejecting ink toward the lower-end side of the paper S. In this case, if a raster line r is formed by the nozzle #nb next to (in a position adjacent on the lower-end side to) a raster line r that is formed by the nozzle #na, then these raster lines will be formed at a spacing that is wider in the carrying direction than the normal spacing. An image that macroscopically is lighter in darkness than normal occurs as a result. Conversely, if a raster line r is formed by the nozzle #na next to a raster line r that is formed by the nozzle #nb, then these raster lines will be formed at a spacing that is narrower in the carrying direction than the normal spacing. An image that macroscopically has a darker darkness than normal occurs as a result. In images that are printed through interlacing, the order of the nozzles that form the raster lines making up the image does not always match the order of the nozzles in the nozzle rows. That is to say, there are cases where the combination of nozzles forming adjacent raster lines may change. Because this combination of nozzles changes depending on the processing modes described above, the correction values that are obtained through the reference example method may not be effective even if they are used when printing in the processing modes.

Additionally, with this method, the pixels to be measured in the raster lines making up the correction pattern are a single pixel out of the plurality of pixels making up a single line. Thus, it is difficult to correct darkness nonuniformities in the carriage movement direction (vertical band-shaped darkness nonuniformities) shown in FIG. 25B.

===Method According to the Present Embodiment for Printing an Image in which Darkness Nonuniformities Have Been Inhibited===

<Main Features of Printing Method of Present Embodiment>

Taking the above matters into consideration, in the present embodiment, the darkness of each raster line is measured with respect to a printed test pattern to obtain a correction value for each raster line. Here, the darkness of a plurality of pixels positioned on the same raster line is measured and correction values are obtained based on the measured darkness. For example, a correction value is obtained from the average value of the darkness of the plurality of pixels that is measured. Then, the dots of the corresponding raster line are formed in the dot forming operation such that the darkness becomes the darkness corrected by the correction amount. Thus, discrepancies in darkness due to differences in the positions where the dots are measured are cancelled, thereby effectively inhibiting darkness nonuniformaties in the image.

Further, in the present embodiment, the correction pattern is printed with the combination of nozzles that are used when the actual printing is performed. For example, if the actual printing is performed using interlacing, then the correction pattern also is printed using interlacing. Further, if there are a plurality of processing modes, then printing is performed through each processing mode. By adopting this method, correction values are obtained also taking into consideration the combination of the nozzles that are used, and thus, darkness discrepancies caused by differences in the combination of nozzles are also corrected.

Additionally, in this embodiment, an "other correction value" for correcting the darkness in the carriage movement direction of the image is set for each pixel arranged in the movement direction. Then, in the dot forming operations the dots of the corresponding line are formed so that the darkness becomes the darkness corrected based on both the correction value and the other correction value. Thus, darkness nonuniformities in the carriage movement direction in the image also are inhibited, allowing darkness nonuniformities in the image to be effectively inhibited. Further, the other correction values are obtained by printing an "other correction pattern" and then obtaining the other correction values based on the darkness of the pixels of these correction patterns. In this case, the other correction value is obtained based on the darkness of a plurality of pixels in the same position in the movement direction of the other correction pattern, for example, from the average value thereof. By doing this, darkness discrepancies due to differences in the measurement positions of the dots are cancelled out, allowing darkness nonuniformities in the image to be more effectively inhibited.

<Regarding the Method for Printing an Image According to the Present Embodiment>

Figure 29:
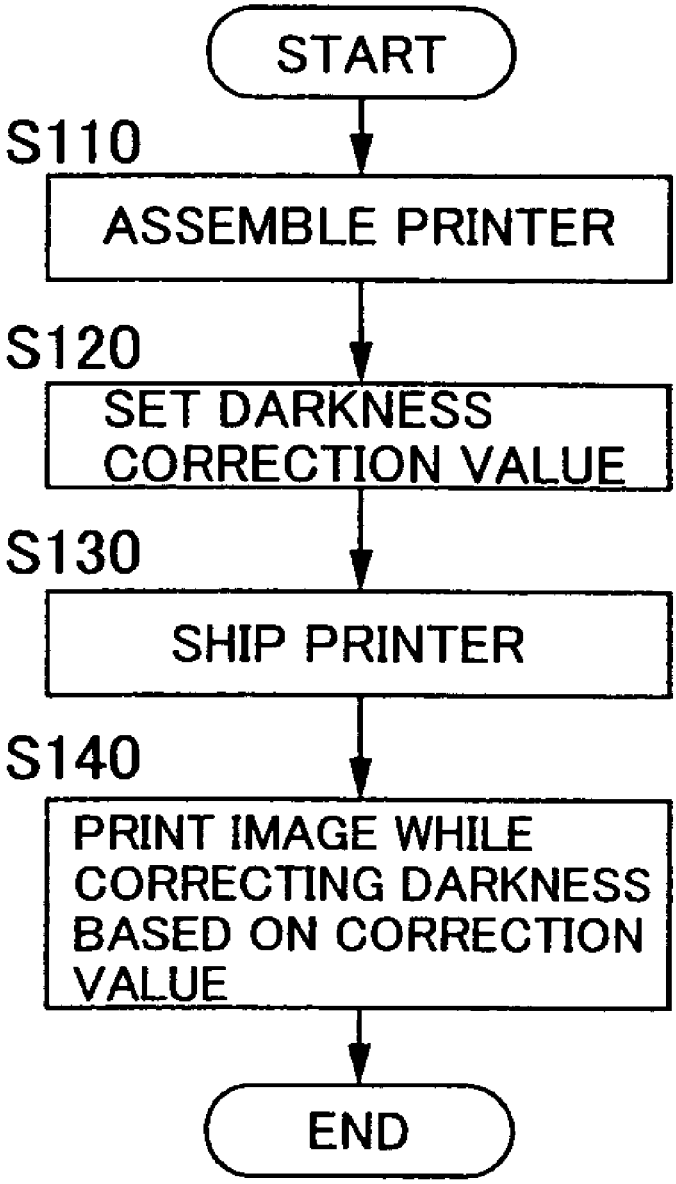
FIG. 29 is a flowchart showing the flow of the processing related to the method for printing the image.

FIG. 29 is a flowchart showing the flow etc. of the processing in the method for printing an image according to the present embodiment. An outline of each process is described below with reference to this flowchart. First, the printer 1 is assembled on the manufacturing line (S110). Next, a worker on the inspection line sets, to the printer 1, correction values for correcting the darkness (S120). The correction values that are obtained here are stored on a memory, more specifically the correction value storage section 63*a* (see FIG. 8), of the printer 1. Next, the printer 1 is shipped (S130). Then, a user that has purchased the printer 1 performs actual printing of an image, and at the time of this actual printing, the printer 1 prints an image on the paper S while performing darkness correction for each raster line based on the correction values (S140). The method of printing an image according to the present embodiment is achieved by the correction value setting step (step S120) and the actual printing of the image (step S140). Consequently, step S120 and step S140 are described below.

It should be noted that for convenience sake, a case in which darkness correction is performed using only the correction values for correcting the darkness in the carrying direction is described first, and a case in which darkness correction is performed combining the other correction values for correcting the darkness in the carriage movement direction will be described later.

<Step S120: Setting the Darkness Correction Values for Inhibiting Darkness Nonuniformities>

Figure 30:
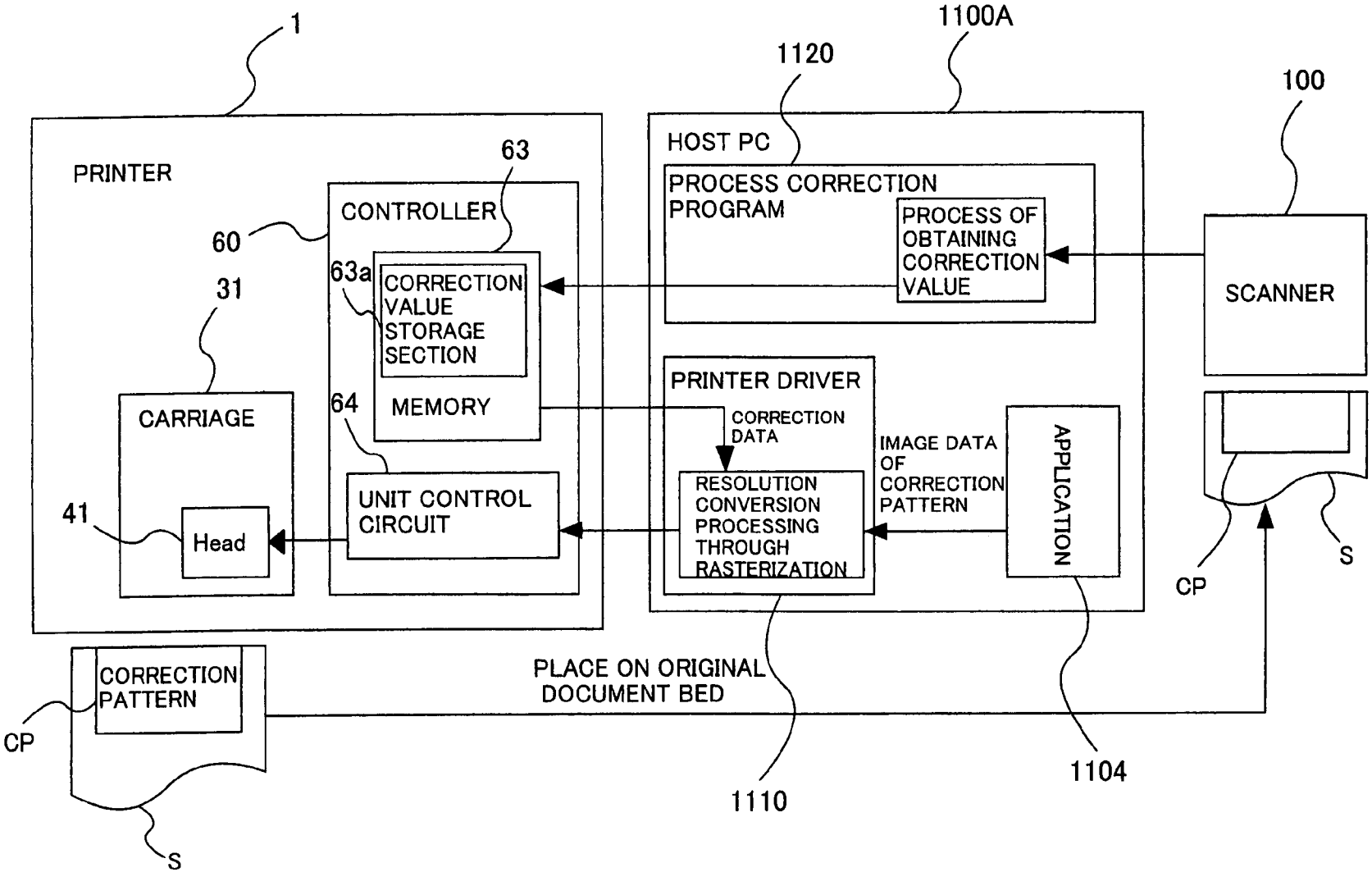
FIG. 30 is a block diagram describing equipments used for setting the correction values.

FIG. 30 is a block diagram for describing equipments used in setting the correction values. It should be noted that structural elements that have already been explained are assigned identical reference numerals and thus description thereof is omitted. In this diagram, a computer 1100A is a computer that is disposed on an inspection line, and runs a process correction program 1120. This process correction program can perform a correction value obtaining process. With this correction value obtaining process, a correction value for a target raster line r is obtained based on a data group (for example, 256 tone grayscale data of a predetermined resolution) obtained by a scanner device 100 reading a correction pattern that has been printed on a paper S. It should be noted that the correction value obtaining process is described in greater detail later. Further, an application running on the computer 1100A outputs to the printer driver 1110 image data for printing a correction pattern CP. Then, the printer driver 1110 performs the series of processes from resolution conversion to rasterization, and outputs to the printer 1 the print data for printing the correction pattern CP.

Figure 31:
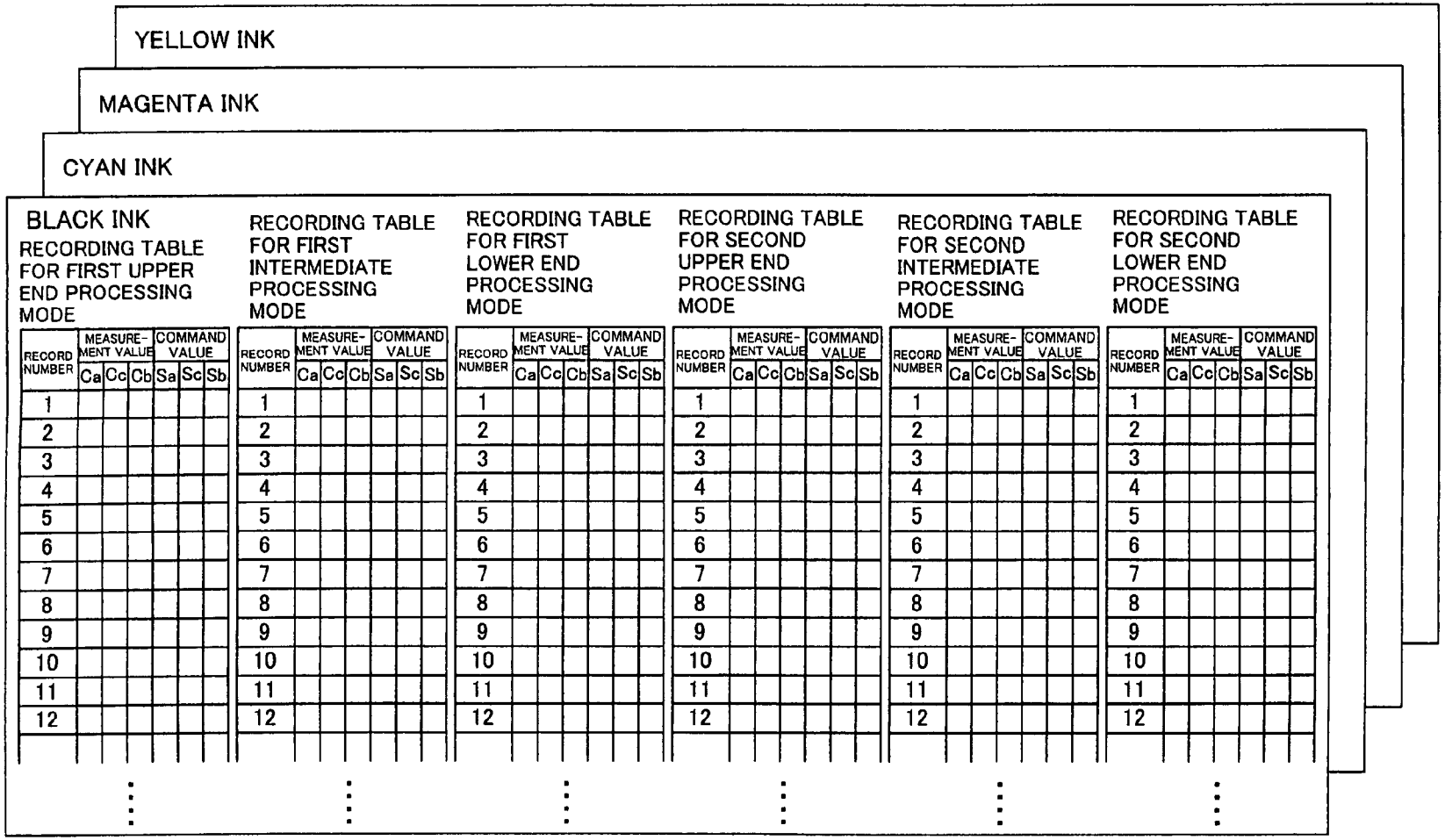
FIG. 31 is a conceptual diagram of a recording table.

FIG. 31 is a conceptual diagram of a recording table that is provided in the memory of the computer 1100A. The recording table is provided separately for each division of ink color and processing mode. The measurement values of the correction pattern CP printed in each division are recorded in the corresponding recording table. It should be noted that this diagram shows recording tables for black (K) for the first upper end processing mode, the first intermediate processing mode, the first lower end processing mode, the second upper end processing mode, the second intermediate processing mode, and the second lower end processing mode, as representative of these recording tables.

The measurement values Ca, Cb, and Cc for the three correction patterns CPka, CPkb, and CPkc (described later), which each having a different darkness, and command values Sa, Sb, and Sc corresponding to those measurement values, are recorded in each recording table. Thus, six fields are prepared in this recording table. In the records of the first field and the fourth field from the left of the table are recorded the measurement value Ca, and its command value Sa, for the correction pattern CPka, which has the lightest darkness. Further, in the records of the third field and the sixth field from the left are recorded the measurement value Cb, and its command value Sb, for the correction pattern CPkb, which has the darkest darkness. Likewise, in the records of the second field and the fifth field from the left are recorded the measurement value Cc, and its command value Sc, for the correction pattern CPkc, which has an intermediate darkness.

A record number is given to each record, and the measurement values of the small-numbered raster lines in the corresponding correction patterns. CP1, CP2, and CP3 (described later) are successively recorded from the small number records. The number of records that is provided is the number that can correspond to the overall width of the print region A (length in the carrying direction). For the three correction patterns CPka, CPkb, and CPkc, the measurement values Ca, Cb, and Cc and the command values Sa, Sb, and Sc of the same raster line are recorded in a record with the same record number.

Figure 32:
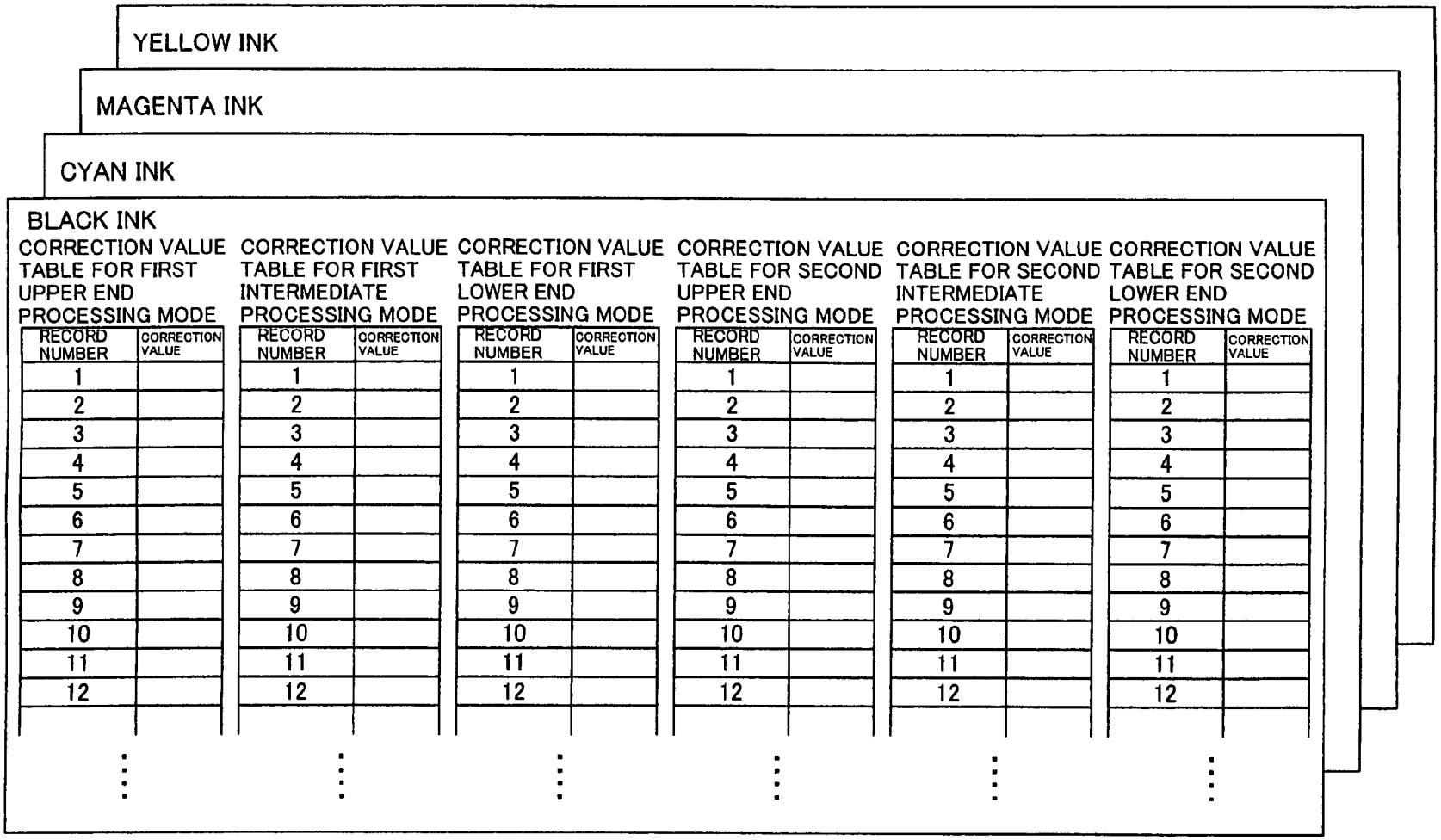
FIG. 32 is a conceptual diagram of the correction value storage section.

FIG. 32 is a conceptual diagram of the correction value storage section 63*a* provided in the memory 63 of the printer 1. As shown in the drawing, correction value tables are prepared in the correction value storage section 63*a*. Like the recording tables mentioned above, the correction value tables are provided separately for each color ink and processing mode. Consequently, correction values also are prepared for each ink color and each processing mode. This diagram shows the correction value tables for black (K) for the first upper end processing mode, the first intermediate processing mode, the first lower end processing mode, the second upper end processing mode, the second intermediate processing mode, and the second lower end processing mode, as representative correction value tables. These correction value tables each have records for recording a correction value. Each record is assigned a record number, and a correction value calculated based on the measurement values is recorded in the record having the same record number as the record for those measurement values. Further, the number of records that is provided is the number that can correspond to the overall width of the print region A. It should be noted that the procedure for storing correction values in the correction value storage section 63*a* is described in greater detail later.

Figure 33A:
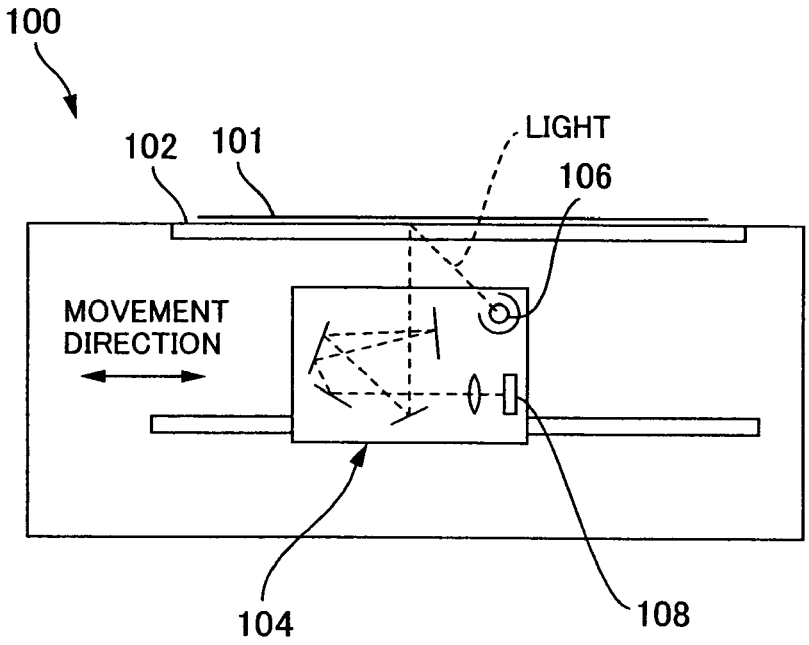
FIG. 33A is a vertical cross-section of the scanner device.
Figure 33B:
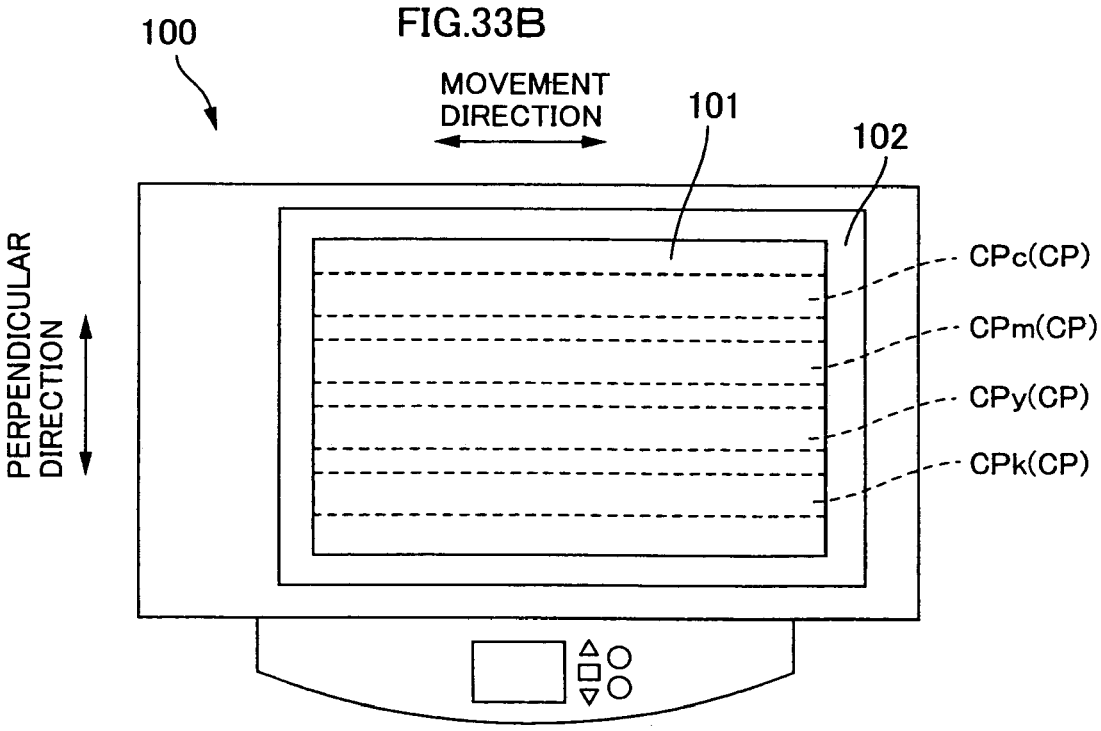
FIG. 33B is a plan view of that scanner device.

FIG. 33 is a diagram for describing the scanner device 100 that is communicably connected to the computer 1100A. That is, FIG. 33A is a vertical sectional view of the scanner device 100, and FIG. 33B is a plan view of the scanner device 100. The scanner device 100 is a type of darkness measuring device that optically measures the darkness of the correction patterns CP (see FIG. 35), which are described later. The scanner device 100 is capable of reading an image that has been printed on an original document 101 (for example, a paper S on which a correction pattern has been printed) as a data group in units of pixels, and is provided with an original document bed glass 102 on which the original document 101 is placed, a reading carriage 104 that moves in a predetermined movement direction in opposition to the original document 101 via the original document bed glass 102, and a controller (not shown) for controlling the various sections, such as the reading carriage 104. The reading carriage 104 is provided with an exposure lamp 106 that irradiates light onto the original document 101 and a linear sensor 108 for receiving the light that is reflected by the original document 101 over a predetermined range in a perpendicular direction that is perpendicular to the movement direction. Then, the scanner device 100 reads an image that has been printed on the original document 101 at a predetermined reading resolution by moving the reading carriage 104 in the movement direction while causing the exposure lamp 106 to emit light and receiving the light that is reflected with the linear sensor 108. It should be noted that the dashed line in FIG. 33A indicates the path of the light when image reading.

Figure 34:
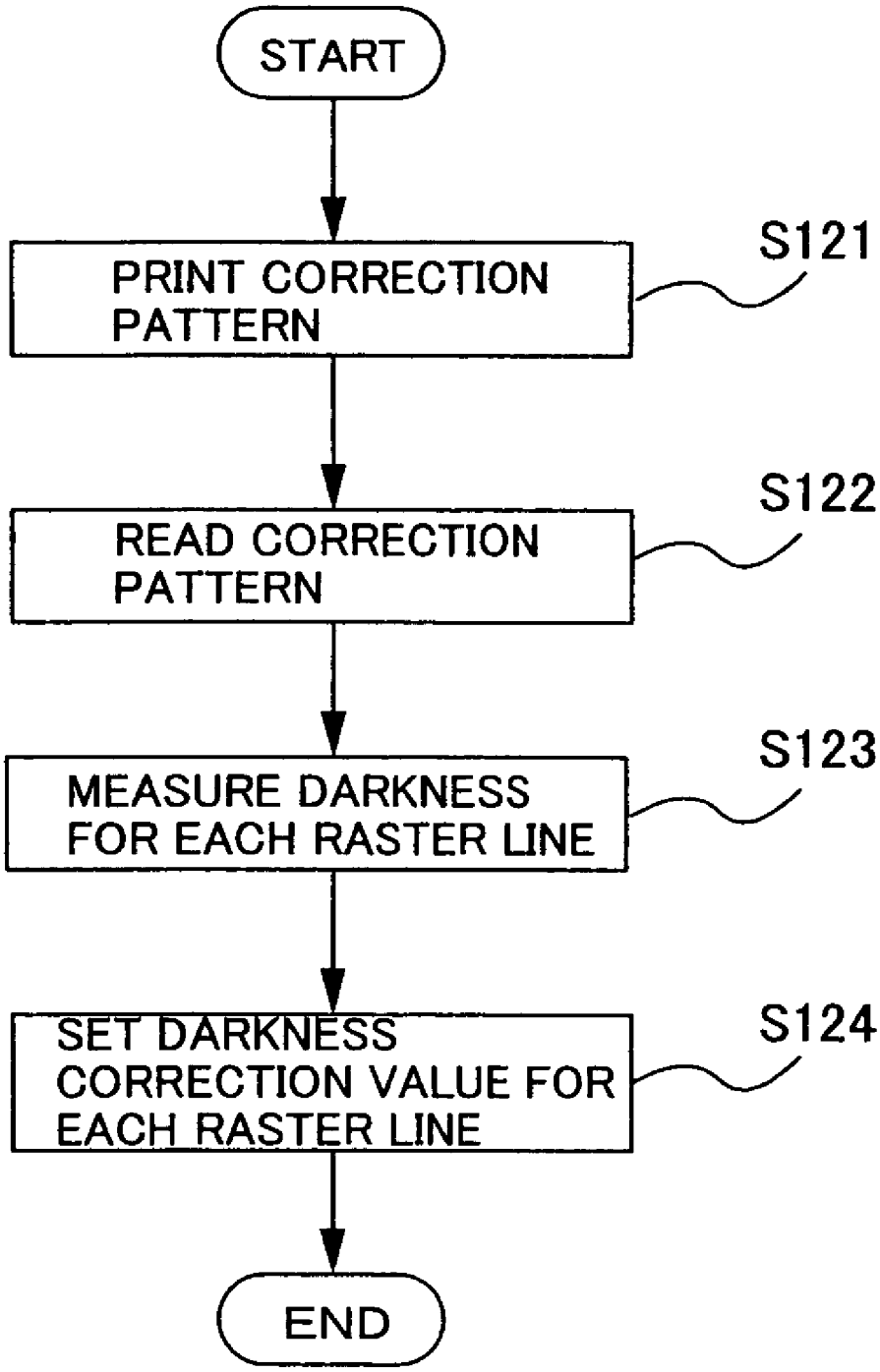
FIG. 34 is a flowchart showing the procedure of step S120 in FIG. 29.

FIG. 34 is a flowchart showing the procedure of step S120 in FIG. 29. The procedure for setting the correction values is described below using this flowchart.

This setting procedure includes a step of printing a correction pattern CP (S121), a step of reading the correction pattern CP (S122), a step of measuring the pixel darkness of each raster line (S123), and a step of setting a darkness correction value for each raster line (S124). These steps are described in detail below.

(1) Regarding Printing the Correction Pattern CP (S121)

First, in step S121, a correction pattern CP is printed on the paper S. Here, a worker on the inspection line communicably connects the printer 1 to a computer 1100A on the inspection line and prints a correction pattern CP using the printer 1. In other words, the worker gives out a command to print a correction pattern CP through a user interface of the computer 1100A. At that time, the print mode and the paper size mode are set through the user interface. Due to this command, the computer 1100A reads the image data of the correction pattern CP that is stored in the memory and performs the above-mentioned processes of resolution conversion, color conversion, halftone processing, and rasterization. The result of this processing is that print data for printing a correction pattern CP are output to the printer 1 from the computer 1100A. Then, the printer 1 prints the correction pattern CP on the paper S according to the print data. It should be noted that the printer 1 that prints the correction pattern CP is the printer 1 for which correction values are to be set. In other words, correction values are set on a printer-by-printer basis.

Figure 35:
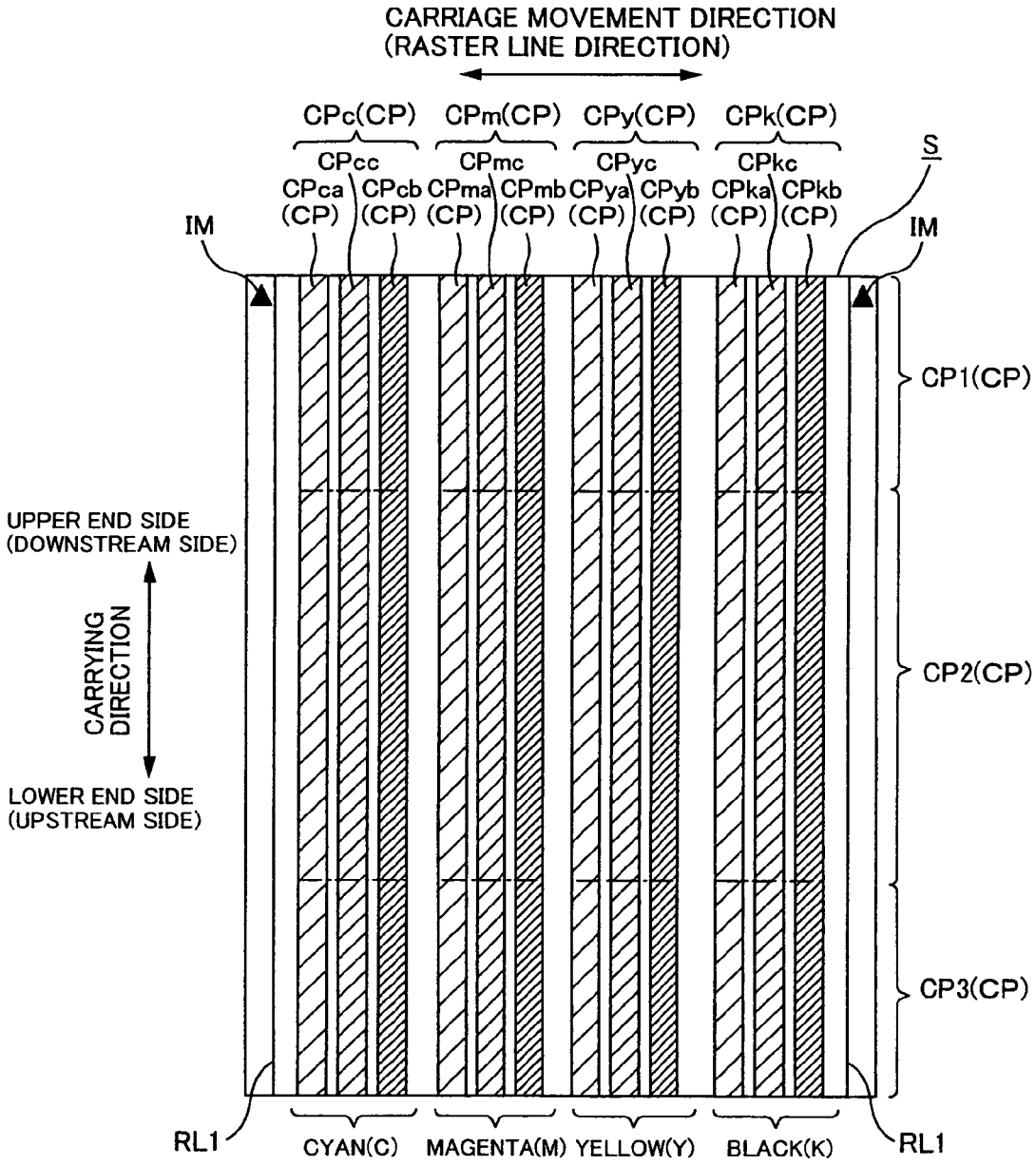
FIG. 35 is a diagram describing an example of the correction pattern that is printed.

Here, FIG. 35 is a diagram describing an example of the correction pattern CP that is printed. As shown in this drawing, the correction pattern CP of the present embodiment is printed in divisions of ink color, darkness, and processing mode. The print data of the correction pattern CP are data that have been created by performing halftone processing and rasterization with respect to CMYK image data made by directly specifying the gradation value of each of the ink colors CMYK. Then, the gradation values of the pixel data of the CMYK image data are set to the same value for all of the pixels of each band-shaped correction pattern CP formed for each ink color and darkness. Due to this, each correction pattern CP is printed at substantially the same darkness over the entire region in the carrying direction.

In principle, the only difference between the correction patterns CP is the ink color. For this reason, hereinafter the black (K) correction pattern CPk is described as a representative correction pattern CP. Further, as mentioned above, darkness nonuniformities in multicolor prints are inhibited for each ink color that is used in that multicolor print, but the method that is used for inhibiting the darkness nonuniformities is the same. For this reason, black (K) shall serve as an example in the following description. In other words, in the following description there are sections that only describe examples for the color black (K), but the same also applies for the other ink colors C, M, and Y as well.

The black (K) correction pattern CPk is printed in a band shape that is long in the carrying direction. The print region in the carrying direction extends over the entire region in the carrying direction of the paper S. In other words, it is formed contiguously from the upper end to the lower end of the paper S. Further, the correction pattern CPk is formed such that three band patterns are formed in rows, in the carriage movement direction, parallel to one another. The gradation values of these correction patterns CP can be set freely. However, from the standpoint of actively inhibiting darkness nonuniformities in regions in which darkness nonuniformities occur easily, a gradation value that results in a so-called halftone is selected in the present embodiment.

Further, these correction patterns CP have mutually different print darkness. That is, a plurality of types of correction patterns CP each with a different darkness have been prepared. In the present embodiment, there are a correction pattern CPkc that has been set to a gradation value at which darkness nonuniformities occur easily (for convenience, this is referred to as the "reference gradation value"), a correction pattern CPka that has been set to a gradation value that is lower than the reference gradation value (for convenience, this is referred to as the "low-darkness-side gradation value"), and a correction pattern CPkb that has been set to a gradation value that is higher than the reference gradation value (for convenience, this is referred to as the "high-darkness-side gradation value"). Here, the reference gradation value can be the gradation most suited for finding the correction value, and in a case where the gradation value has 256 tones and the ink color is black, it corresponds to a gradation value range from 77 to 128. Further, the gradation value on the low darkness side of the reference gradation value and the gradation value on the high darkness side of the reference gradation value are set such that their center value is the reference gradation value. For example, the low-darkness-side gradation value is set to a gradation value that is about 10% lower than the reference gradation value, and the high-darkness-side gradation value is set to a gradation value that is about 10% higher than the reference gradation value.

It should be noted that the reason for using a plurality of types of correction patterns CP having different darkness is described later.

The correction pattern CPk is printed for each processing mode, and in the example of the drawing, one of the correction patterns CP1, CP2, and CP3, which differ in processing modes, is printed in one of the three regions partitioned in the carrying direction. Here, it is preferable that the relationship dictating which correction pattern CP1, CP2, and CP3 is printed in which of these partitioned regions matches that relationship for actual printing. For example, taking the first upper end processing mode, the first intermediate processing mode, and the first lower end processing mode as examples, if the first processing mode is selected at the time of actual printing, then the upper end of the paper S is actually printed through the first upper end processing mode, the intermediate portion of the paper S is actually printed through the first intermediate processing mode, and the lower end of the paper S is actually printed through the first lower end processing mode. For this reason, in the correction pattern CPk, the correction pattern CP that is printed through the first upper end processing mode is printed to the region on the upper-end side of the paper S (hereinafter, this is referred to as the "first upper end correction pattern CP1). Likewise, the correction pattern CP that is printed through the first intermediate processing mode is printed to the region of the intermediate portion of the paper S (hereinafter this is referred to as the "first intermediate correction pattern CP2"), and the correction pattern CP that is printed through the lower end processing mode is printed to the region on the lower-end side of the paper S (hereinafter, referred to as the "first lower end correction pattern CP3").

By doing this, the carrying operations and the dot forming operations that are the same as those of the actual printing can be faithfully reproduced when printing the correction patterns CP1, CP2, and CP3. As a result, the accuracy of darkness correction using the correction values obtained based on these correction patterns CP1, CP2, and CP3 is increased, allowing darkness nonuniformities to be reliably inhibited.

The reason why a plurality of types of correction patterns CP each having a different darkness are used is described below.

First, the problems that arise when there is a single type of correction pattern CP having a single darkness for each color are described. When there is only a single type of correction pattern CP having a single darkness, then normally the raster lines that make up that correction pattern CP will have a target darkness that is the average value obtained by averaging the darkness. Then, the correction value is set such that the darkness of a target raster line becomes this target darkness.

For example, let us assume that a gradation value C is the measured darkness value of a target raster line, a gradation value M is the average value of the measured darkness values of the raster lines, and ΔC is the difference between the measured value (gradation value C) and the average value (gradation value M). In this case, a correction value H for the darkness of each raster line can be found through the Formula 1 below.

$$\text{correction value } H = \Delta C / M \qquad \text{(Formula 1)}$$
$$= (M - C) / M$$

Then, the pixel data of the image data are corrected using this correction value H, thereby correcting the darkness of the raster line. Here, a raster line whose correction value H is ΔC/M will have a darkness measurement value C that is changed by ΔC (=H×M) due to correction, and can be expected to be the target value (average value M). In order for it to change in this way, when reading the level data corresponding to the gradation value M of the pixel data from the dot creation ratio table (see FIG. 4), first the correction amount ΔC is calculated by multiplying the gradation value M by the correction value H (=ΔC/M). Next, the level data of the gradation value shifted from the gradation value M by the correction value ΔC is read. Then, the size of the dot that should be formed is determined based on this level data and the dither matrix (see FIG. 5). At this time, the size of the dot that is formed changes by the amount that the level data has changed by the difference ΔC, and thus the measurement value C of the darkness of the raster line is corrected.

However, just changing the gradation value M for reading the level data by the difference ΔC is no guarantee that the measurement value of the darkness of the raster line that is printed will be reliably changed by the difference ΔC and become the target value (gradation value M). That is, with the correction value H, the measurement value C can be brought closer to the target value M but it might not necessarily bring it close enough that they substantially match.

Consequently, with this method, one was forced to repeatedly perform printing of the correction pattern CP and measurement of its darkness while changing the correction value H until the most suitable correction value H is obtained, that is, until the measurement value (gradation value C) becomes the target value (average value M). Thus, this task required a large amount of work.

On the other hand, in this embodiment, three different correction patterns CP (such as CPka, CPkb, and CPkc), each having a different darkness due to changing the darkness command value, are printed, three information pairs each having a measurement value and a command value as a pair are obtained, and using these three information pairs that are obtained, the correction value H is obtained. For example, by performing primary interpolation using the three information pairs, a correction value H whose measurement value becomes the target value is obtained directly. By doing this, when obtaining the correction value H, it is not necessary to perform the above-described burdensome repeated task, allowing the correction value H to be obtained efficiently. It should be noted that the procedure for obtaining the correction value using the correction patterns CP is described in greater detail later.

Further, in the present embodiment, vertical reference ruled lines RL1 extending in the carrying direction (this corresponds to the "intersecting-side reference ruled line" in the claims) are formed together with the correction patterns CP. The vertical reference ruled lines RL1 are used for correcting image data obtained by reading with the scanner device 100. In the example of FIG. 35, two vertical reference ruled lines RL1 are formed. One of these is formed between the cyan correction pattern CPc and the left edge of the paper S (that is, in the left edge region of the paper S), parallel to the correction pattern CPc. The other one is formed between the black correction pattern CPk and the right edge of the paper S (that is, the right edge region of the paper S), parallel to the correction pattern CPk. The vertical reference ruled lines RL1 can be printed in ink of any color, but it is preferable that the ink is a color that has a high contrast with respect to the base color of the paper S. For example, if the base color of the paper S is white, then it is preferable that the vertical reference ruled lines RL1 are printed in black ink. This is because the higher the contrast with the base color, the more accurately the vertical reference ruled lines RL1 can be read by the scanner device 100. It should be noted that the method of using the vertical reference ruled lines RL1 is described along with the explanation of reading the correction patterns CP.

Additionally, in the present embodiment, index markers IM for recognizing the upper end of the paper S are printed in the corner portions of the paper upper end. The index markers IM are used when identifying the upper end and the lower end of an image, as regards the image data obtained by reading with the scanner device 100. In other words, the top and bottom of an image that has been read is determined by the computer 1100A based on these index markers IM when reading the darkness of the correction patterns CP. That is, the computer 1100A determines that the side on which the index markers IM are printed is the upper-end side, and that the side on which the index markers IM are not printed is the lower-end side. Thus, when reading the correction patterns CP, even if a worker on the inspection line mistakes the upper and lower sides of the correction pattern CP when placing the paper S on the original document bed, measurement can be performed without problem.

(2) Reading the Correction Patterns CP (Step S122)

Next, the correction patterns CP that have been printed are read by the scanner device 100. In step S122, first a worker on the inspection line places the paper S on which the correction patterns CP have been printed onto the original document bed. At this time, he/she places the paper S such that, as shown in FIG. 33B, the raster line direction of the correction patterns CP (CPc to CPk) and the perpendicular direction of the scanner device 100 (that is, the direction in which the linear sensor 108 is arranged) are the same direction. Once the paper S has been placed, the worker sets the reading conditions through the user interface of the computer 1100A and then gives out a command to initiate reading. Here, it is preferable that the reading resolution in the movement direction of the reading carriage 104 is several integer multiples narrower than the pitch of the raster lines. In this way, the measured values of the darkness that is read and the raster lines can be correlated easily, allowing the measurement accuracy to be increased. When the command to initiate reading is received, the controller (not shown) of the scanner device 100 controls the reading carriage 104, for example, to read the correction patterns CP that have been printed on the paper S and obtain data groups in units of pixels. The data groups that are obtained are transferred to the memory of the computer 1100A.

Figure 36:
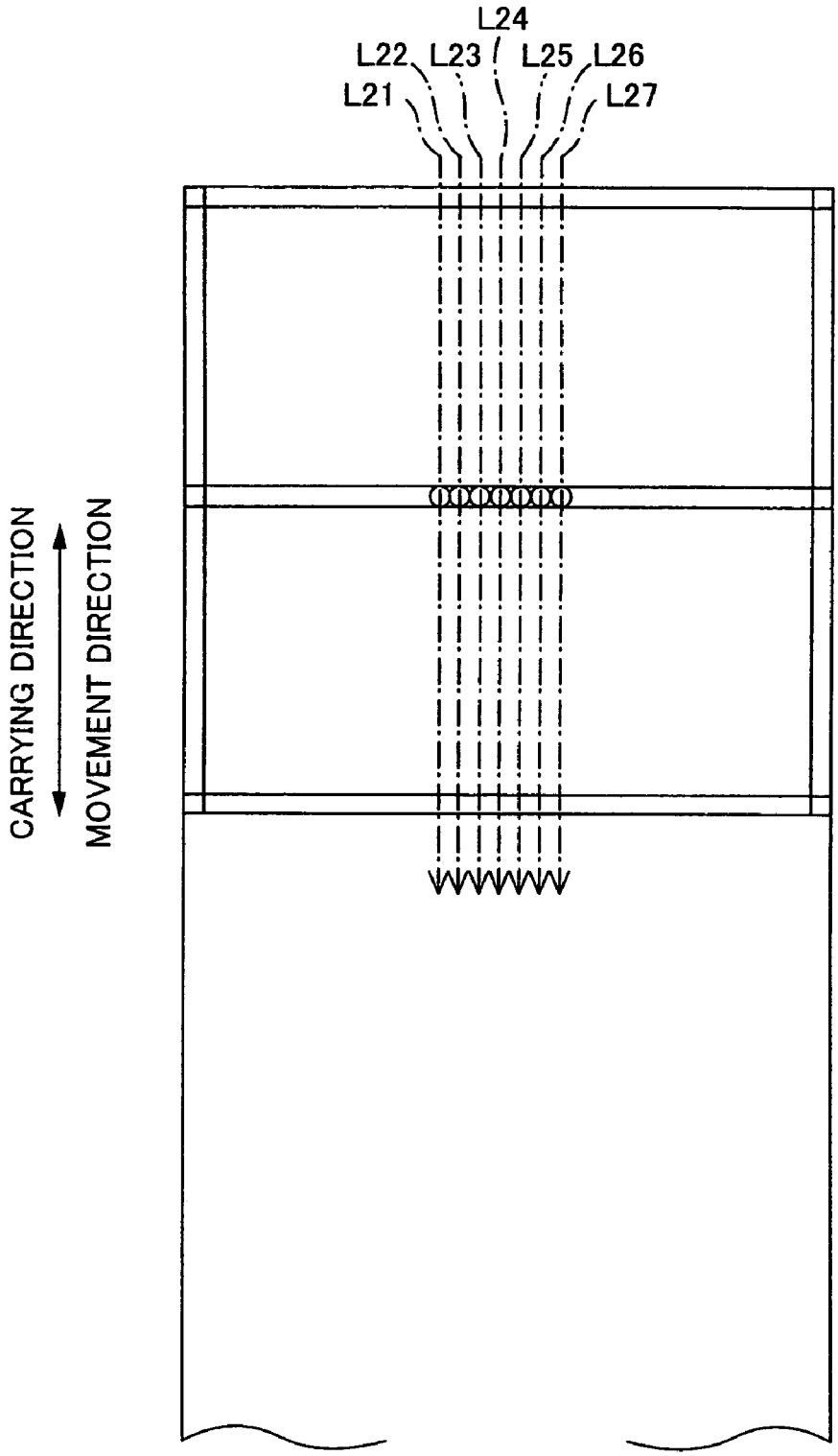
FIG. 36 is a diagram describing how the correction pattern is read by the line sensor.

Here, FIG. 36 is a diagram schematically explaining how the correction patterns CP are read by the linear sensor 108. Further, FIG. 37A is a diagram for schematically describing the positions where the dots are read by the light receiving elements provided in the linear sensor 108, FIG. 37B is a diagram for describing the detection signals (pulses) when reading is performed at the positions of FIG. 37A, and FIG. 37C is a diagram for describing the difference in pixel darkness that is recognized from the pulses of FIG. 37B.

When the paper S has been placed and the image is read, then, as shown in FIG. 36, the linear sensor 108 moved from the upper end to the lower end, or conversely, from the lower end to the upper end, of the paper S, and successively reads the darkness of the dots making up the correction patterns CP. At this time, the light-receiving elements of the linear sensor 108 move along the path shown by the dotted arrows in the drawing, that is, in a path along the carrying direction. In this case, the pitch at which adjacent light-receiving elements are arranged and the pitch at which the dots of the correction patterns CP are formed do not necessarily match. Thus, as shown in FIG. 37A, the positions of intersection between the path of movement of the light-receiving elements and the dots are not always the same. Due to this difference in intersection position, the detection times of the detection signals (pulses) become different.

Figure 37A:
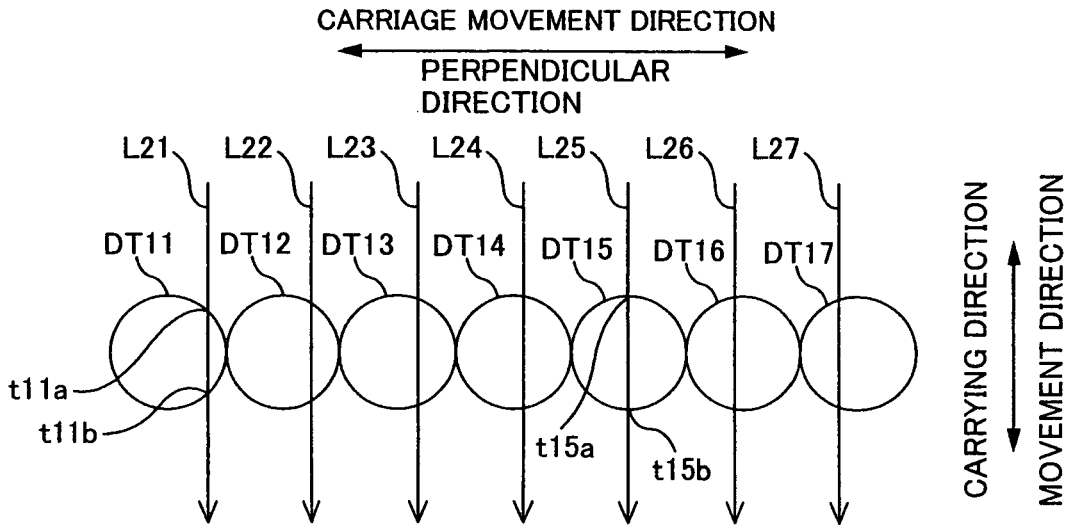
FIG. 37A is a diagram schematically describing the positions where the dots are read by the light-receiving elements provided in the line sensor.
Figure 37B:
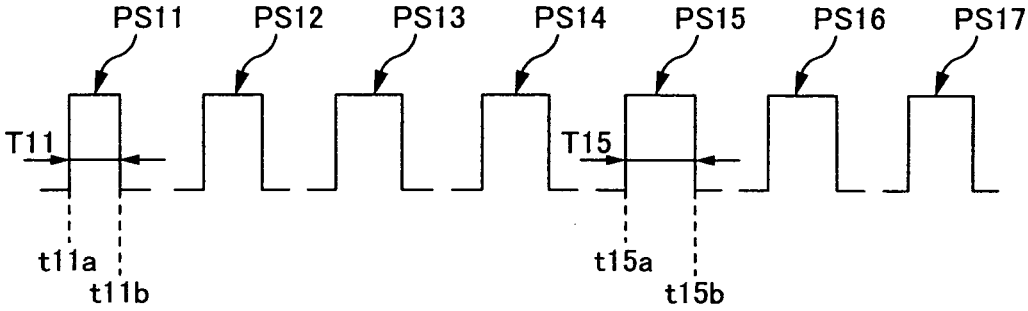
FIG. 37B is a diagram describing the detection signals in the case of reading at the positions of FIG. 37A.
Figure 37C:
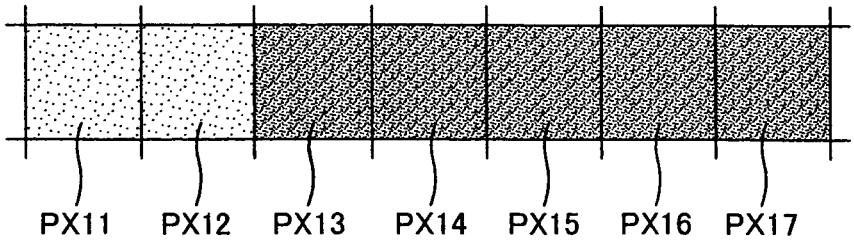
FIG. 37C is a diagram describing the difference in the recognized pixel darkness from the pulses of FIG. 37B.

For example, looking at the dot DT11 positioned on the left edge of FIG. 37A, the light-receiving element corresponding to this dot DT11 passes over the right side edge portion of the dot DT11 as is clear from the movement path L21. For this reason, that light-receiving element starts detection of the dot DT11 at a time t11*a* and ends detection at a time t11*b*. The time duration of the detection signal PS11 consequently becomes T11. On the other hand, looking at the dot DT15 fifth from the left, the light-receiving element corresponding to the dot DT15 passes over substantially the center between the left and right of the dot DT15, as is clear from the movement path L25. For this reason, that light-receiving element starts detection of the dot DT15 at a time t15*a* and ends detection at a time t15*b*. The time duration of the detection signal PS15 consequently becomes T15, and the time duration of the detection signal is largest when the dot DT15 is detected.

Comparing the time duration T15 of the detection signal DT15 and the time duration T11 of the detection signal DT11, the time duration T11 is approximately 70% of the time duration T15. In this case, as FIG. 37C schematically shows, the pixel PX11 to which the dot DT11 lands is determined to have a darkness that is 70% that of the pixel PX15 to which the dot DT15 lands, even though the dot DT11 and the dot DT15 are the same size. The same applies for the other dots DT12 to DT14, DT16, and DT17, and even though the dots are the same size the darkness of the pixels PX12 to PX14, PX16, and PX17 change depending on the position over which the corresponding light-receiving element passes.

Figure 38:
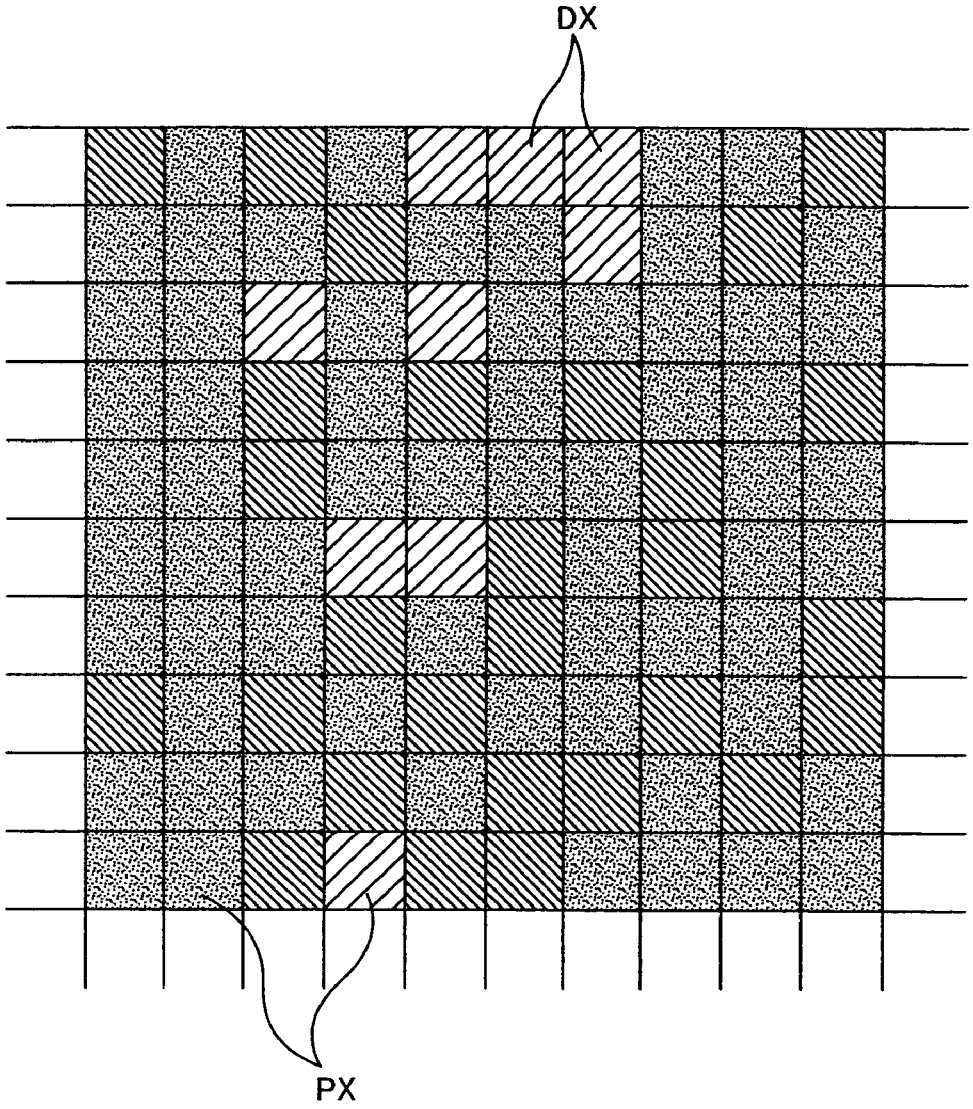
FIG. 38 is a diagram describing the darkness of the pixels read by the scanner device.

Consequently, discrepancies occur in the darkness of the pixels PX after reading by the scanner device 100 due to the position where the dots are read, as shown in FIG. 38. Further, the correction patterns CP in the present embodiment are printed in halftone as mentioned above. As can be understood from FIG. 4, with halftone there is a possibility that any one of a small dot, a medium dot, and a large dot will be formed in each pixel PX. From this standpoint there consequently is a possibility that discrepancies will occur in the darkness. From the above it is clear that it is difficult to sufficiently obtain the effect of correction if the darkness of one raster line is represented by a single pixel.

Accordingly, with the present embodiment, in the measurement of each raster line that is performed next, the darkness of a plurality of pixels located on the same raster line is measured and the correction value is obtained based on their darkness.

(3) Measuring the Darkness of the Correction Patterns CP (Step S123)

Figure 39:
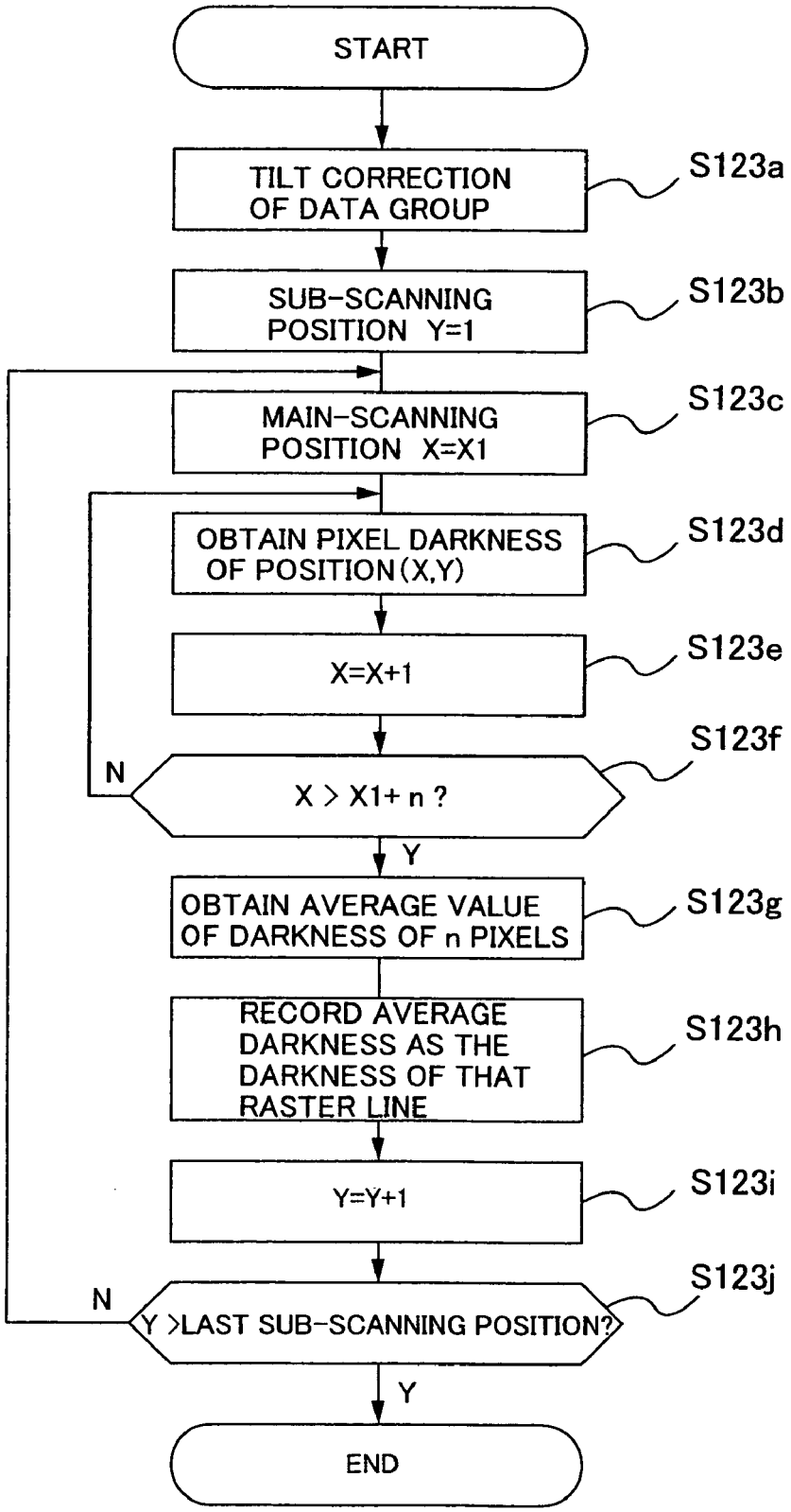
FIG. 39 is a flowchart showing the specific procedure of the step S123 in FIG. 34.

FIG. 39 is a flowchart showing in detail the procedure of the step S123 in FIG. 34.

The computer 1100A executes the procedure of the step S123 under the process correction program. Measurement of the darkness of the correction patterns CP is described below with reference to this flowchart.

Figure 40:
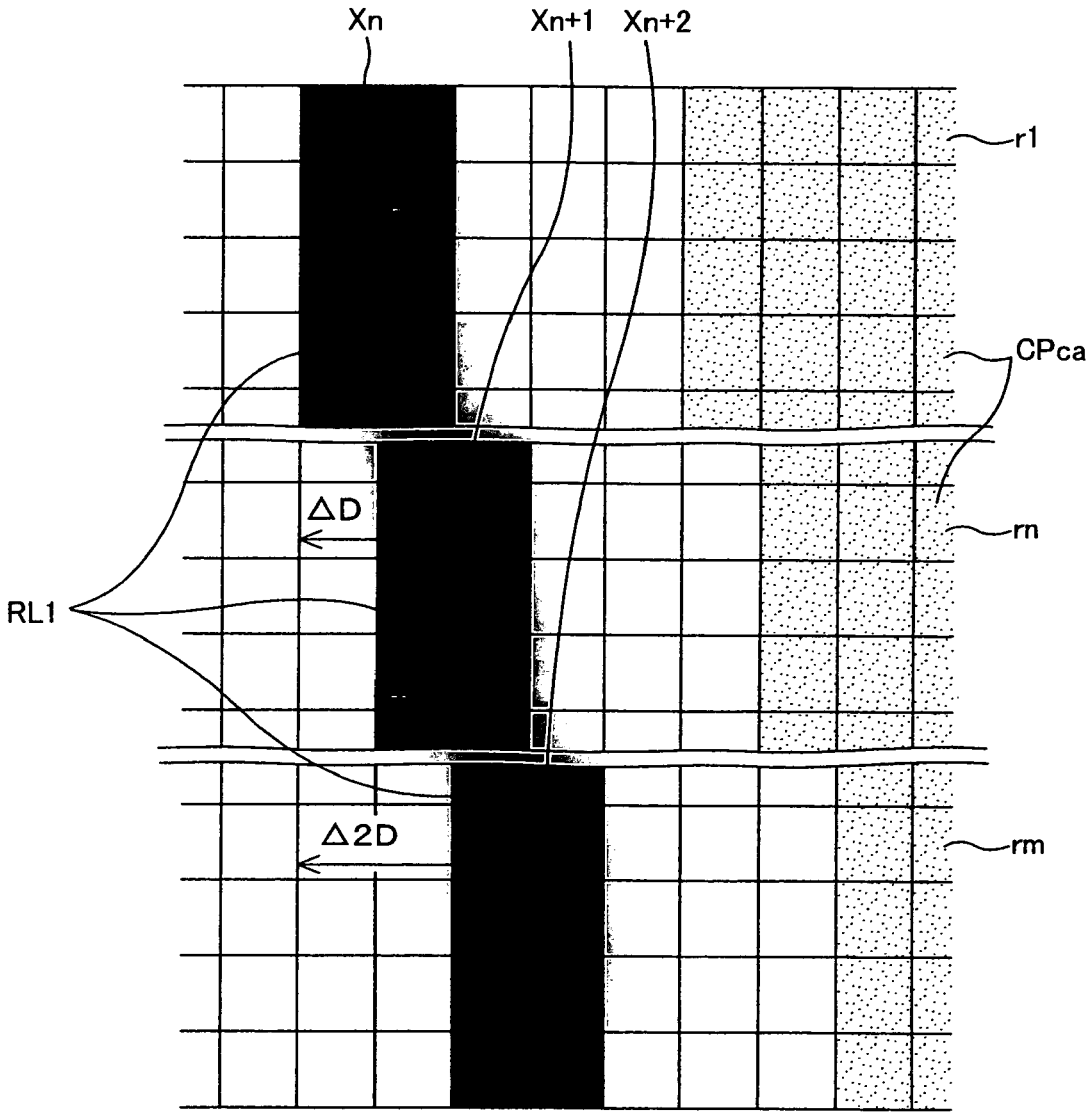
FIG. 40 is a diagram schematically describing the tilt correction that is performed in step S123*a;*

In step S123*a*, the computer 1100A first performs correction of the transferred data groups (hereinafter, also referred to as "tilt correction"). Here, FIG. 40 is a diagram schematically describing the tilt correction that is performed in this step. More specifically, the upper stage of this diagram shows the upper end section of the vertical reference ruled line RL1 printed on the upper end section of the paper S, the middle stage shows the intermediate portion of the vertical reference ruled line RL1 printed on an intermediate portion of the paper S, and the lower stage shows the lower end section of the vertical reference ruled line RL1 printed on the lower end section of the paper S. It should be noted that for convenience sake, the vertical reference ruled line RL1 in the drawing is drawn at a thickness of two pixels (see the solid black section in the drawing), and the intermediate positions in the scanning direction are the positions of the ruled line.

In tilt correction, the computer 1100A first sets the reference position of the vertical reference ruled line RL1. For example, the computer 1100A obtains the position of the upper end or the lower end, more specifically the position in the scanning direction along the carriage movement direction, and sets the position in the scanning direction that is obtained as the reference position. Next, the computer 1100A reads the position of the vertical reference ruled line RL1 at each raster line, comparing this against the reference position. If the position in the scanning direction of the raster line is deviated from the reference position, then the data of the pixels belonging to that raster line is shifted (moved) by that amount of deviation. As an example, a case in which the position Xn of the vertical reference ruled line RL1 at the first line r1 is regarded as the reference position is described below. In this case, if the position of the vertical reference ruled line RL1 at the n-th raster line is Xn+1, shifted to the right of Xn by one pixel, then the computer 1100A shifts the data of the pixels belonging to the raster line rn to the left by one pixel. Similarly, in the m-th raster line, the position of the vertical reference ruled line RL1 is Xn+2, shifted two pixels to the right of Xn, and thus the computer 1100A shifts the data of the pixels belonging to the raster line rm to the left by two pixels.

Then, once this correction has been performed for all of the raster lines making up the correction pattern CP, the procedure advances to step S123*b*.

By performing tilt correction, the shift from the correct position can be corrected, even if the correction pattern CP is read shifted off of the correct position. Then, because the pixel darkness is measured after this shifting has been corrected, the reliability of the correction values and the other correction values can be increased. Further, shifting in the pattern can be automatically corrected through the above image processing. Thus, the processing efficiency can also be improved.

It should be noted that in tilt correction, if the difference in the position in the scanning direction between the upper end section and the lower end section of the vertical reference ruled line RL1 is equal to or greater than a predetermined threshold value, then it is possible to suggest that the correction pattern CP is read again because an accurate measurement cannot be performed. In this case, the computer 1100A displays message urging re-reading through the user interface.

Next, the computer 1100A measures the darkness of a plurality of pixels located on the same raster line of the correction pattern CP. First, the computer 1100A obtains position information of a first raster line to be measured (S123*b*). In this embodiment, darkness is measured from the uppermost raster line, and thus a value "1" (Y=1) is obtained as the information on the sub-scanning position. Once the position information of the raster line has been obtained, the computer 1100A obtains position information indicating the main-scanning position of the pixel to be measured (S123*c*). Here, the position in the main-scanning direction differs depending on the correction pattern CP to be measured. Thus, in this step, X1 (X=X1) is obtained as the information on the main-scanning position.

It should be noted that as shown in FIG. 35, the correction patterns CP of this embodiment are band-shape that are long in the vertical direction, and as will be discussed later, the pixel to be measured is moved successively to the right. Thus, it is preferable that the position in the main-scanning direction is set to the position of the left edge of the correction patterns CP. Once the information Y on the sub-scanning position and the information X on the main-scanning position have been obtained, the darkness of the pixel specified by these positions is obtained (S123*d*). Once the darkness of this pixel has been obtained, the value of the X coordinate is increased by 1 (i.e., X=X+1) (S123*e*). That is, the pixel to be measured is reset to the pixel adjacent to its right in the main-scanning direction. Then, it is determined whether or not the new X coordinate that is obtained by adding 1 is greater than a threshold value (X1+n) (S123*f*). Here, if the X coordinate does not exceed the threshold value (X1+n), then the procedure is returned to step S123*d* and the darkness of the pixel specified by the new X coordinate is obtained.

It should be noted that the threshold value is defined as the number of pixels whose darkness is to be obtained (corresponds to n above). This pixel number can be set to any value, but preferably it is set to within a range from several tens to several hundreds of pixels, and more preferable it is set to within the range of 50 to 200. In the present embodiment, it has been set to 50. Thereafter, the procedure of the steps S123*d* to S123*f* is repeated, successively obtaining the darkness of the pixels.

If it is determined in step S123*f* that the X coordinate has exceeded the threshold value (X1+n), that is, if the darkness for the last pixel to be measured in that raster line has been measured, then the procedure is advanced to step S123*g*, and an average darkness value of the n pieces of pixels that have been measured is found. Once the average darkness value has been obtained, the procedure is advanced to step S123*h*, and the average darkness value that has been obtained is recorded in the corresponding record of the recording table as the darkness for that raster line. For example, if the average darkness value has been obtained for the first raster line in the sub-scanning direction, then that average darkness value is recorded in the first record. Once the average darkness value has been recorded, the above procedure is performed for the next raster line. That is, in step S123*i* the value of the Y coordinate is increased by 1 (i.e., Y=Y+1). In other words, the raster line to be measured is reset to a raster line that is positioned adjacent on the downstream side in the carrying direction. It is then determined whether or not the new Y coordinate that has been obtained by adding 1 exceeds the last sub-scanning position (S123*j*). Here, if the Y coordinate does not exceed the last sub-scanning position, then the procedure is returned to step S123*c* and the darkness of the raster line specified by the new Y coordinate is obtained (S123*c* to S123*h*). On the other hand, if the Y coordinate does exceed the last sub-scanning position, then darkness measurement for that correction pattern CP is ended, and darkness measurement for the next correction pattern CP is performed.

Figure 41A:
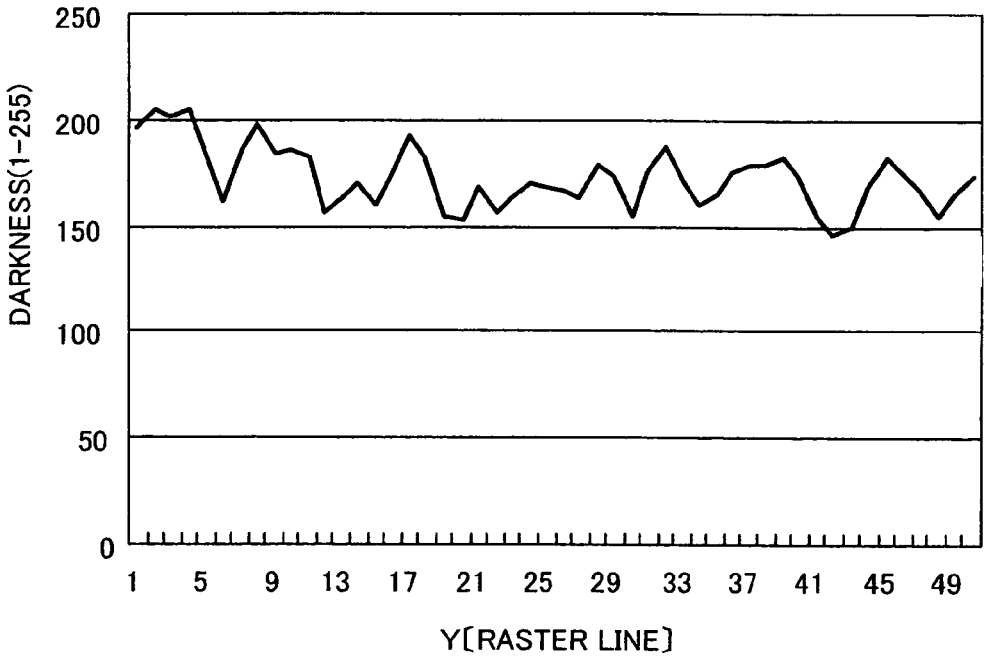
FIG. 41A is a diagram showing the results of measuring the darkness of specific pixels along a line parallel to the carrying direction and at the same position in the carriage movement direction.
Figure 41B:
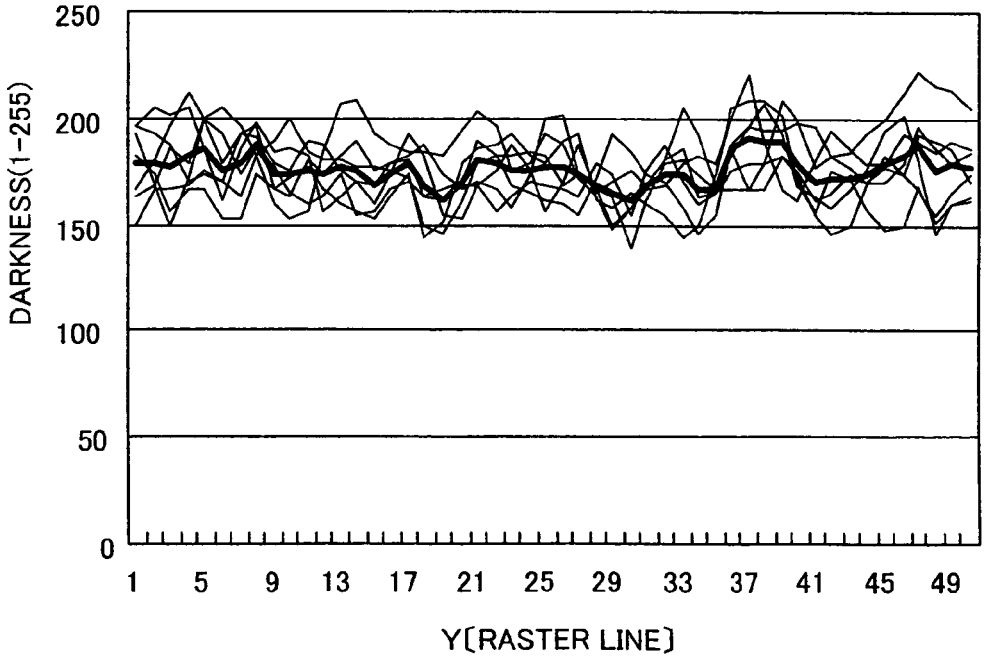
FIG. 41B is a diagram showing the measurement results obtained by changing the position of this line, and the average darkness that is obtained from these measurement results.

FIG. 41 shows an example of the measured darkness values of a correction pattern CP obtained in this manner. Here, FIG. 41A is a diagram showing the result of measuring the darkness of specific pixels at the same position in the carriage movement direction, along a line parallel to the carrying direction (hereinafter, also referred to as "virtual line"). Further, FIG. 41B shows the measurement results obtained by changing the position of the virtual line and the average darkness obtained from these measurement results. In these diagrams, the horizontal axis denotes the raster line number and the vertical axis denotes the measured darkness value. In FIG. 41B the thin lines show the measured darkness values for each virtual line, and the thick line shows the average darkness of the pixels belonging to the same raster line.

From these drawings, it is clear that the measured darkness fluctuates for each pixel, even for pixels that are on the same raster line. Consequently, by taking the average value of a plurality of pixels on the same raster line it is possible to obtain an accurate darkness for each raster line. It should be noted that with the procedure described above, the plurality of pixels whose darkness is measured are adjacent to one another. This is in consideration of the possibility that periodic darkness nonuniformities may occur in the carriage movement direction (the main-scanning direction). In other words, adopting this method allows reliable prevention of the problem of, in a case where darkness nonuniformities have periodically occurred in the carriage movement direction, selectively measuring only those spots where darkness nonuniformities have occurred. As a result, the reliability of the correction values and the other correction values can be increased.

(4) Setting the Darkness Correction Value for Each Raster Line (Step S124)

Next, the computer 1100A sets the correction value of the darkness for each raster line. Here, the computer 1100A calculates the correction values for the darkness based on the measured values that have been recorded in the records of the recording tables, and sets the correction values in the correction value storage section 63*a* of the printer 1 (see FIG. 32). As mentioned above, the correction value storage section 63*a* has records to which the correction values are recorded. Each record is assigned a record number, and the correction value that has been calculated based on the measured value is recorded to the record with the same record number as the record with that measured value. For example, the correction values that have been calculated based on the corresponding measured values of the recording table are recorded in the records of the correction value recording section allocated for the first upper end processing mode. Consequently, correction values corresponding to the upper-end-only region and the upper-end/intermediate mixed region are recorded in this correction value recording section.

Figure 42:
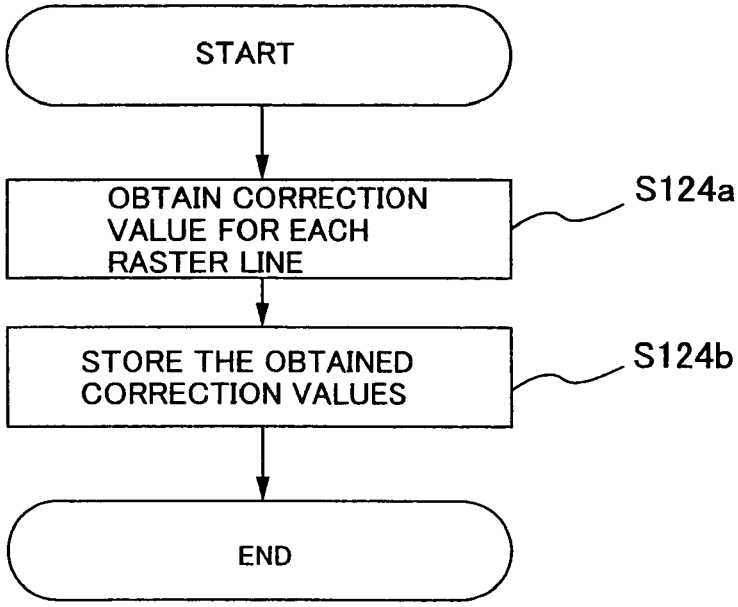
FIG. 42 is a flowchart showing the specific procedure of step S124 in FIG. 34.

These correction values are obtained in the format of a correction ratio indicating the ratio of correction with respect to the gradation value of the darkness. More specifically, this is performed following the flowchart of FIG. 42. First, the computer 1100A calculates the correction value H (S124*a*). Here, the correction value H is calculated by performing primary interpolation using the three information pairs (Sa, Ca), (Sb, Cb), and (Sc, Cc) of the pairing between the command values Sa, Sb, and Sc and the measurement values Ca, Cb, and Cc recorded in the records of the recording tables, and that correction value H is set in the correction value table. In this processing the correction value is obtained through primary interpolation, and thus the processing can be simplified, allowing the work efficiency to be increased. Further, in this processing, three information pairs are used, and thus the correction value H can be calculated with high accuracy. In other words, in general, the slope is different among straight lines used in primary interpolation in a range where the darkness is either higher or lower than the reference. Even in this case, with this method, the two information pairs (Sb, Cb) and (Sc, Cc) can be used to perform primary interpolation for the range in which the darkness is higher than the reference darkness, and the two information pairs (Sa, Ca) and (Sc, Cc) can be used to perform primary interpolation for the range in which the darkness is lower than the reference darkness. Thus, the correction value H can be calculated accurately even when the slope of the straight lines obtained used in primary interpolation is different.

Figure 43:
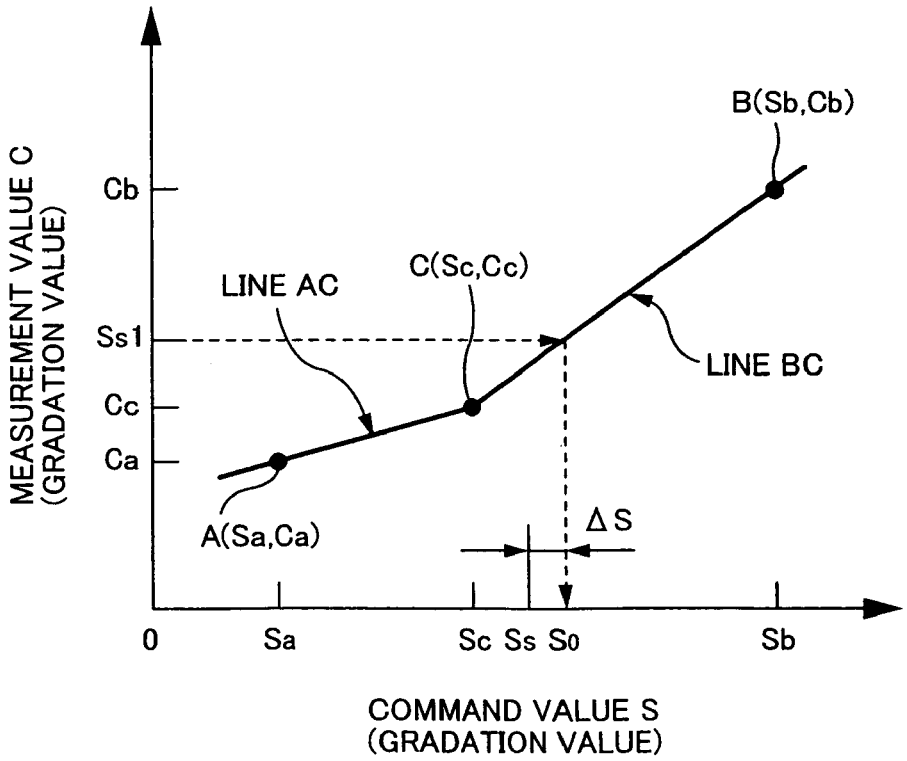
FIG. 43 is a graph for describing primary interpolation, which is performed using three information pairs.

FIG. 43 is a graph for describing primary interpolation performed using these three information pairs (Sa, Ca), (Sb, Cb), and (Sc, Cc). In FIG. 43, the horizontal axis of the graph is the gradation value of black (K) serving as the command value S, and the vertical axis is the gradation value of the grayscale serving as the measurement value C. The coordinates of the points on the graph are indicated by (S, C).

As shown in this diagram, the three information pairs (Sa, Ca), (Sb, Cb), and (Sc, Cc) are each expressed on the graph by point A having the coordinates (Sa, Ca), point B at (Sb, Cb), and point C at (Sc, Cc). The straight line BC connecting the points B and C shows the relationship between the change in command value S and the change in measurement value C in a range where the darkness is higher than the reference darkness. Further, the straight line AC connecting the points A and C shows the relationship between the change in command value S and the change in measurement value C in a range where the darkness is lower than the reference darkness.

Then, a value So of the command value S at which the measurement value C becomes the target value Ss1 is read from the graph made of these two lines AC and BC to determine the correction value H. For example, first the value So of the command value S at which the measurement value C is the target value Ss1 is read from these lines AC and BC. The value So is the command value S at which the measurement value C of the darkness is the target value Ss1. Here, even though normally (that is, if correction is unnecessary) the target value Ss1 should be obtained at the measurement value C if the command value S is set to the reference value Ss, the measurement value C does not become the target value Ss1 unless the command value S is set to So. It is clear from this that the deviation So-Ss between the value So and the value Ss will become the correction amount ΔS. It should be noted that the correction value H is given in the form of a correction ratio, and thus the value obtained by dividing the correction amount ΔS by the reference value Ss is calculated as the correction value (correction value H=ΔS/Ss).

Incidentally, the following is the correction value H when expressed as a formula.

First, the line AC on the lower darkness side can be expressed by Formula 2 below.

$$C=[(Ca-Cc)/Sa-Sc]]\cdot(S-Sa)+Ca \qquad \text{Formula 2}$$

If Formula 2 is solved for the command value S and the target value Ss1 is substituted for the measurement value C, then the command value So at which the measurement value C becomes the target value Ss1 can be expressed by Formula 3 below.

$$So=(Ss1-Ca)/[(Ca-Cc)/(Sa-Sc)]+Sa \qquad \text{Formula 3}$$

Similarly, the line BC on the higher darkness side can be expressed by Formula 4 below.

$$C=[(Cc-Cb)/Sc-Sb]]\cdot(S-Sc)+Cc \qquad \text{Formula 4}$$

If Formula 4 is solved for the command value S and the target value Ss1 is substituted for the measurement value C, then the command value So at which the measurement value C becomes the target value Ss1 can be expressed by Formula 5 below.

$$So=(Ss1-Cc)/[(Cc-Cb)/(Sc-Sb)]+Sc \qquad \text{Formula 5}$$

On the other hand, the correction amount ΔS of the command value S is expressed by Formula 6, and the correction value is expressed by Formula 7.

$$\Delta S=So-Ss \qquad \text{Formula 6}$$

$$H=\Delta S/Ss=(So-Ss)/Ss \qquad \text{Formula 7}$$

Consequently, Formulas 3, 5, and 7 are the formulas for finding the correction value H, and by substituting concrete values for Ca, Cb, Cc, Sa, Sb, Sc, Ss, and Ss1 in these formulas, it is possible to find the correction value H.

A program for executing the computations of these formulas is stored on a memory provided in the computer 1100A on the inspection line.

The correction value H that is obtained in this manner is stored in the correction value table shown in FIG. 32 (S124*b*). In other words, the computer 1100A reads the three information pairs (Sa, Ca), (Sb, Cb), and (Sc, Cc) from the same record of the recording table and substitutes these into Formula 3, Formula 5, and Formula 7 to calculate the correction value H, and then records the calculated correction value to the record of the same record number in the correction value table.

Thus, by using this correction value H to perform darkness correction, which is discussed later, discrepancies in the darkness between each raster line can be made small for each ink color and each processing mode, thus allowing darkness nonuniformities to be inhibited.

<Step S140: Actual Printing of the Image While Performing Darkness Correction for Each Raster Line>

The printer 1 in which the darkness correction values are set as above is shipped and operated by a user. In other words, the actual printing is performed by the user. In the actual printing, the printer driver 1110 and the printer 1 work in cooperation to perform darkness correction for each raster line and execute printing in which darkness nonuniformities are inhibited. Here, the printer driver 1110 references the correction values stored in the correction value table and corrects the pixel data such that it becomes the darkness corrected based on this correction value. That is, the printer driver 1110 changes the 2-bit pixel data in accordance with the correction value when converting the RGB image data into print data. It then outputs the print data based on the corrected image data to the printer 1. The printer 1 forms the dots of the corresponding raster line based on those print data. The print procedure is described in greater detail below.

Figure 44:
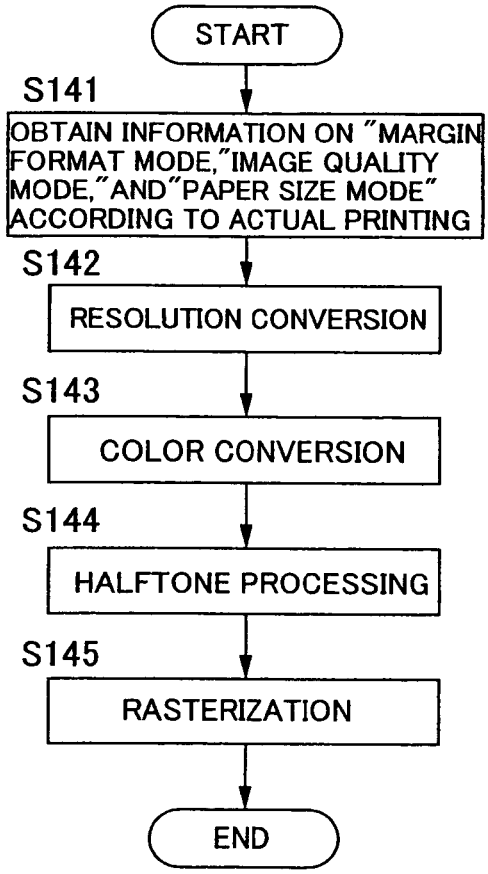
FIG. 44 is a flowchart showing the specific procedure of step S140 in FIG. 29.

(1) Regarding the Darkness Correction Procedure:

FIG. 44 is a flowchart showing the procedure for correcting the darkness of each raster line in step S140 of FIG. 29. Hereinafter, the darkness correction procedure is described with reference to this flowchart.

In this procedure, first the printer driver 1110 obtains information on the "margin format mode," "image quality mode," and "paper size mode" for the actual printing (step S141). Next the printer driver 1110 successively performs resolution conversion (step S142), color conversion (step S143), halftone processing (step S144), and rasterization (step S145).

Step S141: First, the user communicably connects the printer 1 that he/she has purchased to his/her computer 1100, establishing the printing system described in FIG. 1. The user then inputs the margin format mode, the image quality mode, and the paper size mode through the user interface screen of the printer driver 1110 in the computer 1100. Due to this input, the printer driver 1110 obtains information on these modes, for example. For example, "fine" is input as the image quality mode, "borderless" is input as the margin format mode, and "first size," that is, the paper size whose size in the carrying direction is 110•D, is input as the paper size mode.

Step S142: Next, the printer driver 1110 performs resolution conversion with respect to the RGB image data that have been output from the application program 1104. That is, it converts the resolution of the RGB image data to the print resolution corresponding to the image quality mode that has been input. The printer driver 1110 then suitably processes the RGB image data by trimming, for example, to adjust the number of pixels in the RGB image data so that it matches the number of dots in the print region A corresponding to the paper size and margin format mode that have been designated.

Step S143: Next, the printer driver 1110 executes color conversion to convert the RGB image data into CMYK image data. As mentioned above, the CMYK image data include C image data, M image data, Y image data, and K image data, and these C, M, Y, and K image data are each made of 121 rows of pixel data.

Step S144: Next, the printer driver 1110 performs halftone processing. Halftone processing is for converting the gradation values of 256 grades indicated by the pixel data in the C, M, Y, and K image data into gradation values of four grades. It should be noted that the pixel data of these four gradation values are 2-bit data indicating "no dot formation," "small dot formation," "medium dot formation," and "large dot formation." Then, in this embodiment, darkness correction is performed for each raster line during halftone processing. In other words, the processing for converting each pixel data of the image data from a gradation value of 256 grades to one of four grades is performed while correcting the pixel data by the amount of the correction value. Darkness correction is performed for each of the C, M, Y, and K image data based on the correction value table provided for each ink color, but here black (K) image data are described to represent these image data.

In halftone processing, the printer driver 1110 specifies the processing mode to be used and executes darkness correction at the correction value corresponding to that specified processing mode. Thus, the printer driver 1110 first references the first reference table (FIG. 19) using the margin format mode and the image quality mode as guides to obtain the corresponding print mode. The printer driver 1110 then references the second reference table (FIG. 20) using the print mode as a guide to specify the processing mode to be used during actual printing of the image. If a single processing mode is specified, then the correction value table for that processing mode is used to correct the pixel data rows in the K image data. On the other hand, if a plurality of processing modes have been specified, then the regions that are to be printed by each printing mode are specified in accordance with the paper size mode. Then, the correction value table for each processing mode is used to correct the image data rows corresponding to the regions to be printed by that processing mode.

It should be noted that the information on the regions that are printed by the processing modes is recorded in a region determination table. The region determination table is stored on the memory in the computer 1100, and the printer driver 1110 references this region determination table to specify the region that is printed by each processing mode.

For example, as shown in FIG. 21A, the upper-end-only region and the upper-end/intermediate mixed region that are printed by the first upper end processing mode are formed in a fixed number of eight passes as discussed above, and thus it is known in advance that the region will have 40 raster lines from the uppermost end of the print region A toward the lower-end side. Consequently, "region from uppermost end of print region A to the $40^{th}$ raster line" is recorded in the region determination table to correspond to the first upper end processing mode. Similarly, as shown in FIG. 21B, the intermediate/lower-end mixed region and the lower-end-only region printed through the first lower end processing mode are formed in a fixed number of eight passes as discussed above, and thus it is known in advance that the region will have 36 raster lines from the lowermost end of the print region A toward the upper-end side. Consequently, "region from lowermost end of print region A to the $36^{th}$ raster line toward the upper-end side thereof" is recorded in the region determination table to correspond to the first lower end processing mode.

Further, as shown in FIG. 21A and FIG. 21B, the intermediate-only region that is printed through the first intermediate processing mode only is the region that continues toward the lower-end side from the region that is printed by the first upper end processing mode, and is also the region that continues toward the upper-end side from the region that is printed by the first lower end processing mode. Thus, the intermediate-only region is known in advance to be the region that is sandwiched by the $41^{st}$ raster line toward the lower end from the uppermost end of the print region A and the $37^{th}$ raster line toward the upper end from the lowermost end of the print region A. Consequently, "region sandwiched by the $41^{st}$ raster line toward the lower end from the uppermost end of the print region A and the $37^{th}$ raster line toward the upper end from the lowermost end of A" is recorded in the region determination table to correspond to the first intermediate processing mode.

In this example, the modes are "borderless" and "fine," and thus the printer driver 1110 references the first and second reference tables shown in FIG. 19 and FIG. 20 and specifies "first print mode" as the print mode, and thus the three corresponding processing modes of first upper end processing mode, first intermediate processing mode, and first lower end processing mode are specified as the processing modes for the actual printing. Further, because the paper size mode is "first size" the print region A in the actual printing is 121•D in the carrying direction, and as discussed above, because there are three processing modes, the regions that are printed by the respective processing modes are specified with reference to the region determination table, and the pixel data rows corresponding to the respective regions are corrected.

For example, the upper-end-only region and the upper-end/intermediate mixed region that are printed through the first upper end processing mode are specified from the region determination table as the region from r1 to r40 in the print region of r1 to r121. The data of the raster lines of the region r1 to r40 are the pixel data rows from the first row to the $40^{th}$ row of the K image data. On the other hand, the correction values corresponding to the upper-end-only region and the upper-end/intermediate mixed region are recorded in the first through $40^{th}$ records in the correction value table for the upper end processing mode. Consequently, the correction values of the first through $40^{th}$ records of the correction value table for the first upper end processing mode are successively correlated to the first through $40^{th}$ pixel data rows while the pixel data making up each pixel data row are corrected. Similarly, the intermediate/lower-end mixed region and the lower-end-only region that are printed through the first lower end processing mode are specified as the region from r86 to r121 in the print region of r1 to r121 based on the region determination table. The data of the raster lines of the region r86 to r121 are the pixel data rows from the $86^{th}$ row to the $121^{st}$ row of the K image data. On the other hand, the correction values corresponding to the intermediate/lower-end mixed region and the lower-end-only region are recorded in the first through $36^{th}$ records of the correction value table for the first lower end processing mode. Consequently, the correction values of the first through $36^{th}$ records of the correction value table for the first lower end processing mode are successively correlated to the first through $36^{th}$ pixel data rows while the pixel data making up each pixel data row are corrected.

The intermediate-only region, which is printed through the first intermediate processing mode only, is specified as the region from r41 to r85 of the print region r1 to r121 based on the region determination table. The data of the raster lines of the region r41 to r85 are the pixel data rows of the $41^{st}$ to $85^{th}$ rows in the K image data. On the other hand, the correction values corresponding to the intermediate-only region are recorded in the first through $45^{th}$ records of the correction value table for the first intermediate processing node. Consequently, the correction values of the first through $45^{th}$ records of the correction value table for the first intermediate processing mode are successively correlated to the $41^{st}$ through $85^{th}$ pixel data rows while the pixel data making up each pixel data row are corrected.

It should be noted that, as mentioned above, the number of passes of the first intermediate processing mode is not fixed like in the first upper end processing mode etc., and rather changes depending on the paper size mode that has been input. Thus, the number of pixel data rows in the intermediate-only region changes depending on the paper size mode.

Here, the correction value table for the first intermediate processing mode includes correction values for only the fixed number of 45 records from the first record through the $45^{th}$ record, giving rise to a possibility that the number of correction values will run out in the latter half when correlating them to a pixel data row. This is dealt with by utilizing the periodicity of the combination of nozzles forming adjacent raster lines. In other words, as shown in the right diagrams of FIG. 21A and FIG. 21B, the order of the nozzles forming the raster lines in the intermediate-only region r41 to r85, which is printed by only the first intermediate processing mode, in a single cycle is #2, #4, #6, #1, #3, #5, and #7, and this cycle is repeated. This cycle is increased by one cycle each time the pass number of the first intermediate processing mode increases by one. Consequently, it is possible to use the correction values of this one cycle for the row numbers for which there is not a corresponding correction value That is, the correction values from the first record to the seventh records, for example, corresponding to this cycle can be used repeatedly for the rows for which the correction values have run out.

Step S145: Next, the printer driver 1110 executes rasterization. The rasterized print data are output to the printer 1, and the printer 1 executes actual printing of the image to the paper S according to the pixel data of the print data. It should be noted that as discussed above, the darkness of the pixel data has been corrected for each raster line, and thus darkness nonuniformities can be effectively inhibited in the image that is printed.

(2) Regarding the Method for Correcting the Pixel Data Based on the Correction Values Next, the method for correcting the pixel data based on the correction values is described in detail. As mentioned above, pixel data having gradation values of 256 grades are converted into pixel data having gradation values of four grades indicating "no dot formation," "small dot formation," "medium dot formation," and "large dot formation" through halftone processing. During this conversion, the 256 gradations are first substituted with level data and then converted into four gradations. Accordingly, in the present embodiment, at the time of this conversion the level data are changed by the amount of the correction value so as to correct the pixel data of gradation values having four grades, thus performing "correction of pixel data based on the correction value."

It should be noted that the halftone processing here differs from the halftone processing that has already been described using FIG. 3 in that it includes steps S301, S303, and S305 for setting the level data, and otherwise the two are identical. Consequently, the following description focuses on this difference, and aspects that are the same have been summarized.

Further, the following description is made using the flowchart of FIG. 3 and the dot creation ratio table of FIG. 4.

First, the printer driver 1110 obtains the K image data in step S300 like in ordinary halftone processing. It should be noted that at this time the C, M, and Y image data also are obtained, but because the following description can be applied to any of the C, M, and Y image data as well, the description is made with the K image data representing these image data.

Next, in step S301, the printer driver 1110 reads, for each pixel data, the level data LVL corresponding to the gradation value of that pixel data from the large dot profile LD of the creation ratio table. However, in the present embodiment, when the level data LVL are read, the gradation value is shifted by the correction value H corresponding to the pixel data row to which the pixel data belong.

For example, if the gradation value of the pixel data is gr and the pixel data row to which that pixel data belongs is the first row, then that pixel data row is correlated to the correction value H of the first record in the recording table for the first upper end processing. Consequently, the level data LVL is read shifting the gradation value gr by a value Δgr (=gr×H) that is obtained by multiplying the correction value H by the gradation value gr, obtaining a level data LVL of 11d.

In step S302, the printer driver 1110 determines whether or not the level data LVL of this large dot is greater than the threshold value THL of the pixel block corresponding to that pixel data on the dither matrix. Note that the level data LVL has been changed by the value Δgr based on the correction value H. Consequently, the result of this determination changes by the amount of change, and thus the tendency of a large dot being formed also changes. As a result, the "correction of pixel data based on the correction value" mentioned above is achieved. It should be noted that if in step S302 the level data LVL is larger than the threshold value THL, then the procedure is advanced to step S310 and a large dot is recorded corresponding to that pixel data. Otherwise the procedure is advanced to step S303.

In step S303, the printer driver 1110 reads the level data LVM corresponding to the gradation value from the medium dot profile MD of the creation ratio table, and at this time, as in step S301, the level data LVM is read shifting the gradation value by the amount of the correction value (for example, by the value Δgr (=gr×H)). Doing this, a level data LVM of 12d is obtained.

Next, in step S304 the printer driver 1110 determines whether or not the level data LVM of this medium dot is greater than the threshold value THM of the pixel block corresponding to that pixel data on the dither matrix. Here also, the level data LVM has been changed by the value Δgr based on the correction value H. Consequently, the result of this size determination is changed by that amount of change, and thus the tendency of a medium dot being formed also changes, thus achieving the "correction of pixel data based on the correction value" mentioned above. It should be noted that if in step S304 the level data LVM is larger than the threshold value THM, then the procedure is advanced to step S309 and a medium dot is recorded corresponding to that pixel data. Otherwise the procedure is advanced to step S305.

In step S305 the printer driver 1110 reads the level data LVS corresponding to the gradation value from the small dot profile SD of the creation ratio table, and like in step S301, at this time it reads the level data LVS shifting the gradation value by the amount of the correction value (for example, by the value Δgr (=gr×H)). Doing this, a level data LVS of 13d is obtained.

Then, in step S306 the printer driver 1110 determines whether or not the level data LVS of this small dot is larger than the threshold value THS of the pixel block corresponding to that pixel data on the dither matrix. Here as well, the level data LVS has been changed by the value Δgr based on the correction value H. Consequently, the result of this size determination changes by this amount of change, and thus the tendency of a small dot being formed also changes, thus achieving the "correction of pixel data based on the correction value" mentioned above.

It should be noted that if in step S306 the level data LVS is larger than the threshold value THS, then the procedure is advanced to step S308, and a small dot is recorded corresponding to that pixel data. Otherwise the procedure is advanced to step S307 and no dot is recorded corresponding to that pixel data.

<Regarding the Combination With the Other Correction Value for Correcting the Darkness in the Carriage Movement Direction>

Next, an embodiment in which darkness correction is performed combining an other correction value H2 for correcting the darkness in the carriage movement direction and the above-described correction values H for each raster line. As mentioned above, darkness nonuniformities in the carriage movement direction (see FIG. 25B) occur due to mechanical causes such as vibration of the carriage 31. Such darkness nonuniformities in the carriage movement direction that are repeatable can be corrected by adopting the above correction method. In other words, darkness nonuniformities in the carriage movement direction also can be corrected by obtaining, from the darkness of a plurality of pixels lined up at the same position in the carriage direction, an other correction value H2 for that position and setting the other correction values H2 in correspondence with the pixels lined up in the carriage movement direction.

With this method, the printer driver 1110, when obtaining print data, corrects the darkness of a target pixel using both the correction value H and the other correction value H2. Then, the printer 1 forms the dots of the corresponding lines in the dot forming operations such that their darkness becomes the darkness corrected based on the correction value H and the other correction value H2.

As a result, darkness nonuniformities in the carriage movement direction also can be inhibited, allowing darkness nonuniformities in the image to be effectively inhibited.

<Regarding the Other Correction Values>

Figure 45:
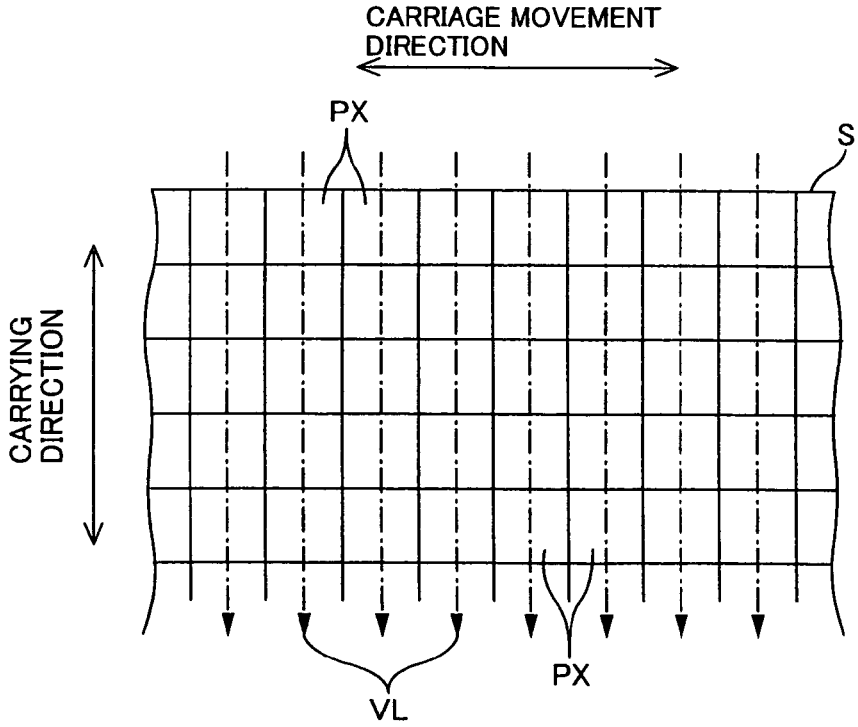
FIG. 45 is a diagram that schematically shows the pixels that are formed on the paper.

FIG. 45 is a diagram that for schematically illustrating the pixels PX formed on the paper S, and the other correction values H2 will be described with reference to this diagram. In this diagram, the left-right direction is the carriage movement direction and the up-down direction is the carrying direction of the paper S. Further, this diagram shows a magnification of a portion of the paper S, and each grid square in lattice on the paper S indicates a single pixel PX.

The other correction values H2 mentioned above are set for each pixel PX lined up in the carriage movement direction (main-scanning direction). Using the virtual lines VL shown by the dashed lines (straight lines in the carrying direction, set for each pixel) in the drawing to describe the other correction values H2, the other correction values H2 are set in units of pixels lined up in the main-scanning direction, and each correction value can be regarded as a correction value that can be used in common for a plurality of pixels PX on the same virtual line VL.

The method for printing an image using the other correction values H2 is the same as the method for printing an image using the correction values H. That is, as described in the flowchart of FIG. 29, first the printer 1 is assembled on the manufacturing line (S110), then the correction values H and the other correction values H2 are set to the printer 1 (S120). Next, the printer 1 is shipped (S130), and then the user during actual printing prints an image on the paper S while performing darkness correction (S140).

Here, the difference between this embodiment and the embodiment discussed above is primarily in the process for setting the correction values (step S120) and the actual printing of the image (step S140). In other words, in the processing for setting the correction values of this embodiment, a correction value H is set for each raster line and an other correction value H2 is set for each dot in the main-scanning direction. Further, during actual printing of the image, the dot creation ratio is changed using both the correction value H and the other correction value H2. Consequently, the step S120 and the step S140 are described below.

<Step S120: Setting the Darkness Correction Values to Inhibit Darkness Nonuniformities>

In this embodiment, the equipments that are used for setting the correction values H and the other correction values H2 is the same as the equipments described in FIG. 30. Thus, only the differences are described below, and common sections are assigned common reference numerals and description thereof is omitted.

FIG. 46 is a conceptual diagram of a recording table for obtaining the other correction values H2 (for convenience, it is referred to as "other recording table"). It should be noted that also in this embodiment, the computer 1100A is provided with the recording table shown in FIG. 31 (the recording table described above for recording measurement values and command values). Again, the other recording tables also are provided in the memory of the computer 1100A. The other recording tables are prepared for each ink color. Here, the reason why a recording table is not provided for each processing mode is because darkness nonuniformities in the carriage movement direction occur for reasons unrelated to the processing mode, such as due to vibration of the carriage 31. Further, the measurement values of the correction patterns CP printed in each division are recorded in the corresponding recording table. It should be noted that this diagram shows the recording table for black (K) as a representative recording table.

The measurement values Ca, Cb, and Cc for the three correction patterns CPka, CPkb, and CPkc, which each have different darkness, and command values Sa, Sb, and Sc corresponding to those measurement values are recorded in the other recording tables. Thus, six fields are prepared in each recording table. In the records of the first field and the fourth field from the left of the table are recorded the measurement value Ca, and its command value Sa, for the correction pattern CPka, which has the lightest darkness. Further, in the records of the third field and the sixth field from the left are recorded the measurement value Cb, and its command value Sb, for the correction pattern CPkb, which has the darkest darkness. Likewise, in the records of the second field and the fifth field from the left are recorded the measurement value Cc, and its command value Sc, for the correction pattern CPkc, which has an intermediate darkness.

A record number is assigned to each record, and in the small number records, the measurement values of the small number main-scanning positions in the corresponding correction patterns CP are successively recorded. It should be noted that the numbers of the main-scanning positions can be assigned from the left side or the right side of the paper S, but for convenience sake, in this embodiment the left edge of the paper S is given the smallest number and the right edge of the paper S is given the largest number. The number of records that are provided is the number that can correspond to the overall width of the print region A (length in the carrying direction). For the three correction patterns CPka, CPkb, and CPkc, the measurement values Ca, Cb, and Cc and the command values Sa, Sb, and Sc of the same main-scanning position are all recorded in a record with the same record number.

FIG. 47 is a conceptual diagram of the correction value storage section 63*a* provided in the memory 63 of the printer 1, and shows a correction value table for storing the other correction values H2 (for convenience, it is referred to as the "other correction value table"). It should be noted that, although omitted from the figure, the printer 1 is also provided with the correction value tables shown in FIG. 32 in addition to the other correction value tables.

As shown in the drawing, the other correction value tables, like the other recording tables mentioned above, are provided for each ink color. This diagram shows the other correction value table for black (K) as a representative table. The other correction value tables, as well, have records for recording a correction value. Each record is assigned a record number, and a correction value calculated based on the measurement values is recorded in the record having the same record number as the record for those measurement values. Consequently, the number of records that are provided is the number that can correspond to the overall width of the print region A.

Figure 48:
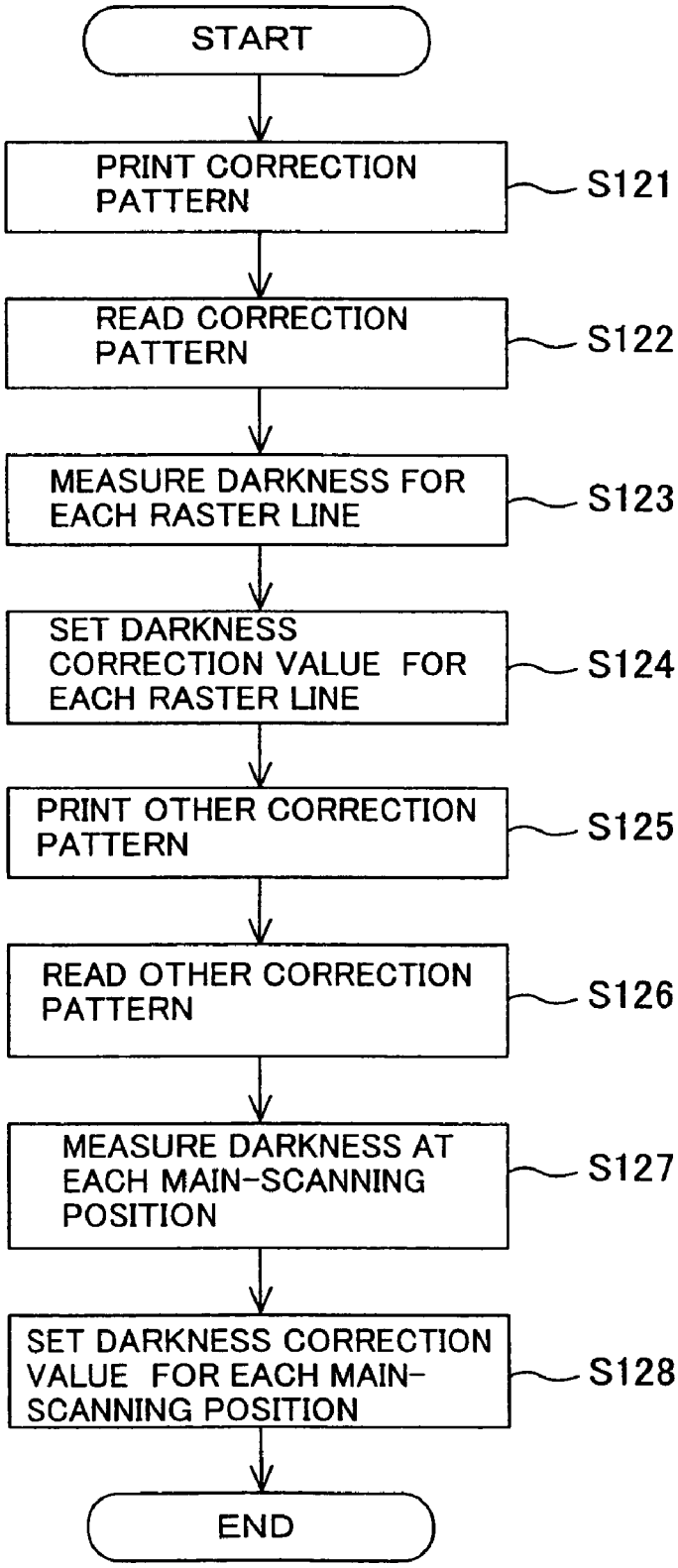
FIG. 48 is a flowchart showing the specific procedure of step S120 in FIG. 29.

FIG. 48 is a flowchart showing the specifics of the procedure of step S120 in FIG. 29 (that is, the procedure for setting the correction value H and the other correction value H2).

As shown in this flowchart, the setting procedure illustrated here includes a step of printing a correction pattern CP (S121), a step of reading the correction pattern CP (S122), a step of obtaining the pixel darkness of the each raster line (S123), a step of setting a darkness correction value for each raster line (S124), a step of printing an other correction pattern CP (S125), a step of reading the other correction pattern CP (S126), a step of measuring the pixel darkness at each main-scanning position (S127), and a step of setting a darkness correction value for each main-scanning position (S128).

These steps are described in detail below. Here, the procedure (1) of printing the correction pattern CP (S121) through the procedure (4) of setting the darkness correction value (S124) are the same as those in the embodiment discussed above. Thus, description of these processes is omitted, and the following description starts from the procedure (5) of printing the other correction pattern CP (S125).

(5) Regarding Printing the Other Correction Pattern CP (S125)

In step S125 an other correction pattern CP is printed on the paper S. Here, a worker on the inspection line gives out a command to print the other correction pattern CP through a user interface of the computer 1100. At that time, the print mode and the paper size mode are set through the user interface. Due to this command, the computer 1100 reads the image data of the other correction pattern CP stored on the memory and performs the above-mentioned processes of resolution conversion, color conversion, halftone processing, and rasterization. Then, when performing halftone processing, the correction values H set in step S124 are used to correct the darkness of the raster lines.

When rasterization is performed, the computer 1100 outputs print data for printing the other correction pattern CP to the printer 1. The printer 1 prints the other correction pattern CP on the paper S based on the print data. At the time of this printing, a raster line is formed in the dot formation process such that the darkness becomes the darkness corrected based on the correction value H.

It is clear from the above that in this embodiment, when printing the other correction pattern CP, the above-described correction value H is used and the corresponding raster line is formed at the darkness corrected by that correction value H. By adopting this method, the other correction pattern CP is printed at a darkness that has been corrected by the correction value, and thus darkness nonuniformities in the carrying direction have been corrected. The pixel darkness of the other correction pattern CP is measured, after correction, to obtain an other correction value H2, and thus it is possible to suppress fluctuation in the measured pixel darkness and thereby increase the reliability of the other correction value H2.

Figure 49:
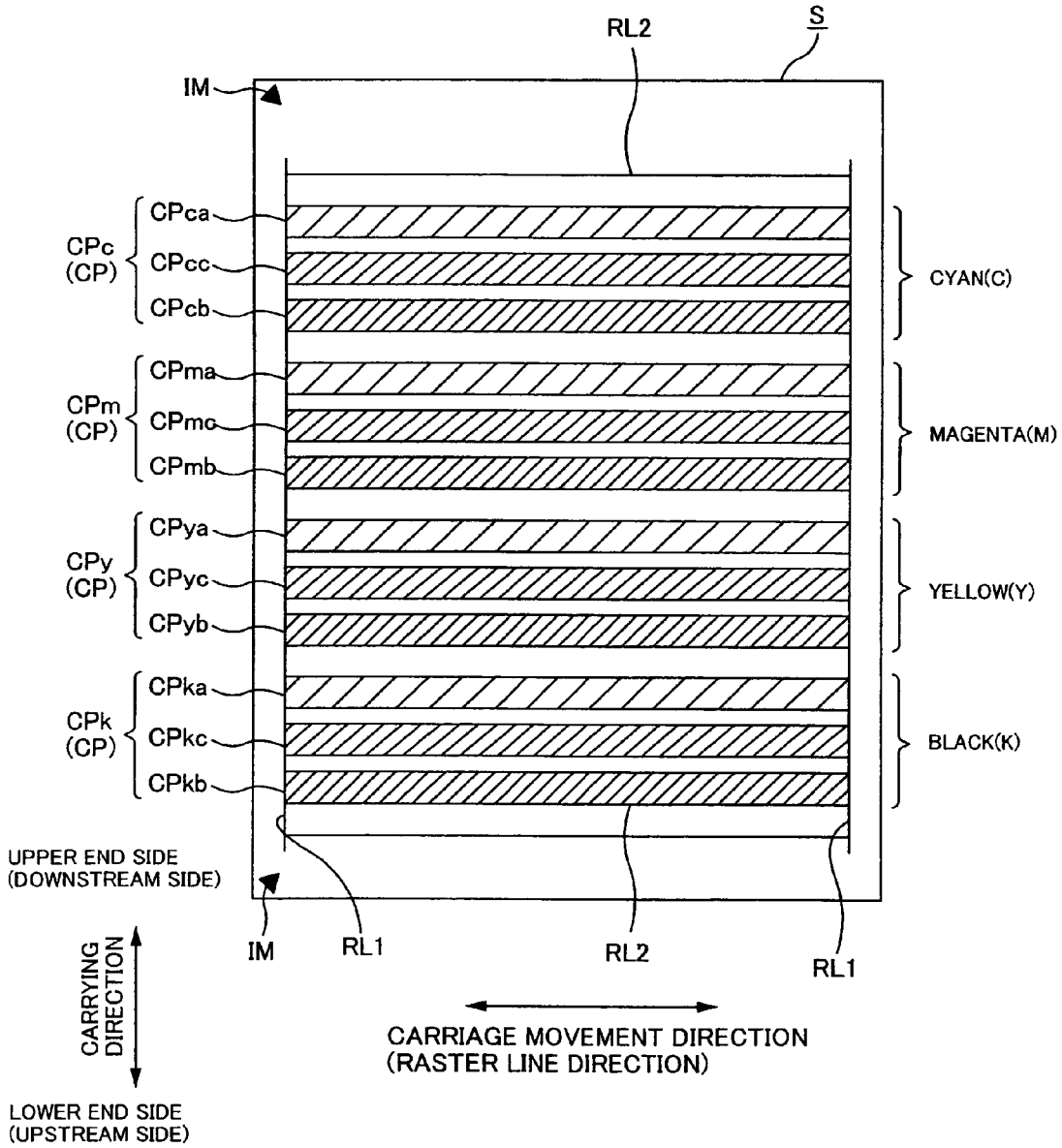
FIG. 49 is a diagram describing an example of the other correction pattern CP.

FIG. 49 is a diagram for describing an example of the other correction pattern CP. As shown in the drawing, the other correction pattern CP of the present embodiment is printed in divisions of ink color and darkness. That is, the other correction pattern CP can be said to have a plurality of types of band-shaped patterns each having a different ink color and darkness. The gradation values of the pixel data in the other correction pattern CP are set to the same value for each division of darkness. Thus, each correction pattern CP is printed at substantially the same darkness over the entire region in the carriage movement direction.

In the other correction pattern CP that is shown, the first through third patterns from the upper end of the paper are the other correction patterns CP for cyan (C). The fourth through sixth patterns from the upper end of the paper are the other correction patterns CP for magenta (M). The seventh through ninth patterns from the upper end of the paper are the other correction patterns CP for yellow (Y), and the tenth through twelfth patterns from the upper end of the paper are the other correction patterns CP for black (K).

The patterns for each color have different print darkness. In other words, the patterns for each color are a pattern that is printed at a reference gradation value at which darkness nonuniformities occur easily, a pattern that is printed at a low-darkness-side gradation value that is lower than the reference gradation value, and a pattern that is printed at a high-darkness-side gradation value that is higher than the reference gradation value. Using black as an example, the upper pattern CPka (the tenth pattern from the upper end of the paper) is printed at the low-darkness-side gradation value, the middle pattern CPkc (the eleventh pattern from the upper end of the paper) is printed at the reference gradation value, and the lower end pattern CPkb (the twelfth pattern from the upper end of the paper) is printed at the high-darkness-side gradation value.

It should be noted that the reference gradation value, the low-darkness-side gradation value, the high-darkness-side gradation value, and the reason why a pattern with a plurality of darkness is used, are the same as those with regards to the correction pattern CP mentioned above, and thus description thereof is omitted.

In principle, the only difference between the other correction patterns CP is the ink color. For this reason, hereinafter the black (K) correction pattern CPk is described as a representative correction pattern CP. Further, in the following description there are sections that describe only the color black (K), but as mentioned above, the same also applies for the other ink colors C, M, and Y as well.

The other correction pattern CPk that is illustratively shown is printed in a band shape that is long in the carriage movement direction. The print region in the carrying direction is approximately the entire region from one side of the paper S in the width direction (the direction corresponding to the carriage movement direction) to the other. In this embodiment, printing of the other correction pattern CP is stopped slightly before the edge of the paper S, forming a margin. In these margins, a vertical reference ruled line RL1 extending in the carrying direction (these correspond to the "intersecting-side reference ruled line" in the claims) is formed. The vertical reference ruled lines RL1 are the same as those in the above embodiment, and are used when correcting tilt in the image data read by the scanner device 100. Further, horizontal reference ruled lines RL2 (these correspond to the "movement-side reference ruled line" in the claims) is formed in the carriage movement direction both above the upper cyan pattern toward the upper end of the paper S and below the lower black pattern toward the lower-end side of the paper S. The horizontal reference ruled lines RL2 also are used when correcting tilt in the image data read by the scanner device 100.

Further, in the present embodiment, index markers IM indicating the position of the paper S are printed in the margin on the left or right side of the paper S, and more specifically in the corner portions of the paper S. The index markers IM are used when recognizing the right and the left of an image in image data obtained by reading with the scanner device 100. In other words, when reading the darkness of the correction pattern CP, the computer 1100 determines the left and right side of the image that has been read based on the index markers IM. Thus, when reading the correction pattern CP, even if a worker on the inspection line mistakes the left and right sides of the correction pattern CP when placing the paper S on the original document bed, measurement can be performed without problem.

It should be noted that the other correction pattern CP of FIG. 49 is only one example, and it can be suitably changed. For example, if the other correction value H2 is required over the entire carriage movement direction (main-scanning direction), then the other correction patterns CP of the respective colors can be formed contiguously over the entire region in the width direction of the paper S. In this case, only the horizontal reference ruled lines RL2 are printed, and the vertical reference ruled lines RL1 are not printed. That is, it is only necessary that at least one of either the vertical reference ruled lines RL1 and the horizontal reference ruled lines RL2 are formed.

(6) Reading the Other Correction Patterns CP (Step S126)

Next, the other correction patterns CP that have been printed are read by the scanner device 100. In step S126, first a worker on the inspection line places the paper S on which the other correction patterns CP have been printed onto the original document bed 102. Once the paper S has been placed, the worker specifies the reading conditions through the user interface of the computer 1100 and then gives out a command to initiate reading. Here, it is preferable that the reading resolution in the movement direction of the reading carriage 104 is several integer multiples finer than the pitch between dots adjacent in the main-scanning direction. By doing this, the measurement values of the darkness that is read and the pixels can be correlated easily, allowing the measurement accuracy to be increased. When it has received the command to initiate reading, the controller (not shown) of the scanner device 100 controls the reading carriage 104, for example, to read the other correction patterns CP printed on the paper S and obtain data groups in units of pixels. The data groups that are obtained are then transferred to the memory of the computer 1100.

Figure 50:
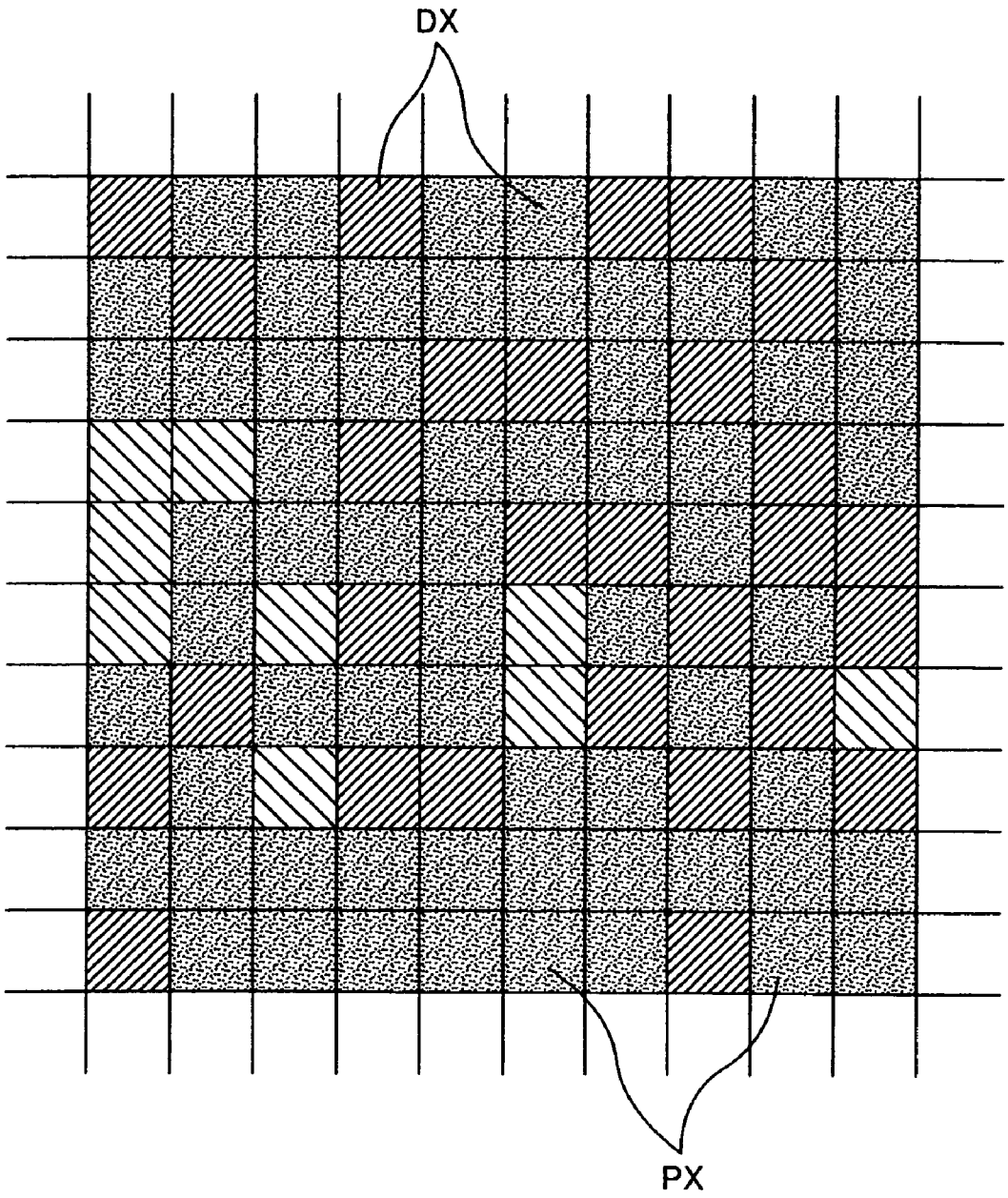
FIG. 50 is a diagram for describing the darkness of the pixels that is read by the scanner device.

In this case as well, the pitch at which adjacent light-receiving elements are arranged in the linear sensor 108 and the pitch at which the dots are formed in the other correction patterns CP do not always match. Thus, as mentioned above, the point where the dots and the path over which the light-receiving elements move intersect one another is not fixed, and fluctuations occur in the detection darkness. Consequently, the darkness of the pixels after being read by the scanner device 100 becomes irregular for example due to the position where the dots are read, as shown in FIG. 50. Further, the other correction patterns CP are printed in halftone, and thus discrepancies may also occur due to the size of the dots. Accordingly, the darkness of a plurality of pixels at the same main-scanning position is measured, and the other correction value H2 is obtained based on the darkness.

(7) Measuring the Darkness of the Other Correction Patterns CP (Step S127)

Figure 51:
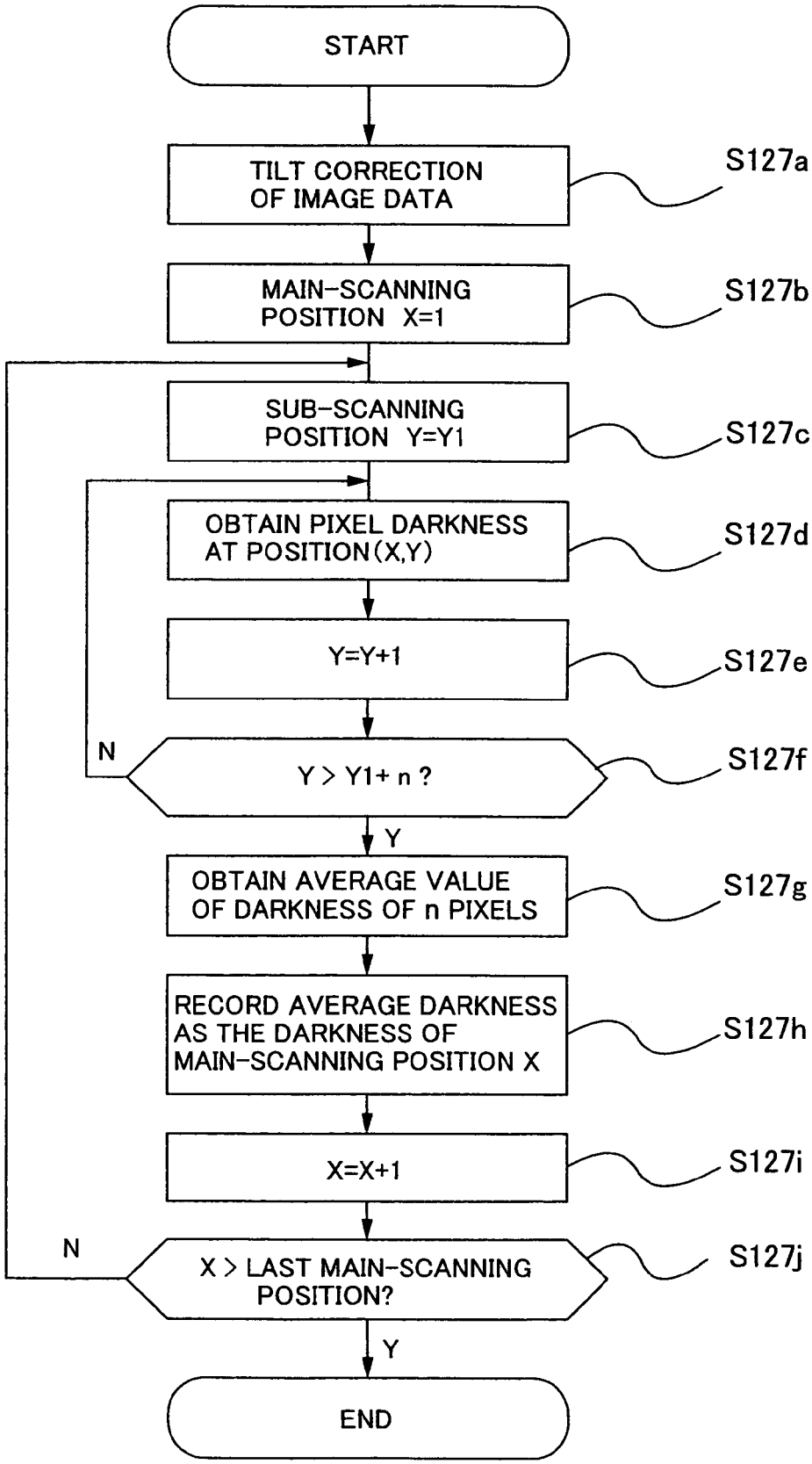
FIG. 51 is a flowchart showing the specific procedure of step S127 in FIG. 48.

FIG. 51 is a flowchart showing in detail the procedure of the step S127 in FIG. 48. The computer 1100A executes the procedure of the step S127 under the process correction program. Measurement of the darkness of the other correction patterns CP is described below with reference to this flowchart.

The computer 1100A first in step S127*a* performs tilt correction of the transferred data groups (S127*a*). This tilt processing is the same as the tilt processing described above (S123*a*; see FIG. 39 and FIG. 40). That is, in step S127*a* the computer 1100 obtains the coordinates of the vertical reference ruled lines RL1 and the horizontal reference ruled lines RL2, and calculates the amount of deviation from a reference position for each raster line or each virtual line. The computer 1100 then shifts the data of the corresponding pixels based on the amount of deviation that has been calculated. Once this correction has been performed for every raster line and every virtual line in the image of the other correction patterns CP, the procedure is advanced to step S127*b*.

By performing tilt correction, even if the correction pattern CP has been read shifted off of the normal position, this shifting can be corrected. Then, because the pixel darkness is measured after shifting has been corrected, the reliability of the correction values H and the other correction values H2 can be increased. Further, shifting of the pattern can be automatically corrected through the above image processing. Therefore, an increase in processing efficiency can also be achieved.

Next, the computer 1100 measures the darkness of a plurality of pixels at the same main-scanning position of the correction pattern CP. First, the computer 1100 obtains position information for a first main-scanning position to be measured (S127*b*). In this embodiment, darkness is measured from the main-scanning position on the furthermost left, and thus a value "1" (X=1) is obtained as the data for the main-scanning position. Once the information on the main-scanning position has been obtained, the computer 1100 obtains position information indicating the position in the sub-scanning direction of the pixel to be measured (S127*c*). Here, the position in the sub-scanning direction differs depending on the other correction pattern CP to be measured. Thus, in this step, Y1 (Y=Y1) is obtained as the sub-scanning position information. It should be noted that as shown in FIG. 49, the other correction patterns CP of this embodiment have a narrow band-shape that is long in the horizontal direction, and as will be discussed later, the pixel to be measured moves successively toward the lower end of the paper S. Thus, it is preferable that the position in the sub-scanning direction is set to a position on the upper end of the correction patterns CP. Once the information X on the main-scanning position and the information Y on the sub-scanning position have been obtained, the darkness of the pixel specified by these positions is obtained (S127*d*). Once the darkness of this pixel has been obtained, the value of the Y coordinate is increased by 1 (Y=Y+1) (S127*e*). That is, the pixel to be measured is reset to the pixel adjacent toward the lower end in the carrying direction. Then, it is determined whether or not the new Y coordinate that is obtained by adding 1 is greater than a threshold value (Y1+n) (S127*f*). Here, if the Y coordinate does not exceed the threshold value (Y1+n), then the procedure is returned to step S127*d* and the darkness of the pixel specified by the new Y coordinate is obtained.

It should be noted that the threshold value is defined as the number of pixels whose darkness is to be obtained (corresponds to n above). This number of pixels can be set to any value, but like in the above embodiment, preferably it is set to within a range from several tens to several hundreds of pixels, and more preferably is set to within the range of 50 to 200. In the present embodiment, it has been set to 50. Thereafter, the operations of the steps S127*d* to S127*f* are repeated, successively obtaining the darkness of the pixels.

If it is determined in step S127*f* that the Y coordinate has exceeded the threshold value (Y1+n), that is, if the darkness for the last pixel to be measured at that main-scanning position has been measured, then the procedure advances to step S127*g*, and the average darkness value of the n-number of pixels to be measured is found. Once the average darkness value has been obtained, the procedure advances to step S127*h*, and the average darkness value that has been obtained is stored in the corresponding record of the recording table as the darkness at that main-scanning position. Once the average darkness value has been stored, the above procedure is performed for the next main-scanning position. That is, in step S127*i* the value of the X coordinate is increased by 1 (X=X+1). In other words, the main-scanning position to be measured is reset to a pixel that is positioned adjacent to the right in the main-scanning direction. It is then determined whether or not the new X coordinate that has been obtained by adding 1 is greater than the final main-scanning position (S127*j*). Here, if the X coordinate has not exceeded the final main-scanning position, then the procedure is returned to step S127*c* and the darkness of the main-scanning position specified by the new X coordinate is obtained (S127*c* to S127*h*). On the other hand, if the X coordinate does exceed the final main-scanning position, then darkness measurement for that correction pattern CP is ended, and darkness measurement for the next correction pattern CP is performed.

Due to the reasons discussed above, irregularities can occur in the measured darkness between pixels, even for pixels at the same main-scanning position. Therefore, it can be understood that by taking an average of a plurality of pixels at that main-scanning position it is possible to accurately obtain the darkness at each main-scanning position. It should be noted that in this procedure as well, the plurality of pixels whose darkness is measured are adjacent to one another; this is to take into account the possibility that darkness nonuniformities in the carrying direction (sub-scanning direction) may occur periodically. As mentioned above, in this embodiment the darkness nonuniformities that occur in the carrying direction are corrected, but the difference in dot size remains. Thus, by using the average darkness of a plurality of pixels, it is possible to effectively inhibit darkness irregularities between the pixels due to differences in the dot size.

(8) Setting the Darkness Correction Value for Each Main-Scanning Position (Step S128)

Next, the computer 1100 sets the darkness correction value for each main-scanning position. Here, the computer 1100 calculates the darkness correction value based on the measured values that have been recorded in the records of the recording tables (see FIG. 46), and records this other correction value in the corresponding record of the correction value storage section 63*a* of the printer 1 (see FIG. 47).

Figure 52:
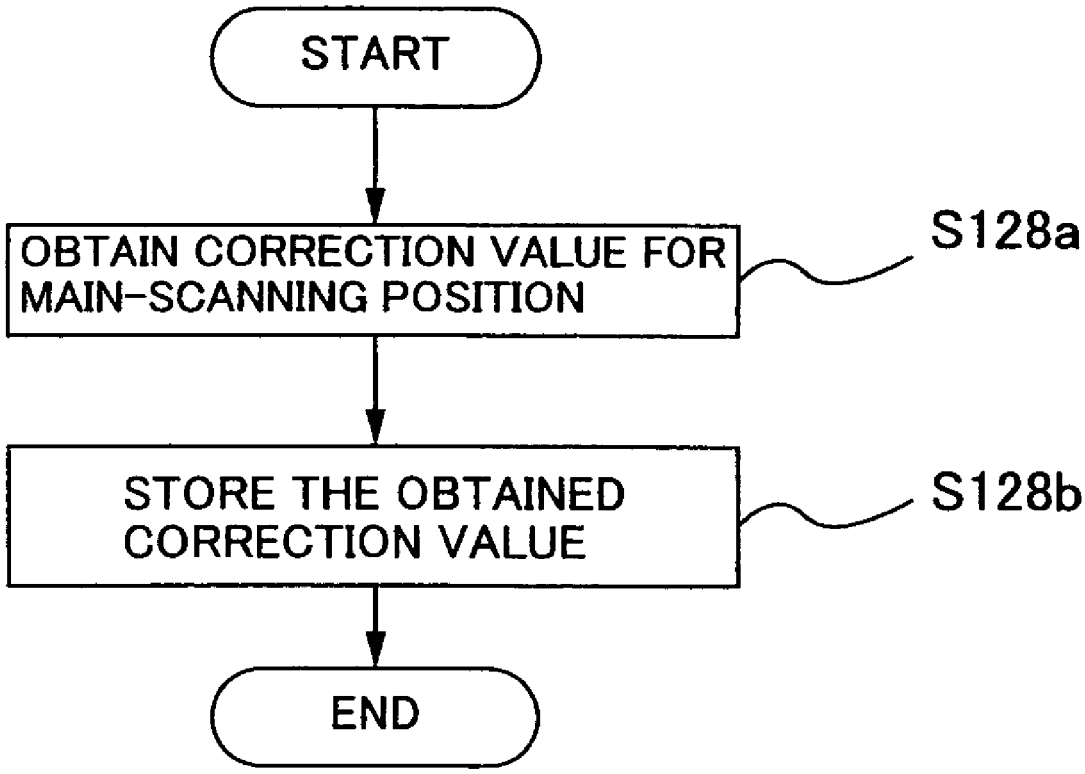
FIG. 52 is a flowchart showing the specific procedure of step S128 in FIG. 48.

Next, this other correction value is found in a correction ratio format that indicates the ratio of correction with respect to the gradation value of the darkness; more specifically, this is performed in accordance with the flowchart of FIG. 52. First, the computer 1100 calculates the other correction value H2 (S128*a*). Here, the other correction value H2 is calculated by performing primary interpolation using the three information pairs (Sa, Ca), (Sb, Cb), and (Sc, Cc) of the pairing between the command values Sa, Sb, and Sc and the measurement values Ca, Cb, and Cc recorded to the records of the recording tables, and that other correction value H2 is set in the other correction value table. It should be noted that the details of this setting procedure are the same as those for setting a darkness correction value for each raster line described above.

That is, the other correction value H2 is obtained by substituting concrete values for Ca, Cb, Cc, Sa, Sb, Sc, Ss, and Ss1 in following Formulas 3, 5, and 7'.

$$So=(Ss1-Ca)/[(Ca-Cc)/(Sa-Sc)]+Sa \quad \text{Formula 3}$$

$$So=(Ss1-Cc)/[(Cc-Cb)/(Sc-Sb)]+Sc \quad \text{Formula 5}$$

$$H2=\Delta S/Ss=(So-Ss)/Ss \quad \text{Formula 7'}$$

In this processing the other correction value is obtained through primary interpolation, and thus the processing is simplified, allowing work efficiency to be improved. Further, because three information pairs are used in this process, the other correction value H2 can be calculated with high accuracy. In other words, in general, the slope between lines used for primary interpolation may be different in the range of a higher darkness and the range of a lower darkness than the reference. In such cases as well, with this method, primary interpolation can be performed using the two information pairs of (Sb, Cb) and (Sc, Cc) with respect to the range of higher darkness than the reference darkness, and primary interpolation can be performed using the two information pairs of (Sa, Ca) and (Sc, Cc) with respect to the range of lower darkness than the reference darkness. Thus, the other correction value H2 can be calculated with high accuracy even when the slope between lines used for primary interpolation is different.

Then, the other correction value H2 that is obtained in this manner is stored in the other correction value table shown in FIG. 47 (S128*b*). In other words, the computer 1100 reads the three information pairs (Sa, Ca), (Sb, Cb), and (Sc, Cc) from the same record on the recording table and substitutes these into Formula 3, Formula 5, and Formula 7 to calculate the other correction value H2, and then records the calculated other correction value to the record of the same record number in the other correction value table.

Thus, by using this other correction value H2 to perform darkness correction, which is discussed later, fluctuations in the darkness in each main-scanning position can be made small for each ink color, allowing darkness nonuniformities to be inhibited even more.

<Step S140: Actual Printing of the Image While Performing Darkness Correction for Each Raster Line>

The printer 1 in which darkness correction values have been set in this manner is shipped and used for an actual printing by a user. In the actual printing, the printer driver 1110 and the printer 1 work in cooperation to perform darkness correction for each raster line and execute printing in which darkness nonuniformities are inhibited. The operation here is the same as the operation in the above embodiment. That is, the printer driver 1110 changes the 2-bit pixel data based on the correction value when converting the RGB image data into print data. It then outputs print data based on the corrected image data to the printer 1. The printer 1 forms the dots of the corresponding raster line based on those print data.

(1) Regarding the Method for Correcting Pixel Data Based on the Correction Value:

Correction of the pixel data based on the correction value is performed through halftone processing, as in the embodiment discussed above. In halftone processing, pixel data having gradation values of 256 grades are converted into pixel data having gradation values of four grades indicating "no dot formation," "small dot formation," "medium dot formation," and "large dot formation". During this conversion, the 256 gradations are first substituted with level data and then converted into gradation values of four gradation. In the present embodiment, at the time of this conversion, the level data are changed by the amount of the correction value H and the other correction value H2 so as to correct the four-gradation-value pixel data, thus performing "correction of pixel data based on the correction value and the other correction value."

It should be noted that the halftone processing here differs from the halftone processing that has already been described using FIG. 3 in that it includes steps S301, S303, and S305 for setting the level data, and otherwise the two are identical. Consequently, this difference is emphasized in the following description, and aspects that are the same have been summarized. Further, the following description is made with reference to the flowchart of FIG. 3 and the dot creation ratio table of FIG. 4.

First, the printer driver 1110 obtains the K image data in step S300 like in ordinary halftone processing. It should be noted that at this time the C, M, and Y image data also are obtained, but because the following description can be applied to any of the C, M, and Y image data as well, the K image data are described representing these image data.

Next, in step S301, the printer driver 1110 reads, for each pixel data, the level data LVL corresponding to that pixel data gradation value from the large dot profile LD of the creation ratio table. However, in the present embodiment, when the level data LVL are read, their gradation value is shifted by the correction value H corresponding to the raster line (pixel data row) to which the pixel data belongs and by the correction value H2 corresponding to the main-scanning position to which the pixel data belongs.

For example, if the gradation value of the pixel data is gr and the pixel data row to which that pixel data belongs is the first row, then that pixel data row is correlated to the correction value H of the first record in the recording table for the first upper end processing. Consequently, the gradation value gr is shifted by a value Δgr (=gr×H) that is obtained by multiplying the correction value H by the gradation value gr.

Further, if that pixel data belongs to the first main-scanning position (pixel on the left edge), then that pixel data row is correlated to the correction value H2 of the first record in the recording table. Consequently, the gradation value gr is further shifted by a value Δgr2 (=gr×H2) that is obtained by multiplying this other correction value H2 by the gradation value gr. It should be noted that in the example of the diagram, the value Δgr2 is a correction value correcting toward the lower-darkness side.

Thus, the level data LVL of the gradation value indicated by (gr+Δgr)−Δgr2 is read in step S301. As a result, the level data LVL is found to be 21d.

In step S302, the printer driver 1110 determines whether or not the level data LVL of this large dot is greater than the threshold value THL of the pixel block corresponding to that pixel data on the dither matrix. Further, the level data LVL is changed by the value Δgr and the value Δgr2 based on the correction value H and the correction value H2. Consequently, the result of this size determination is changed by that amount of change, and thus the tendency of the large dots being formed also changes. As a result, the "correction of pixel data based on the correction value and the other correction value" mentioned above is achieved. If in step S302 the level data LVL is larger than the threshold value THL, then the procedure is advanced to step S310 and large dot is recorded corresponding to that pixel data. Otherwise the procedure is advanced to step S303.

In step S303, the printer driver 1110 reads the level data LVM corresponding to the gradation value from the medium dot profile MD of the creation ratio table, and at this time, as in step S301, the level data LVM is read shifting the gradation value by the value Δgr and the value Δgr2. As a result, a level data LVM of 22d is obtained.

Next, in step S304, the printer driver 1110 determines whether or not the level data LVM of this medium dot is greater than the threshold value THM of the pixel block corresponding to that pixel data on the dither matrix. Here also, the level data LVM is changed by the values Δgr and Δgr2. Consequently, the result of this size determination is changed by that amount of change, and thus the tendency of the medium dots being formed also changes, and as a result, the "correction of pixel data based on the correction value and the other correction value" mentioned above is achieved. If in step S304 the level data LVM is larger than the threshold value THM, then the procedure is advanced to step S309 and a medium dot is recorded corresponding to that pixel data. Otherwise the procedure is advanced to step S305.

In step S305, the printer driver 1110 reads the level data LVS corresponding to the gradation value from the small dot profile SD of the creation ratio table, and like in step S301, at this time the level data LVS is read shifting the gradation value by the values Δgr and Δgr2. As a result, a level data LVS of 33d is obtained.

Then, in step S306, the printer driver 1110 determines whether or not the level data LVS of this small dot is larger than the threshold value THS of the pixel block corresponding to that pixel data on the dither matrix. Here as well, the level data LVS is changed by the value Δgr based on the correction value H and Δgr2 based on the other correction value H2. Consequently, the result of this size determination changes by that amount of change, and thus the tendency of the small dots being formed also changes, and as a result, the "correction of pixel data based on the correction value and the other correction value" mentioned above is achieved.

It should be noted that if in step S306 the level data LVS is larger than the threshold value THS, then the procedure is advanced to step S308, and a small dot is recorded corresponding to that pixel data. Otherwise the procedure is advanced to step S307 and no dot is recorded corresponding to that pixel data.

OTHER EMBODIMENTS

The above embodiment was written primarily with regard to the printer 1, but the above embodiment of course also includes the disclosure of a printing device, a printing method, and a printing system, for example.

A printer 1, for example, was described as one embodiment, but the foregoing embodiment is for the purpose of elucidating the present invention and is not to be interpreted as limiting the present invention. The invention can of course be altered and improved without departing from the gist thereof and includes equivalents. In particular, the embodiments discussed below are also included in the present invention.

<Regarding the Printer>

In the above embodiments, the printer 1 and the scanner device 100 are configured separately, and each is communicably connected to the computer 1000A. However, application of the present invention is not limited this configuration. For example, the present invention can also be applied to a so-called printer-scanner multifunction device that has both the function of the printer 1 and the function of the scanner device 100.

Further, a printer 1 was described in the above embodiments, but the present invention is not limited to this. For example, the same technology as in the present embodiment can be applied to a various types of devices employing inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. The methods for, and the manufacturing methods of, these also fall within the scope to which the present invention can be applied.

<Regarding the Ink>

The above embodiment was of the printer 1, and thus a dye ink or a pigment ink was ejected from the nozzles. However, the ink that is ejected from the nozzles is not limited to such inks.

<Regarding the Nozzles>

In the foregoing embodiments, ink was ejected using piezoelectric elements. However, the method for ejecting ink is not limited to this. For example, it is also possible to employ other methods as well, such as a method where bubbles are generated within the nozzles due to heat.

<Regarding the Print Mode>

Interlacing was described as an example of the print mode in the above embodiments, but the print mode is not limited to this, and it is also possible to use the so-called overlapping mode. With interlacing, a single raster line is formed by a single nozzle, whereas with overlapping, a single raster line is formed by two or more nozzles. That is, with overlapping, each time the paper S is carried by a predetermined carry amount F in the carrying direction, the nozzles, which move in the carriage movement direction, intermittently eject ink droplets at intervals of every several pixels, intermittently forming dots in the carriage movement direction. Then, in another pass, dots are formed such that the intermittent dots already formed by the other nozzle are completed in a complementary manner. Thus, a single raster line is completed by a plurality of nozzles.

<Regarding the Target of Darkness Correction>

In the above embodiments, darkness correction is performed based on the correction value H and the other correction value H2 during halftone processing, but the present invention is not limited to this method. For example, it is also possible to adopt a configuration in which darkness correction is performed based on the correction value H and the other correction value H2 with respect to the RGB image data that are obtained through, for example, the resolution conversion processing.

<Regarding the Carriage Movement Direction in which Ink is Ejected>

The foregoing embodiment describes an example of single-direction printing in which ink is ejected only when the carriage 31 is moving forward, but this is not a limitation, and it is also possible to perform so-called bi-directional printing in which ink is ejected both when the carriage 31 is moving forward and backward.

<Regarding the Color Inks Used for Printing>

The foregoing embodiment describes an example of multicolor printing in which the four color inks, cyan (C), magenta (M), yellow (Y), and black (K), are ejected onto the paper S to form dots, but the ink colors are not limited to these. For example, it is also possible to use other inks in addition to these, such as light cyan (LC) and light magenta (LM). Alternatively, it is also possible to perform single-color printing using only one of these four colors.

What is claimed is:

1. A printing method comprising:

printing, on a medium, a correction pattern that is made of a plurality of lines, said plurality of lines being formed by repeating in alternation a dot forming operation of forming dots on the medium by ejecting ink from a plurality of nozzles that move in a predetermined movement direction, and a transporting operation of transporting said medium in an intersecting direction that intersects said movement direction;

measuring, for each line of said correction pattern, the darkness of a plurality of pixels located on a same line of said correction pattern;

obtaining, for each line of said correction pattern, a correction value for correcting a darkness, in said intersecting direction, of an image to be printed based on the darkness of said plurality of pixels that has been measured;

setting, for each line of said image, said correction value that has been obtained;

correcting, for each line of said image, a gradation value of each pixel data based on said correction value that has been set for each line of said image; and forming, in said dot forming operation, dots of a corresponding line based on said corrected gradation values, wherein a plurality of types of processing modes are provided for executing print processing, in which said transporting operation is different from that in another print processing, the processing modes including an end processing mode for printing an end portion of said medium and an intermediate processing mode for printing an intermediate portion of said medium;

wherein in obtaining said correction value, at least two correction patterns respectively corresponding to said end processing mode and said intermediate processing mode are printed on said medium respectively by said end processing mode and said intermediate processing mode, and said correction value is obtained for each processing mode; and wherein a portion of said medium where the correction pattern corresponding to said end processing mode is printed is closer to an edge of said medium than a portion of said medium where the correction pattern corresponding to said intermediate processing mode is printed.

2. A printing method according to claim 1, wherein said correction value is obtained from an average value of the darkness of said plurality of pixels that has been measured.

3. A printing method according to claim 1, wherein said plurality of pixels whose darkness is to be measured are adjacent to one another.

4. A printing method according to claim 1, wherein said correction pattern has a plurality of types of patterns each having a different darkness.

5. A printing method according to claim 1, wherein the print processing being different in said transporting operation is print processing in which a pattern of change in a transport amount of each said transporting operation is different from that in another print processing; and wherein the print processing being different in said dot forming operation is print processing in which a pattern of change in the nozzles that are used in each said dot forming operation is different from that in another print processing.

6. A printing method according to claim 1, wherein an other correction value for correcting a darkness, in said movement direction, of said image is set for each pixel aligned in said movement direction; and wherein in said dot forming operation, dots of a corresponding line for which said correction value and said other correction value have been set are formed at a darkness that has been corrected based on said correction value and said other correction value.

7. A printing method according to claim 6, wherein said other correction pattern is printed such that its darkness becomes the darkness corrected by said correction value, and said other correction value is obtained based on that other correction pattern.

8. A printing method according to claim 6, wherein said other correction pattern has a plurality of types of patterns each having a different darkness.

9. A printing method according to claim 6, wherein said other correction value is obtained by:

printing, on the medium, an other correction pattern;

measuring the darkness of a plurality of pixels located at a same position, in said movement direction, of said other correction pattern; and obtaining said other correction value based on the darkness of said plurality of pixels that has been measured.

10. A printing method according to claim 9, wherein said other correction value is obtained from an average value of the darkness of said plurality of pixels that has been measured.

11. A printing method according to claim 1, wherein the darkness of said plurality of pixels is measured using a scanner device that is capable of reading an image that has been printed on said medium as data groups in units of pixels.

12. A printing method according to claim 11, wherein at least one of a movement-side reference ruled line extending in said movement direction and an intersecting-side reference ruled line extending in said intersecting direction is formed on said medium together with said correction pattern or other correction pattern;

wherein the data groups read by said scanner device are corrected based on said reference ruled line; and wherein the darkness of said plurality of pixels is measured for said data groups that have been corrected.

13. A printing method according to claim 1, wherein a plurality of said nozzles constitute a nozzle row aligned in said intersecting direction.

14. A printing method according to claim 13, wherein said nozzle row is provided for each color of said ink;

wherein, by printing at least one of said correction pattern and other correction pattern for each said color, at least one of said correction value and said other correction value is provided for each said color; and wherein the darkness of the image is corrected for each color based on at least one of the correction value and the other correction value for that color.

15. A printing method according to claim 13, wherein a line that is not formed is set between said lines that are formed in a single said dot forming operation; and wherein the lines are formed in a complementary manner through a plurality of the dot forming operations.

16. A printing method comprising:

printing, on a medium, a correction pattern that is made of a plurality of lines, said plurality of lines being formed by repeating in alternation a dot forming operation of forming dots on the medium by ejecting ink from a plurality of nozzles that move in a predetermined movement direction, and a transporting operation of transporting said medium in an intersecting direction that intersects said movement direction;

measuring, for each line of said correction pattern, the darkness of a plurality of pixels located on a same line of said correction pattern;

obtaining, for each line of said correction pattern, a correction value for correcting a darkness, in said intersecting direction, of an image to be printed based on the darkness of said plurality of pixels that has been measured;

setting, for each line of said image, said correction value that has been obtained;

correcting, for each line of said image, a gradation value of each pixel data based on said correction value that has been set for each line of said image; and forming, in said dot forming operation, dots of a corresponding line based on said corrected gradation values;

wherein a plurality of types of processing modes are provided for executing print processing, in which said transporting operation is different from that in another print processing, the processing modes including an end processing mode for printing an end portion of said medium and an intermediate processing mode for printing an intermediate portion of said medium;

wherein in obtaining said correction value, at least two correction patterns respectively corresponding to said end processing mode and said intermediate processing mode are printed on said medium respectively by said end processing mode and said intermediate processing mode, and said correction value is obtained for each processing mode;

wherein said correction value is obtained from an average value of the darkness of said plurality of pixels that has been measured;

wherein an other correction value for correcting a darkness, in said movement direction, of said image is set for each pixel aligned in said movement direction;

wherein in said dot forming operation, dots of a corresponding line for which said correction value and said other correction value have been set are formed at a darkness that has been corrected based on said correction value and said other correction value;

wherein said other correction value is obtained by:

printing, on the medium, an other correction pattern;

measuring the darkness of a plurality of pixels located at a same position, in said movement direction, of said other correction pattern; and obtaining said other correction value based on the darkness of said plurality of pixels that has been measured;

wherein said other correction value is obtained from an average value of the darkness of said plurality of pixels that has been measured;

wherein said other correction pattern is printed such that its darkness becomes the darkness corrected by said correction value, and said other correction value is obtained based on that other correction pattern;

wherein said plurality of pixels whose darkness is to be measured are adjacent to one another;

wherein said correction pattern has a plurality of types of patterns each having a different darkness;

wherein said other correction pattern has a plurality of types of patterns each having a different darkness;

wherein the darkness of said plurality of pixels is measured using a scanner device that is capable of reading an image that has been printed on said medium as data groups in units of pixels;

wherein at least one of a movement-side reference ruled line extending in said movement direction and an intersecting-side reference ruled line extending in said intersecting direction is formed on said medium together with said correction pattern or said other correction pattern;

wherein the data groups read by said scanner device are corrected based on said reference ruled line;

wherein the darkness of said plurality of pixels is measured for said data groups that have been corrected;

wherein a plurality of said nozzles constitute a nozzle row aligned in said intersecting direction;

wherein said nozzle row is provided for each color of said ink;

wherein, by printing at least one of said correction pattern and said other correction pattern for each said color, at least one of said correction value and said other correction value is provided for each said color;

wherein the darkness of the image is corrected for each color based on at least one of the correction value and the other correction value for that color;

wherein a line that is not formed is set between said lines that are formed in a single said dot forming operation;

wherein the lines are formed in a complementary manner through a plurality of the dot forming operations;

wherein the print processing being different in said transporting operation is print processing in which a pattern of change in a transport amount of each said transporting-operation is different from that in another print processing;

wherein the print processing being different in said dot forming operation is print processing in which a pattern of change in the nozzles that are used in each said dot forming operation is different from that in another print processing; and wherein a portion of said medium where the correction pattern corresponding to said end processing mode is printed is closer to an edge of said medium than a portion of said medium where the correction pattern corresponding to said intermediate processing mode is printed.

17. A printing apparatus comprising:

nozzles for ejecting ink; and a transporting unit for transporting a medium;

wherein by repeating in alternation a dot forming operation of forming dots on said medium by ejecting ink from a plurality of said nozzles that move in a predetermined movement direction, and a transporting operation of transporting said medium in an intersecting direction that intersects said movement direction using said transporting unit, said printing apparatus forms, in said intersecting direction, a plurality of lines each made of a plurality of dots aligned in said movement direction to print an image;

wherein a correction value for correcting a darkness, in said intersecting direction, of said image is set for each line;

wherein in said dot forming operation, dots of a corresponding line are formed based on corrected gradation values;

wherein, for each line of said image, said gradation value of each pixel data is corrected based on said correction value that has been set for each line of said image;

wherein said correction value is obtained by:

printing, on the medium, a correction pattern that is made of a plurality of the lines;

measuring, for each line of said correction pattern, the darkness of a plurality of pixels located on a same line of said correction pattern; and obtaining, for each line of said correction pattern, said correction value based on the darkness of said plurality of pixels that has been measured, wherein a plurality of types of processing modes are provided for executing print processing, in which said transporting operation is different from that in another print processing, the processing modes including an end processing mode for printing an end portion of said medium and an intermediate processing mode for printing an intermediate portion of said medium, wherein in obtaining said correction value, at least two correction patterns respectively corresponding to said end processing mode and said intermediate processing mode are printed on said medium respectively by said end processing mode and said intermediate processing mode, and said correction value is obtained for each processing mode, and wherein a portion of said medium where the correction pattern corresponding to said end processing mode is printed is closer to an edge of said medium than a portion of said medium where the correction pattern corresponding to said intermediate processing mode is printed.

18. A printing system comprising:

a computer; and a printing apparatus that is communicably connected to said computer, and that is provided with nozzles for ejecting ink and a transporting unit for transporting a medium;

wherein by repeating in alternation a dot forming operation of forming dots on said medium by ejecting ink from a plurality of said nozzles that move in a predetermined movement direction, and a transporting operation of transporting said medium in an intersecting direction that intersects said movement direction using said transporting unit, said printing system forms, in said intersecting direction, a plurality of lines each made of a plurality of dots aligned in said movement direction to print an image;

wherein a correction value for correcting a darkness, in said intersecting direction, of said image is set for each line;

wherein in said dot forming operation, dots of a corresponding line are formed based on corrected gradation values;

wherein, for each line of said image, said gradation value of each pixel data is corrected based on said correction value that has been set for each line of said image;

wherein said correction value is obtained by:

printing, on the medium, a correction pattern that is made of a plurality of the lines;

measuring, for each line of said correction pattern, the darkness of a plurality of pixels located on a same line of said correction pattern; and obtaining, for each line of said correction pattern, said correction value based on the darkness of said plurality of pixels that has been measured; and wherein a plurality of types of processing modes are provided for executing print processing, in which said transporting operation is different from that in another print processing, the processing modes including an end processing mode for printing an end portion of said medium and an intermediate processing mode for printing an intermediate portion of said medium;

wherein in obtaining said correction value, at least two correction patterns respectively corresponding to said end processing mode and said intermediate processing mode are printed on said medium respectively by said end processing mode and said intermediate processing mode, and said correction value is obtained for each processing mode; and wherein a portion of said medium where the correction pattern corresponding to said end processing mode is printed is closer to an edge of said medium than a portion of said medium where the correction pattern corresponding to said intermediate processing mode is printed.

* * * * *